US009193053B2

(12) United States Patent
Rudolph et al.

(10) Patent No.: US 9,193,053 B2
(45) Date of Patent: Nov. 24, 2015

(54) HYBRID IMPACT TOOL

(75) Inventors: Scott M. Rudolph, Aberdeen, MD (US); Daniel Puzio, Baltimore, MD (US); Sankarshan N. Murthy, Cockeysville, MD (US); Aris Cleanthous, Baltimore, MD (US); Joseph Stauffer, Conowingo, MD (US); Robert S. Gehret, Hampstead, MD (US); James D. Hays, Langhorne, PA (US); Qiang J. Zhang, Lutherville, MD (US)

(73) Assignee: BLACK & DECKER INC., Newark, DE (US)

( * ) Notice: Subject to any disclaimer, the term of this patent is extended or adjusted under 35 U.S.C. 154(b) by 1417 days.

(21) Appl. No.: 12/566,046

(22) Filed: Sep. 24, 2009

(65) Prior Publication Data

US 2010/0071923 A1 Mar. 25, 2010

Related U.S. Application Data

(60) Provisional application No. 61/100,091, filed on Sep. 25, 2008.

(51) Int. Cl.

| | |
|---|---|
| ***B25D 16/00*** | (2006.01) |
| ***B25B 21/00*** | (2006.01) |
| ***B25B 21/02*** | (2006.01) |

(52) U.S. Cl.

CPC ..... *B25D 16/006* (2013.01); *B25B 21/00* (2013.01); *B25B 21/02* (2013.01); *B25B 21/026* (2013.01)

(58) Field of Classification Search

CPC ..... B25B 21/00; B25B 21/02; B25B 21/026; B25D 16/006; B25D 2216/0023

USPC ..... 173/46–48, 93.5, 93.6, 93.7, 109, 202, 173/203, 205

See application file for complete search history.

(56) References Cited

U.S. PATENT DOCUMENTS

| | | | | |
|---|---|---|---|---|
| 3,195,702 | A | | 7/1965 | Alexander |
| 3,207,237 | A | | 9/1965 | Wanner |
| 3,414,066 | A | * | 12/1968 | Wallace ..... 173/93.6 |
| 3,584,695 | A | | 6/1971 | Turnbull et al. |
| 3,648,784 | A | | 3/1972 | Schoeps et al. |
| 3,710,873 | A | | 1/1973 | Allen et al. |
| 3,741,313 | A | | 6/1973 | States et al. |
| 4,428,438 | A | | 1/1984 | Holzer et al. |
| 4,986,369 | A | | 1/1991 | Fushiya et al. |

(Continued)

FOREIGN PATENT DOCUMENTS

| | | |
|---|---|---|
| DE | 1949415 | 10/1970 |
| DE | 1652685 | 12/1970 |

(Continued)

*Primary Examiner* — Andrew M Tecco

(74) *Attorney, Agent, or Firm* — Harness, Dickey & Pierce, P.L.C.

(57) ABSTRACT

A power tool having a rotary impact mechanism and a mode change mechanism. The impact mechanism is driven by an output member of a transmission and includes a hammer and an anvil. The mode change mechanism includes a mode collar that is movable between a first position, in which the mode collar directly couples the hammer to the transmission output member to inhibit movement of the hammer relative to the spindle, and a second position in which the mode collar does not inhibit movement of the hammer relative to the spindle. A power tool having an impact mechanism with an external adjusting member that can be moved to vary a trip torque of the impact mechanism is also provided.

16 Claims, 37 Drawing Sheets

(56) References Cited

U.S. PATENT DOCUMENTS

| | | | | |
|---|---|---|---|---|
| 5,025,903 | A | 6/1991 | Elligson | |
| 5,080,180 | A | 1/1992 | Hansson et al. | |
| 5,447,205 | A | 9/1995 | Thurler | |
| 5,457,860 | A | 10/1995 | Miranda | |
| 5,474,139 | A | 12/1995 | Odendahl et al. | |
| 5,673,758 | A | 10/1997 | Sasaki et al. | |
| 5,706,902 | A | 1/1998 | Eisenhardt et al. | |
| 5,836,403 | A | 11/1998 | Putney et al. | |
| 5,868,208 | A | 2/1999 | Peisert et al. | |
| 6,135,212 | A | 10/2000 | Georgiou et sl. | |
| 6,142,242 | A | 11/2000 | Okumura et al. | |
| 6,176,321 | B1 | 1/2001 | Arakawa et al. | |
| 6,196,330 | B1 | 3/2001 | Matthias et al. | |
| 6,223,833 | B1 | 5/2001 | Thurler et al. | |
| 6,457,535 | B1 * | 10/2002 | Tanaka | 173/48 |
| 6,457,635 | B1 | 10/2002 | Scicluna | |
| 6,535,212 | B1 | 3/2003 | Goto et al. | |
| 6,535,636 | B1 | 3/2003 | Savakis et al. | |
| 6,691,796 | B1 * | 2/2004 | Wu | 173/48 |
| 6,805,207 | B2 | 10/2004 | Hagan et al. | |
| 6,834,730 | B2 | 12/2004 | Gass et al. | |
| 6,887,176 | B2 | 5/2005 | Sasaki et al. | |
| 6,892,827 | B2 | 5/2005 | Toyama et al. | |
| 6,976,545 | B2 | 12/2005 | Greitmann et al. | |
| 7,048,075 | B2 | 5/2006 | Saito et al. | |
| 7,073,605 | B2 | 7/2006 | Saito et al. | |
| 7,086,483 | B2 | 8/2006 | Arimura et al. | |
| 7,093,668 | B2 | 8/2006 | Gass et al. | |
| 7,101,300 | B2 | 9/2006 | Milbourne et al. | |
| 7,121,358 | B2 | 10/2006 | Gass et al. | |
| 7,124,839 | B2 * | 10/2006 | Furuta et al. | 173/104 |
| 7,131,503 | B2 | 11/2006 | Furuta et al. | |
| 7,201,235 | B2 | 4/2007 | Umemura et al. | |
| 7,207,393 | B2 | 4/2007 | Clark, Jr. et al. | |
| 7,213,659 | B2 | 5/2007 | Saito et al. | |
| 7,216,749 | B2 | 5/2007 | Droste et al. | |
| 7,223,195 | B2 | 5/2007 | Milbourne et al. | |
| 7,225,884 | B2 | 6/2007 | Aeberhard et al. | |
| 7,306,049 | B2 | 12/2007 | Soika et al. | |
| 7,308,948 | B2 * | 12/2007 | Furuta | 173/48 |
| 7,314,097 | B2 | 1/2008 | Jenner et al. | |
| 7,322,427 | B2 | 1/2008 | Shimma et al. | |
| 7,328,752 | B2 | 2/2008 | Gass et al. | |
| 7,331,408 | B2 | 2/2008 | Arich et al. | |
| 7,331,496 | B2 | 2/2008 | Britz et al. | |
| 7,380,612 | B2 * | 6/2008 | Furuta | 173/29 |
| 7,410,007 | B2 * | 8/2008 | Chung et al. | 173/48 |
| 7,806,198 | B2 * | 10/2010 | Puzio | 173/1 |
| 2003/0146007 | A1 | 8/2003 | Greitmann | |
| 2004/0245005 | A1 | 12/2004 | Toyama et al. | |
| 2005/0028997 | A1 | 2/2005 | Hagan et al. | |
| 2005/0061521 | A1 | 3/2005 | Saito et al. | |
| 2005/0263303 | A1 | 12/2005 | Shimizu et al. | |
| 2005/0263304 | A1 | 12/2005 | Sainomoto et al. | |
| 2005/0263305 | A1 | 12/2005 | Shimizu et al. | |
| 2006/0006614 | A1 | 1/2006 | Buchholz et al. | |
| 2006/0021771 | A1 | 2/2006 | Milbourne et al. | |
| 2006/0086514 | A1 | 4/2006 | Aeberhard | |
| 2006/0090913 | A1 | 5/2006 | Furuta | |
| 2006/0213675 | A1 | 9/2006 | Whitmire et al. | |
| 2006/0237205 | A1 | 10/2006 | Sia et al. | |
| 2006/0254786 | A1 | 11/2006 | Murakami et al. | |
| 2006/0254789 | A1 | 11/2006 | Murakami et al. | |
| 2006/0266537 | A1 | 11/2006 | Izumisawa | |
| 2007/0056756 | A1 | 3/2007 | Chung et al. | |
| 2007/0068692 | A1 | 3/2007 | Puzio | |
| 2007/0068693 | A1 | 3/2007 | Whitmire et al. | |
| 2007/0074883 | A1 | 4/2007 | Strasser et al. | |
| 2007/0084614 | A1 | 4/2007 | Whitmire et al. | |
| 2007/0174645 | A1 | 7/2007 | Lin | |
| 2007/0181319 | A1 * | 8/2007 | Whitmine et al. | 173/48 |
| 2007/0201748 | A1 * | 8/2007 | Bixler et al. | 382/225 |
| 2008/0035360 | A1 | 2/2008 | Furuta | |
| 2008/0041602 | A1 | 2/2008 | Furuta | |
| 2009/0151966 | A1 * | 6/2009 | Chen | 173/48 |

FOREIGN PATENT DOCUMENTS

| | | |
|---|---|---|
| DE | 1941093 | 4/1971 |
| DE | 2557118 | 6/1977 |
| DE | 4038502 | 6/1992 |
| DE | 4328599 | 3/1994 |
| DE | 9404069 | 6/1994 |
| DE | 9406626 | 6/1994 |
| DE | 19954931 | 6/2001 |
| DE | 20209356 | 10/2002 |
| DE | 20304314 | 7/2003 |
| DE | 20305853 | 9/2003 |
| DE | 102004037072 | 1/2006 |
| EP | 0404035 | 12/1990 |
| EP | 0808695 | 11/1997 |
| EP | 1621290 | 2/2006 |
| EP | 1707322 | 10/2006 |
| GB | 1574652 | 9/1980 |
| GB | 2102718 | 2/1983 |
| GB | 2274416 | 7/1994 |
| GB | 2328635 | 3/1999 |
| GB | 2334909 | 9/1999 |
| GB | 2404891 | 2/2005 |
| JP | 62173180 | 7/1987 |
| JP | 62297007 | 12/1987 |
| JP | 63123678 | 5/1988 |
| JP | 2139182 | 5/1990 |
| JP | 2284881 | 11/1990 |
| JP | 3043164 | 2/1991 |
| JP | 3168363 | 7/1991 |
| JP | 6010844 | 1/1994 |
| JP | 6023923 | 2/1994 |
| JP | 6182674 | 7/1994 |
| JP | 6210507 | 8/1994 |
| JP | 6215085 | 8/1994 |
| JP | 07040258 | 2/1995 |
| JP | 7080711 | 3/1995 |
| JP | 7328955 | 12/1995 |
| JP | 9136273 | 5/1997 |
| JP | 9239675 | 9/1997 |
| JP | 10291173 | 11/1998 |
| JP | 2000233306 | 8/2000 |
| JP | 2000246659 | 9/2000 |
| JP | 2001009746 | 1/2001 |
| JP | 2001088051 | 4/2001 |
| JP | 2001088052 | 4/2001 |
| JP | 2001105214 | 4/2001 |
| JP | 2002059375 | 2/2002 |
| JP | 2002178206 | 6/2002 |
| JP | 2002224971 | 8/2002 |
| JP | 2002273666 | 9/2002 |
| JP | 2003071745 | 3/2003 |
| JP | 2003220569 | 8/2003 |
| JP | 2004130474 | 4/2004 |
| JP | 2005052904 | 3/2005 |
| JP | 3655481 | 6/2005 |
| JP | 2006123081 | 5/2006 |
| JP | 2006175562 | 7/2006 |
| WO | WO-9521039 | 8/1995 |
| WO | WO-2007135107 | 11/2007 |

* cited by examiner

HYBRID IMPACT TOOL

CROSS-REFERENCE TO RELATED APPLICATIONS

This application claims the benefit of U.S. Provisional Application No. 61/100,091, filed on Sep. 25, 2008, the disclosure of which is incorporated herein by reference.

FIELD

The present disclosure relates to hybrid impact tools.

BACKGROUND

This section provides background information related to the present disclosure which is not necessarily prior art.

U.S. Pat. No. 7,124,839, JP 6-182674, JP 7-148669, JP 2001-88051 and JP 2001-88052 disclose hybrid impact tools. While such tools can be effective for their intended purpose, there remains a need in the art for an improved hybrid impact tool.

SUMMARY

This section provides a general summary of the disclosure, and is not a comprehensive disclosure of its full scope or all of its features.

In one form, the present disclosure provides a power tool having a motor, a transmission, a rotary impact mechanism and a mode change mechanism. The transmission receives rotary power from the motor and has a transmission output member. The rotary impact mechanism has a spindle, a hammer, a cam mechanism, and an anvil. The hammer is mounted on the spindle. The cam mechanism couples the hammer to the spindle in a manner that permits limited rotational and axial movement of the hammer relative to the spindle. The hammer includes hammer teeth for drivingly engaging a plurality of anvil teeth formed on the anvil. The mode change mechanism has an actuating member and a mode collar. The actuating member is axially movable to affect a position of the mode collar. The mode collar is movable between a first position, in which the mode collar directly couples the hammer to the transmission output member to inhibit movement of the hammer relative to the spindle, and a second position in which the mode collar does not inhibit movement of the hammer relative to the spindle.

In another form, the present disclosure provides a power tool having a motor, a transmission, a rotary impact mechanism, an output spindle and a mode change mechanism. The transmission receives rotary power from the motor and includes a transmission output member. The rotary impact mechanism has a spindle, a hammer, an anvil, a spring and a cam mechanism. The hammer is mounted on the spindle and includes a plurality of hammer teeth. The anvil has a set of anvil teeth. The spring biases the hammer toward the anvil such that the hammer teeth engage the anvil teeth. The cam mechanism couples the hammer to the spindle such that the hammer teeth can move axially rearward to disengage the anvil teeth. The output spindle is coupled for rotation with the anvil. The mode change mechanism includes a mode collar that is axially movable between a first position and a second position. Rotary power transmitted between the hammer and the anvil during operation of the power tool flows exclusively from the spindle through the cam mechanism to the hammer when the mode collar is in the first position, whereas rotary power transmitted between the hammer and the anvil during operation of the power tool flows through a path that does not include the cam mechanism when the mode collar is in the second position.

In another form, the present teachings provide a power tool having a rotary impact mechanism, an output spindle and a mode change mechanism. The rotary impact mechanism has a spindle, a hammer, a cam mechanism, and an anvil. The hammer is mounted on the spindle. The cam mechanism couples the hammer to the spindle in a manner that permits limited rotational and axial movement of the hammer relative to the spindle. The hammer includes hammer teeth for drivingly engaging a plurality of anvil teeth formed on the anvil. The mode change mechanism has a mode collar, a shift fork and an actuator. The mode collar is axially movable between a first position, which locks the rotary impact mechanism such that the anvil, the spindle and the hammer co-rotate, and a second position which permits the hammer to axially separate from and re-engage the anvil. The shift fork is coupled to mode collar such that the mode collar translates with the shift fork. The actuator includes a first cam, which is fixed to the shift fork, and a second cam that cooperates with the first cam to move the shift fork. An actuating means that includes a handle, an electronically-operated actuator or both, is coupled to the second cam and is configured to move the second cam to cause corresponding movement of the shift fork.

In yet another form the present teachings provide a power tool having a rotary impact mechanism, an output spindle and an anvil restricting mechanism. The rotary impact mechanism has a spindle, a hammer, a cam mechanism, and an anvil. The hammer is mounted on the spindle. The cam mechanism couples the hammer to the spindle in a manner that permits limited rotational and axial movement of the hammer relative to the spindle. The hammer includes hammer teeth for drivingly engaging a plurality of anvil teeth formed on the anvil. The anvil restricting mechanism has a restricting member that is movable between a first position and a second position. Placement of the restricting member in the first position limits movement of the anvil toward the hammer to permit the hammer to disengage the anvil when the torque transmitted therebetween exceeds a predetermined trip torque. Placement of the restricting member in the second position permits the anvil to move axially with the hammer such that engagement therebetween is sustained even when the torque transmitted therebetween exceeds the predetermined trip torque.

In still another form the present teachings provide a power tool having a rotary impact mechanism, an output spindle and a locking mechanism. The rotary impact mechanism has a spindle, a hammer, a cam mechanism, and an anvil. The hammer is mounted on the spindle. The cam mechanism couples the hammer to the spindle in a manner that permits limited rotational and axial movement of the hammer relative to the spindle. The hammer includes hammer teeth for drivingly engaging a plurality of anvil teeth formed on the anvil. The locking mechanism has a locking member that is selectively movable into a position that inhibits movement of the hammer away from the anvil by an amount that is sufficient to permit the hammer to disengage the anvil.

In a further form the present teachings provide a power tool having a rotary impact mechanism, an output spindle and a multi-path transmission. The rotary impact mechanism has a spindle, a hammer, a cam mechanism, and an anvil. The hammer is mounted on the spindle. The cam mechanism couples the hammer to the spindle in a manner that permits limited rotational and axial movement of the hammer relative to the spindle. The hammer includes hammer teeth for drivingly engaging a plurality of anvil teeth formed on the anvil.

The multi-path transmission has a first transmission path that directly drives the output spindle and a second transmission path that provides rotary power directly to the spindle of the impact mechanism.

In still another form the present teachings provide a power tool having a rotary impact mechanism, an output spindle and a differential transmission. The rotary impact mechanism has a spindle, a hammer, a cam mechanism, and an anvil. The hammer is mounted on the spindle. The cam mechanism couples the hammer to the spindle in a manner that permits limited rotational and axial movement of the hammer relative to the spindle. The hammer includes hammer teeth for drivingly engaging a plurality of anvil teeth formed on the anvil. The differential transmission has a differential with an first output and a second output. The first output is configured to directly drive the output spindle when a torque output from the output spindle is less than a predetermined threshold. The second output is configured to directly drive the impact mechanism when the torque output from the output spindle is greater than or equal to the predetermined threshold.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
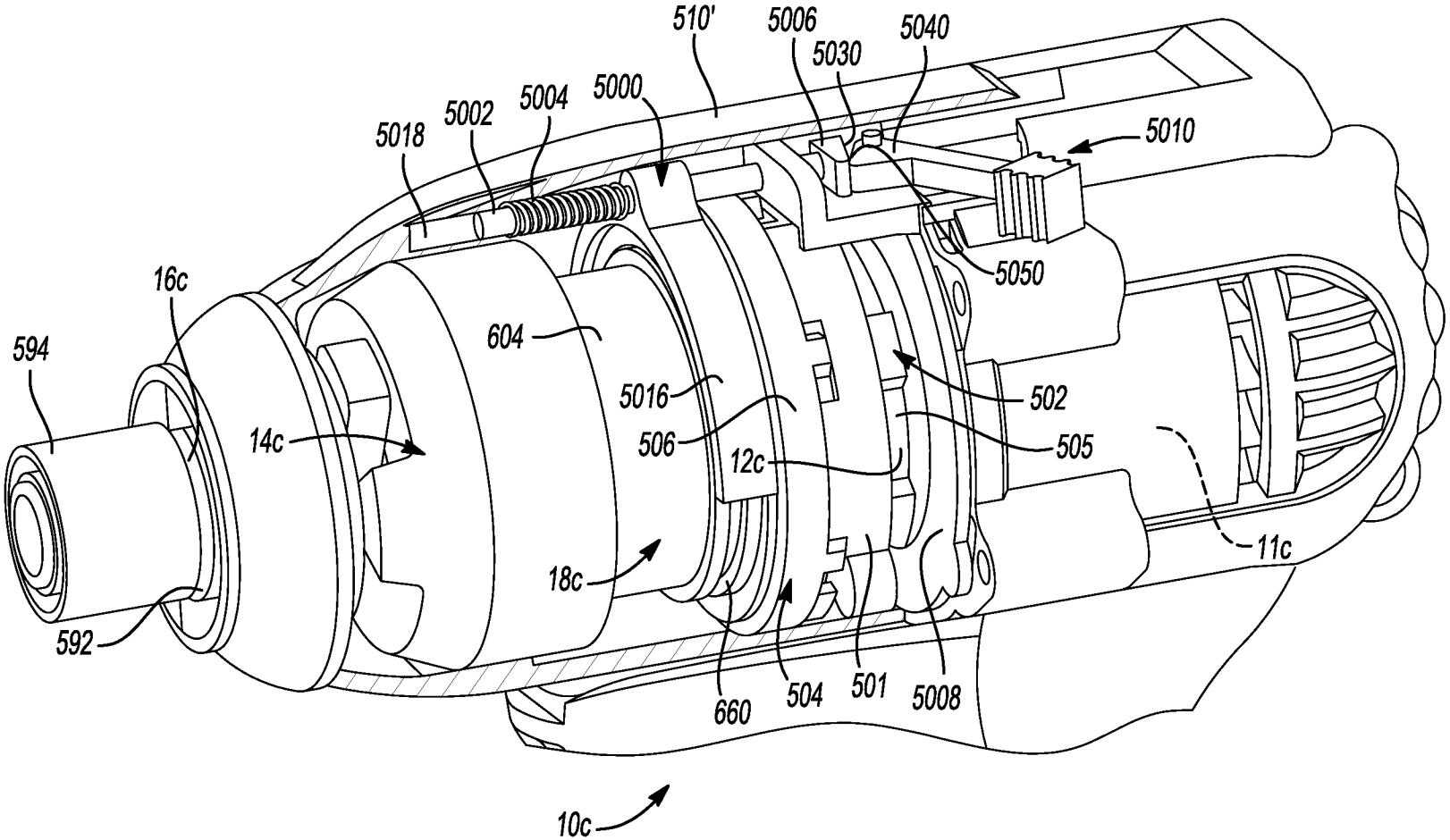
FIG. 1 is a partly broken away perspective view of a portion of a hybrid impact tool constructed in accordance with the teachings of the present disclosure.

With reference to FIG. 1, a hybrid impact tool constructed in accordance with the teachings of the present disclosure is generally indicated by reference numeral 10*c*. The hybrid impact tool 10*c* can be generally similar to the hybrid impact tool 10 of FIG. 1 of copending U.S. patent application Ser. No. 12/138,516, the disclosure of which is hereby incorporated by reference as if fully set forth in detail herein. The hybrid impact tool 10*c* can include a motor 11*c*, a transmission 12*c*, an impact mechanism 14*c*, an output spindle 16*c* and a mode change mechanism 18*c*. The motor 11*c* can be any type of motor (e.g., electric, pneumatic, hydraulic) and can provide rotary power to the transmission 12*c*. With additional reference to FIGS. 2 and 3, the transmission 12*c* can be any type of transmission and can include one or more reduction stages and a transmission output member 500*c*. For example, the transmission 12*c* can be a two-speed planetary transmission having a first stage 502, a second stage 504 and a change collar 501. The construction and operation of the transmission is beyond the scope of this application and need not be discussed in significant detail herein. Briefly, each of the first and second stages 502 and 504 includes a set of planet gears (not shown) and a ring gear (505 and 506, respectively) that is engaged with the set of planet gears. The planet gears of the first and second stages 502 and 504 are co-formed and coupled to one another for rotation. The planet gears of the first and second stages 502 and 504 (hereafter referred to collectively as "the compound planet gears) are mounted for rotation on a common planet carrier 512. Each ring gear 505 and 506 is meshingly engaged to an associated one of the sets of planet gears and includes a plurality of engagement features that can be engaged to corresponding mating engagement features formed on the change collar 501. The change collar 501 can be non-rotatably but axially slidably engaged to a housing 510*c* of the hybrid impact tool 10*c* so as to be slidably received on the first and second stages 502 and 504 and movable between a rearward position and a forward position. In the rearward position, the change collar 501 non-rotatably couples only the ring gear 505 of the first stage 502 to the housing 510*c* so that the first stage 502 operates at a first speed reduction ratio. In the forward position, the change collar 501 non-rotatably couples only the second ring gear 506 of the second stage 504 to the housing 510*c* so that the second stage 504 operates at a second speed reduction ratio. Those of skill in the art will appreciate that as the planet carrier 512 is common to both the first and second stages 502 and 504, and as the planet carrier 512 is the transmission output member 500*c* in the example provided, the first stage 502 drives the transmission output member 500*c* when the change collar 501 is positioned in the rearward position and the second stage 504 drives the transmission output member 500*c* when the change collar 501 is positioned in the forward position. It will be appreciated that other transmission configurations may be substituted for that which is illustrated and described herein.

Figure 2:
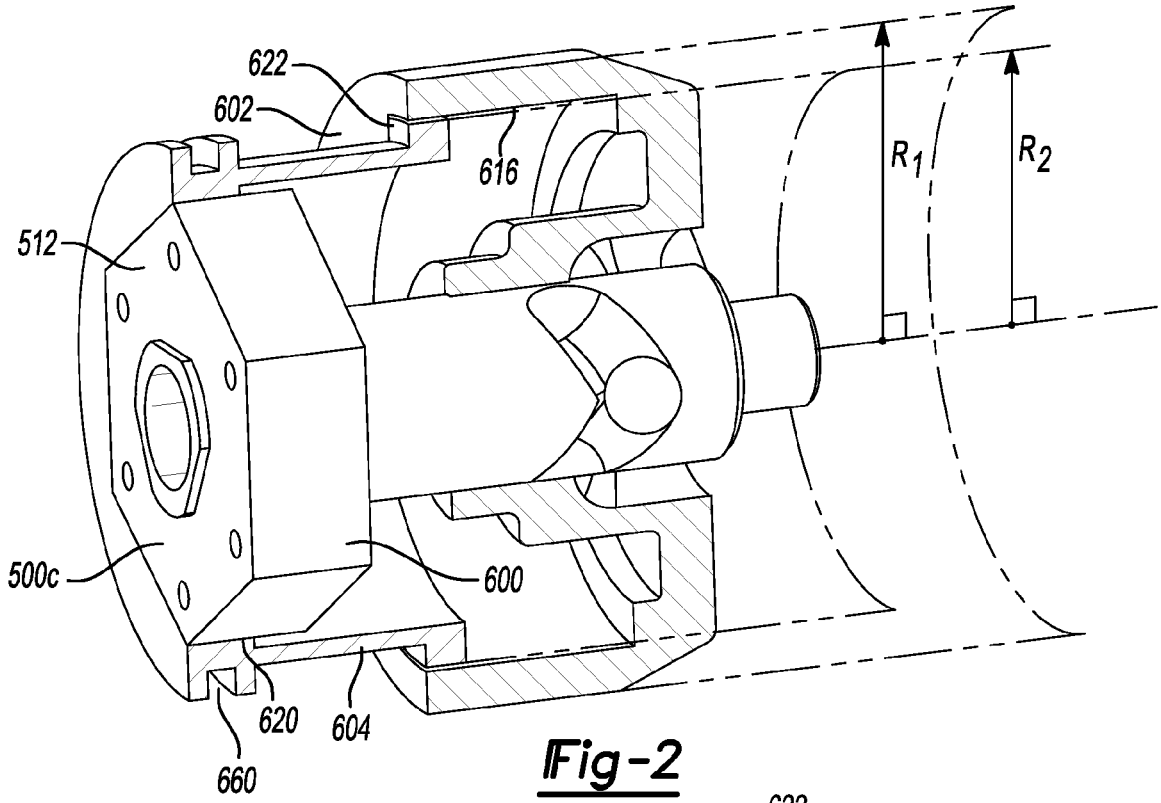
FIGS. 2 and 3 are perspective views of a portion of a hybrid impact tool of FIG. 1.
Figure 4:
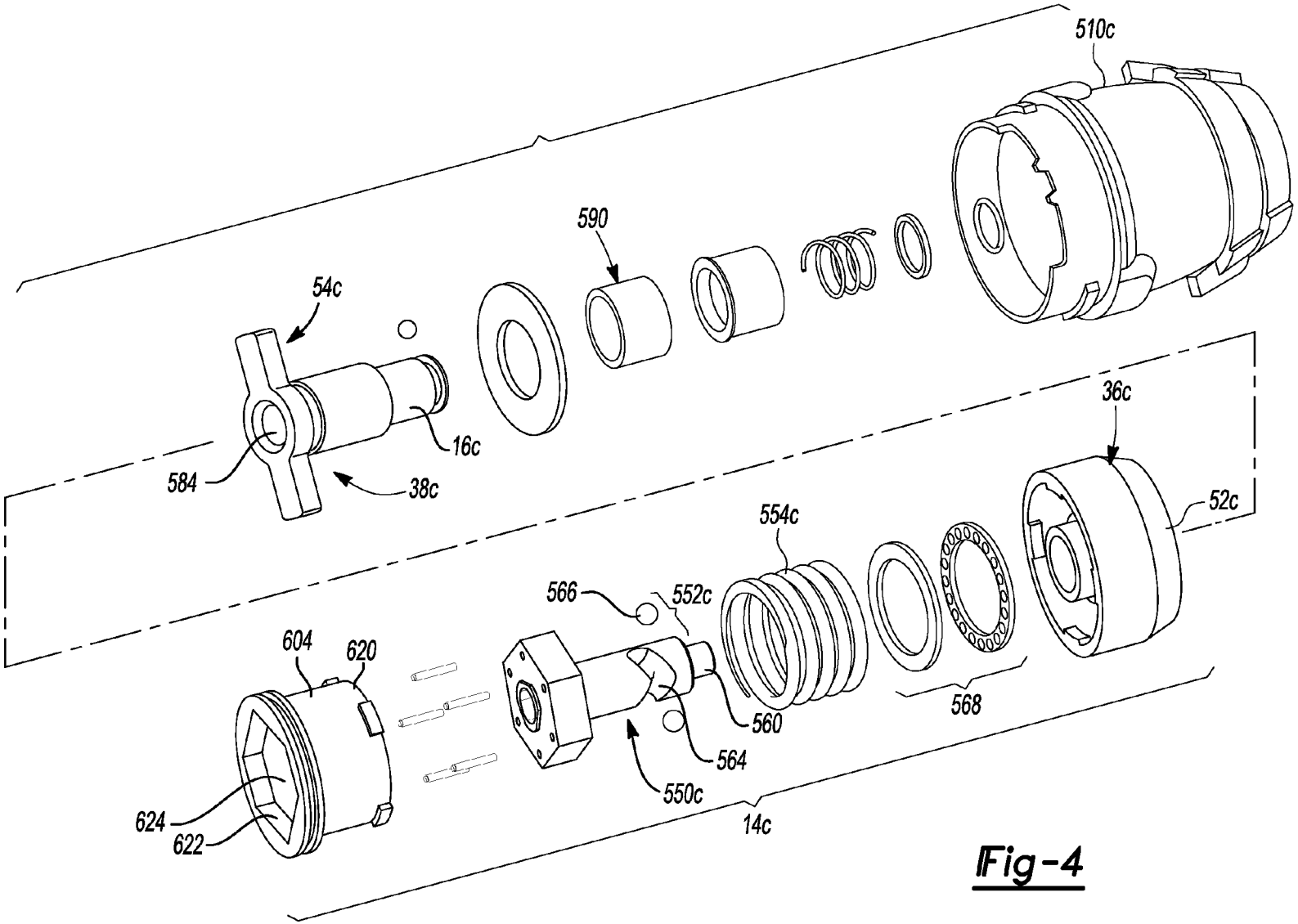
FIG. 4 is an exploded perspective view of a portion of the hybrid impact tool of FIG. 1, illustrating the impact mechanism and the output spindle in more detail.

With reference to FIGS. 2 and 4, the impact mechanism 14*c* can include a spindle (input spindle) 550*c*, a hammer 36*c*, a cam mechanism 552*c*, a hammer spring 554*c* and an anvil 38*c*. The spindle 550*c* can be coupled for rotation with the transmission output member 500*c* and can include a reduced diameter stub 560 on a side opposite the transmission output member 500*c*. The hammer 36*c* can be received onto the spindle 550*c* rearwardly of the stub 560 and can include a set of hammer teeth 52*c*. The cam mechanism 552*c*, which can include a pair of V-shaped grooves 564 formed on the perimeter of the spindle 550*c* and a pair of balls 566 that are received into the V-shaped grooves 564 and corresponding recesses (not shown) formed in the hammer 36*c*, couples the hammer 36*c* to the spindle 550*c* in a manner that permits limited rotational and axial movement of the hammer 36*c* relative to the spindle 550*c*. Such cam mechanisms are well known in the art and as such, the cam mechanism 552*c* will not be described in further detail. The hammer spring 554*c* can be disposed coaxially about the spindle 550*c* and can abut the transmission output member 500*c* and the hammer 36*c* to thereby bias the hammer 36*c* toward the anvil 38*c*. A thrust bearing 568 can be disposed between the hammer 36*c* and the hammer spring 554*c*. The anvil 38*c* can be coupled for rotation with the output spindle 16*c* and can include a plurality of anvil teeth 54*c*. The anvil 38*c* can be unitarily formed with the output spindle 16*c* and can include an anvil recess 584 into which the stub 580 can be received. If desired, a set of bearings, such as needle bearings (not shown), or a bushing (not shown) can be received into the anvil recess 584 between the anvil 38*c* and the stub 560 to support an end of the anvil 38*c* opposite the output spindle 16*c*.

The output spindle 16*c* can be supported for rotation relative to the housing 510*c* by a set of bearings 590. The output spindle 16*c* can include a tool coupling end 592 that can comprise a chuck 594 or square-shaped end segment (not shown) to which an end effector (e.g., tool bit, tool holder) can be coupled.

Figure 5:
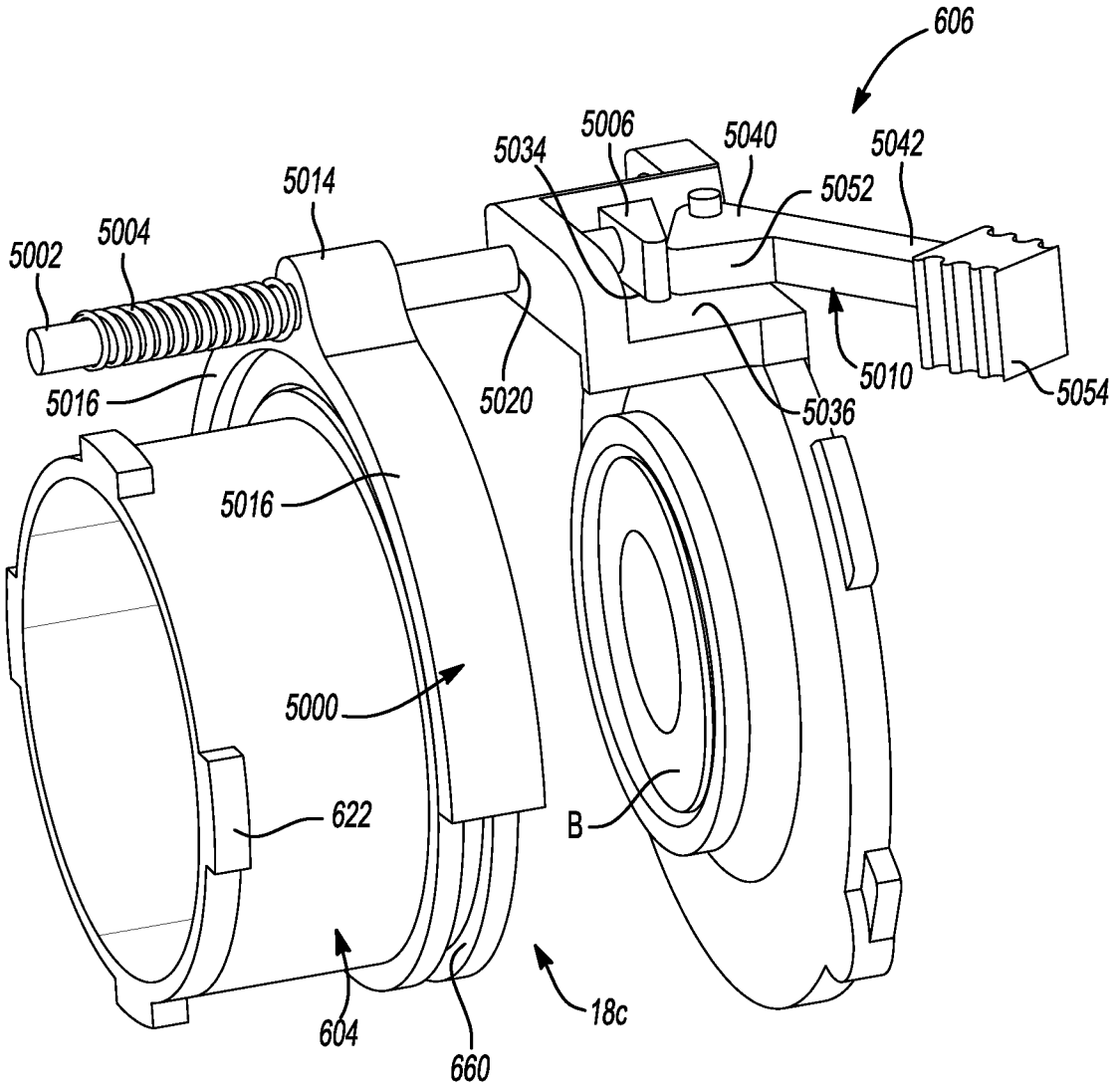
FIG. 5 is a perspective view of a portion of a hybrid impact tool of FIG. 1 illustrating the switch mechanism in greater detail.
Figure 6:
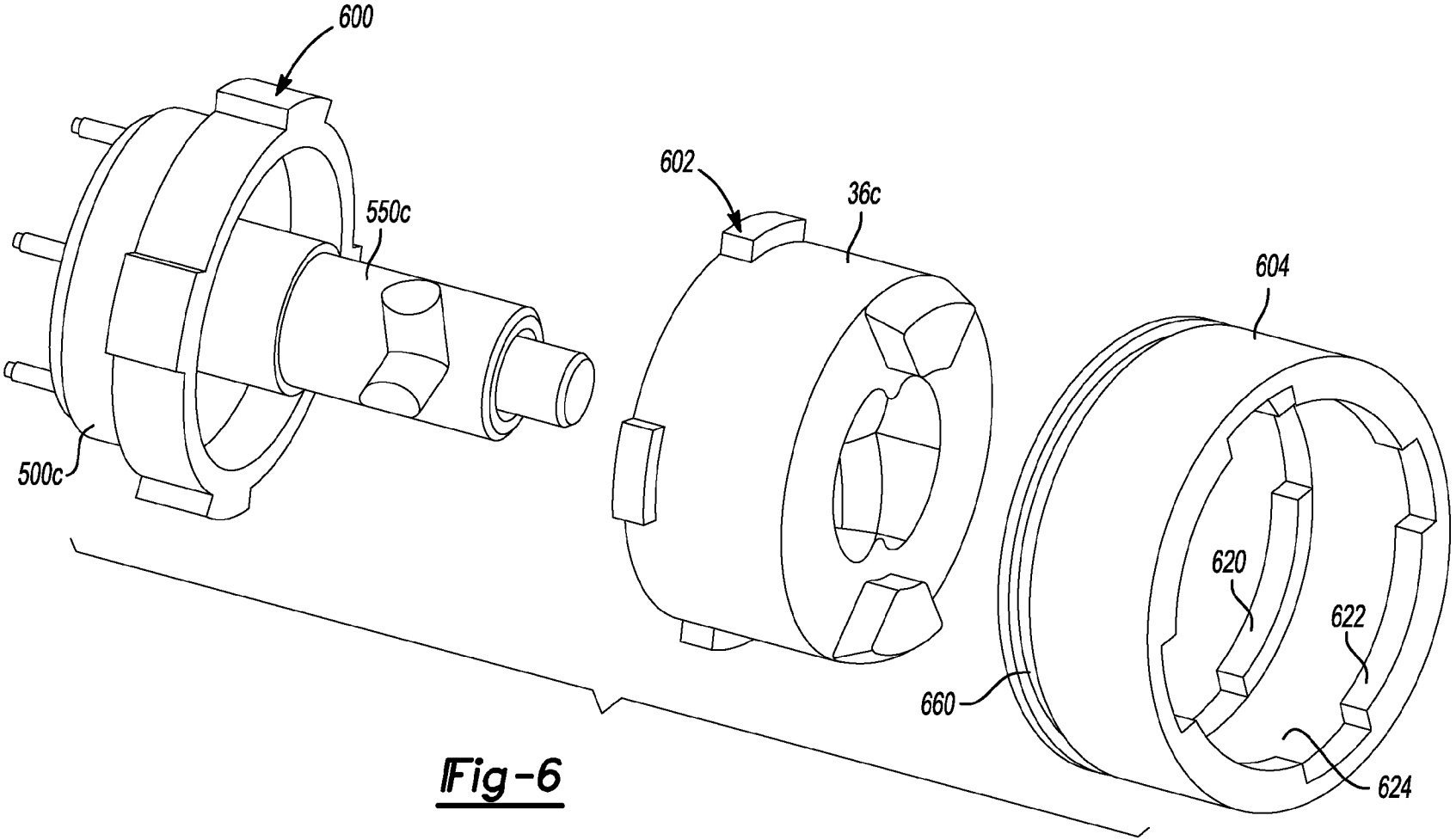
FIG. 6 is an exploded perspective view of a portion of another hybrid impact tool illustrating a portion of an alternately constructed mode change mechanism in more detail.

With reference to FIGS. 2 and 5, the mode change mechanism 18*c* can include a plurality of first engagement members 600, a plurality of second engagement members 602, a mode collar 604 and a switch mechanism 606. The first engagement members 600 can be coupled for rotation with the transmission output member 500*c*, while the second engagement members 602 can be coupled for rotation with the hammer 36*c*. In the particular example provided, the first engagement members 600 can be non-round exterior surfaces on the transmission output member 500*c*, while the second engagement members 602 can be lugs or teeth that can extend radially inwardly from the inner diametrical surface 616 of the hammer 36*c*. Those of skill in the art will appreciate that the first engagement members 600 and/or the second engagement members 602 could be somewhat differently configured. For example, the first engagement members 600 and/or the second engagement members 602 could comprise lugs or teeth that extend from formed on an outer diametrical surface of the transmission output member 500*c* or the hammer 36*c*, respectively, as shown in FIG. 6. It will be appreciated that the different configurations illustrated in FIGS. 4 and 6 have respective advantages and disadvantages that may be pertinent in some situations to the selection of one configuration over the other. Those of skill in the art will appreciate, for example, that the configuration depicted in FIG. 4 permits the mode collar 604 to be shifted forwardly to disengage the hammer 36*c*, which requires less range of travel for the mode collar 604 relative to the example of FIG. 6 so that the overall subassembly may be shortened somewhat. Moreover, it would always be possible to move the mode collar 604 to a position where it was engaged to the hammer 36*c*, even when the teeth 52*c* of the hammer 36*c* are at rest on the teeth 54*c* of the anvil 38*c*.

Returning to FIGS. 2 and 5, the mode collar 604 can be an annular structure that can be received about the transmission output member 500*c* and the hammer 36*c*. The mode collar 604 can include first and second mating engagement members 620 and 622, which can be engaged to the first and second engagement members 600 and 602, respectively.

Figure 3:
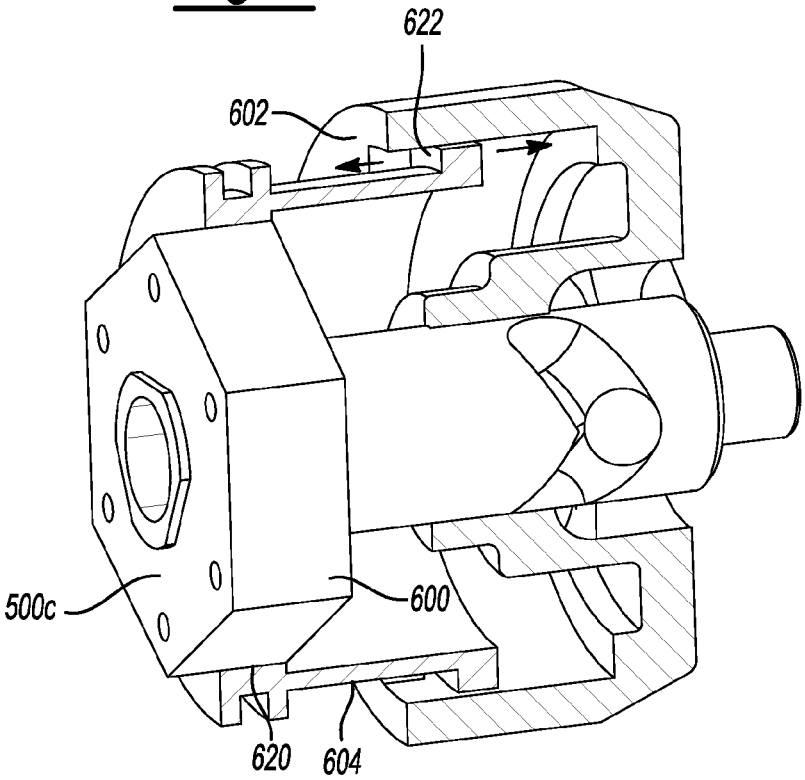

The mode collar 604 is axially slidably movable between a first, rearward position (FIG. 2) and a second, forward position (FIG. 3). When the mode collar 604 is positioned in the first position, first mating engagement members 620 can be engaged to the first engagement members 600 and the second engagement members 602 can be engaged to the second mating engagement members 622 to thereby couple the hammer 36*c* to the transmission output member 500*c* for rotation therewith. It will be appreciated that engagement of the second mating engagement members 622 with the second engagement members 602 inhibits the limited rotational and axial movement of the hammer 36*c* relative to the spindle 550*c* that is otherwise possible due to operation of the cam mechanism 552*c*.

When the mode collar 604 is positioned in the second position, the mode collar 604 can be disengaged from at least one of the first and second engagement members 600 and 602 (i.e., the first mating engagement members 620 can be disengaged from the first engagement members 600 and/or the second mating engagement members 622 can be disengaged from the second engagement members 602) such that the hammer 36*c* is driven by the transmission output member 500*c* via the spindle 550*c* and the cam mechanism 552*c*. In the particular example provided, the first mating engagement members 620 remain in engagement with the first engagement members 600, while the second mating engagement members 622 are disengaged and axially spaced apart forwardly of the second engagement members 602. Accordingly, it will be appreciated that the hammer 36*c* will not disengage and cyclically re-engage the anvil 38*c* when the mode collar 604 is positioned in the first position (i.e., the impact mechanism 14*c* will be controlled such that no rotary impacting is produced), but the hammer 36*c* will be permitted to disengage and cyclically re-engage the anvil 38*c* when the mode collar 604 is positioned in the second position (i.e., the impact mechanism 14*c* will be permitted to produce rotary impacts when the torque applied through the output spindle 16*c* exceeds a predetermined trip torque).

In the particular example provided, the first mating engagement members 620 are engaged with the first engagement members 600 in both the first and second positions (i.e., the mode collar 604 rotates with the transmission output member 500*c*), and the second mating engagement members 622 are disengaged from the second engagement members 602 in the second position as the second engagement members 602 are disposed within the hammer 36*c* forwardly of the second engagement members 602. In the example of FIG. 6, the first mating engagement members 620 are engaged with the first engagement members 600 in both the first and second positions (i.e., the mode collar 604 rotates with the transmission output member 500*c*), and the second mating engagement members 622 are disengaged from the second engagement members 602 in the second position as the second engagement members 602 are disposed in an annular space 624 that is disposed between the first and second mating engagement members 620 and 622.

The mode collar 604 can be disposed axially between the transmission output member 500*c* and the hammer 36*c*. The hammer 36*c* can be disposed within a first cylindrical envelope (shown in FIG. 2) that is defined by a first radius R1, which is perpendicular to a rotational axis of the input spindle 550*c*, that the mode collar 604 can be disposed within a second cylindrical envelope (shown in FIG. 2) that is defined by a second radius R2 that is perpendicular to the rotational axis of the input spindle 550*c*. The first radius R1 can be larger in diameter than the second radius R2. Stated another way, the mode collar 604 can be smaller in diameter than the hammer 36*c* so as to be slidable within the hammer 36*c*.

With reference to FIGS. 1 and 5, the switch mechanism 606 can be employed to axially translate the mode collar 604 between the first and second positions. The switch mechanism 606 can include a shift fork 5000, a shaft 5002, a biasing spring 5004, a cam follower 5006, a support plate 5008 and a shift cam 5010.

Figure 7:
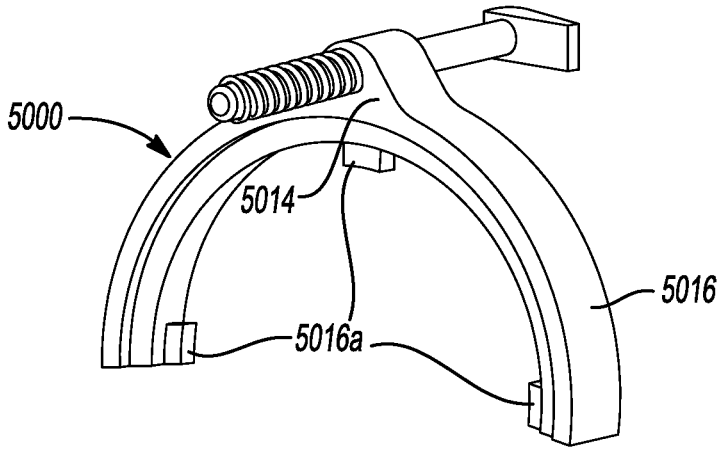
FIG. 7 is a perspective view of a portion of the hybrid impact tool of FIG. 1, illustrating a portion of the switch mechanism in greater detail.
Figure 8:
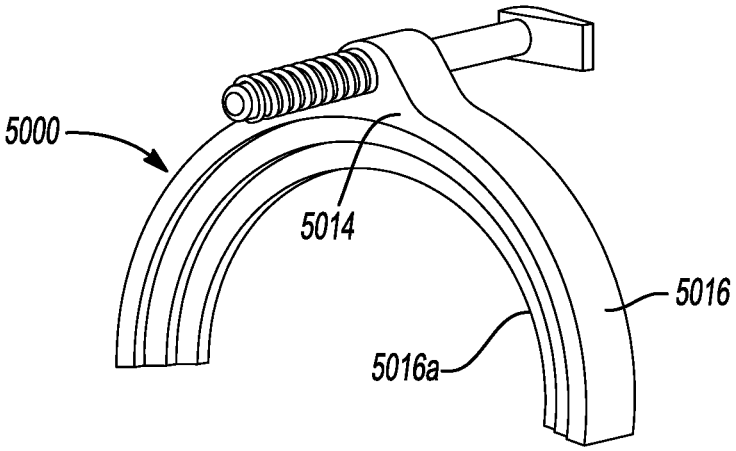
FIGS. 8 and 9 are perspective views similar to that of FIG. 7 but illustrating alternately constructed shift forks.
Figure 9:
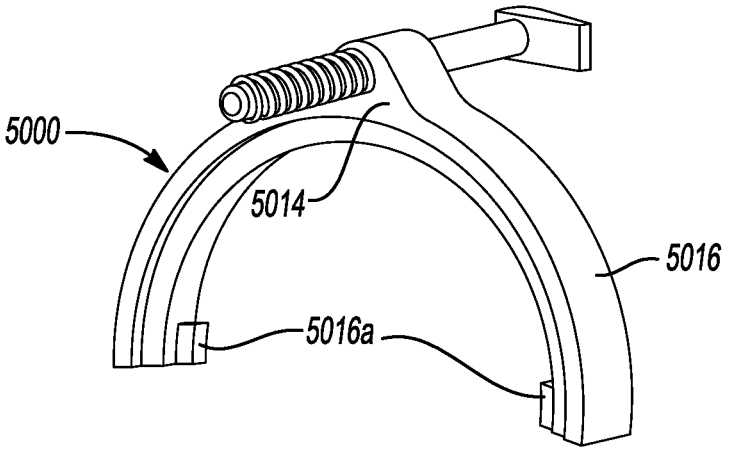

The shift fork 5000 can include a body 5014 and a pair of arcuate arms 5016 that can be coupled to opposite sides of the body 5014 and engaged into the groove 660 formed about the circumference of the mode collar 604. In this regard, the arms 5016 can include one or more lugs or ribs 5016*a* (FIG. 7) that can be received into the groove 660. In the particular example provided, three 5016*a* (FIG. 7) are employed and engage the groove 660 at locations corresponding to the end points of the arms 5016 and at a third point where the arms 5016 intersect one another, but one or two lugs 5016*a* could be employed as shown in FIGS. 8 and 9 such that the lugs 5016*a* are spaced circumferentially apart from one another. A first end of the shaft 5002 can be received in an aperture 5018 in the housing 510'. The shaft 5002 can be axially non-movably mounted to the body 5014 and can extend through an aperture 5020 in the support plate 5008. The biasing spring 5004 can be received between the housing 510' and the shift fork 5000 and can be configured to urge the shift fork 5000 in a direction that positions the mode collar 604 in the first position. The cam follower 5006 can be coupled to a second end of the shaft 5002 that extends through the aperture 5020 in the support plate 5008. The cam follower 5006 can include a first follower profile 5030 and a second follower profile 5032. In the particular example provided, the cam follower 5006 includes a flat lower surface 5034 that is engaged to a corresponding surface 5036 on the support plate 5008. Such contact between the cam follower 5006 and the support plate 5008 inhibits relative rotation therebetween and can thereby reduce friction and/or aid in the alignment between the shift fork 5000 and the mode collar 604. More specifically, engagement of the flat lower surface 5034 to the corresponding surface 5036 on the support plate 5008 can aid in aligning the cam follower 5006 to a desired axis, which can permit the shift fork 5000 to be mounted on the shaft 5002 with a modicum of radial clearance so that the shift fork 5000 may be moved rotationally and/or radially (i.e., radially inward or radially outward) relative to the shaft 5002. Construction in this manner can be advantageous in that it can be relatively tolerant of variation between the axis along which the mode collar 604 and the shaft 5002 are moved. The support plate 5008 can be fixedly mounted to the housing 510' and can support one or more bearings B (such as a bearing that can support the transmission output member 500*c* or the spindle 550*c*), the shift cam 5010 and the shaft 5002. The shift cam 5010 can include a cam 5040 and an arm 5042. The cam 5040 can be pivotally coupled to the support plate 5008 and can include a first cam surface 5050 and a second cam surface 5052. The arm 5042 can extend from the cam 5040 and can include a knob member 5054 that can be manipulated by an operator to effect a change in the position of the shift cam 5010.

Figure 10:
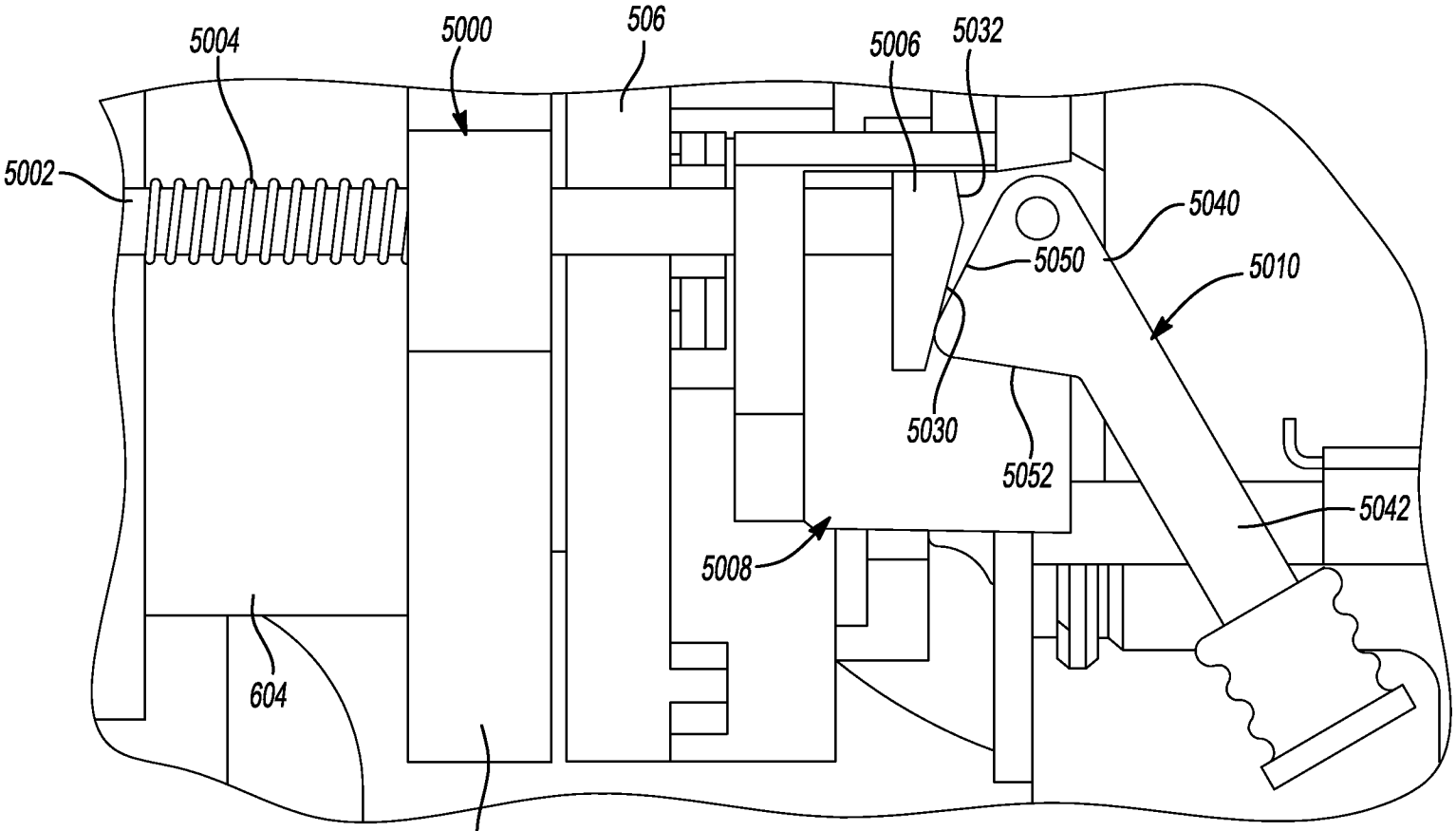
FIG. 10 is a top, partly broken away view of a portion of the hybrid impact tool of FIG. 1 illustrating a shift cam in a rearward position.

In FIGS. 1 and 10, the shift cam 5010 is illustrated in a rearward position, which positions the mode collar 604 in the first position. In this position, the first cam surface 5050 of the cam 5040 is in contact with the first follower profile 5030 of the cam follower 5006. The over-center position of the shift cam 5010 and the force applied to the shaft 5002 by the biasing spring 5004 cooperate to maintain the shift cam 5010 in its rearward position.

Figure 11:
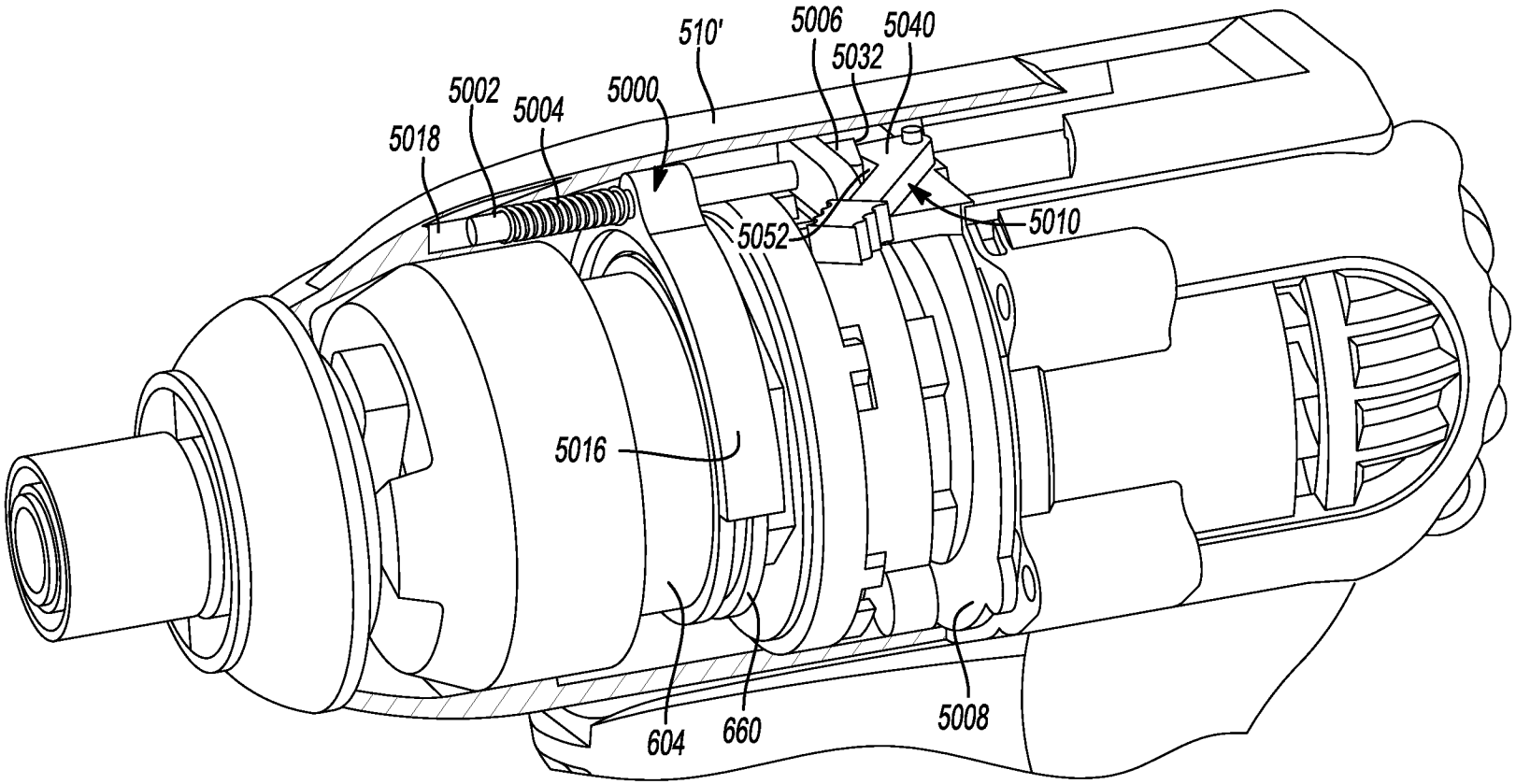
FIG. 11 is a partly broken away perspective view similar to that of FIG. 1 but illustrating the shift cam in the forward position.
Figure 12:
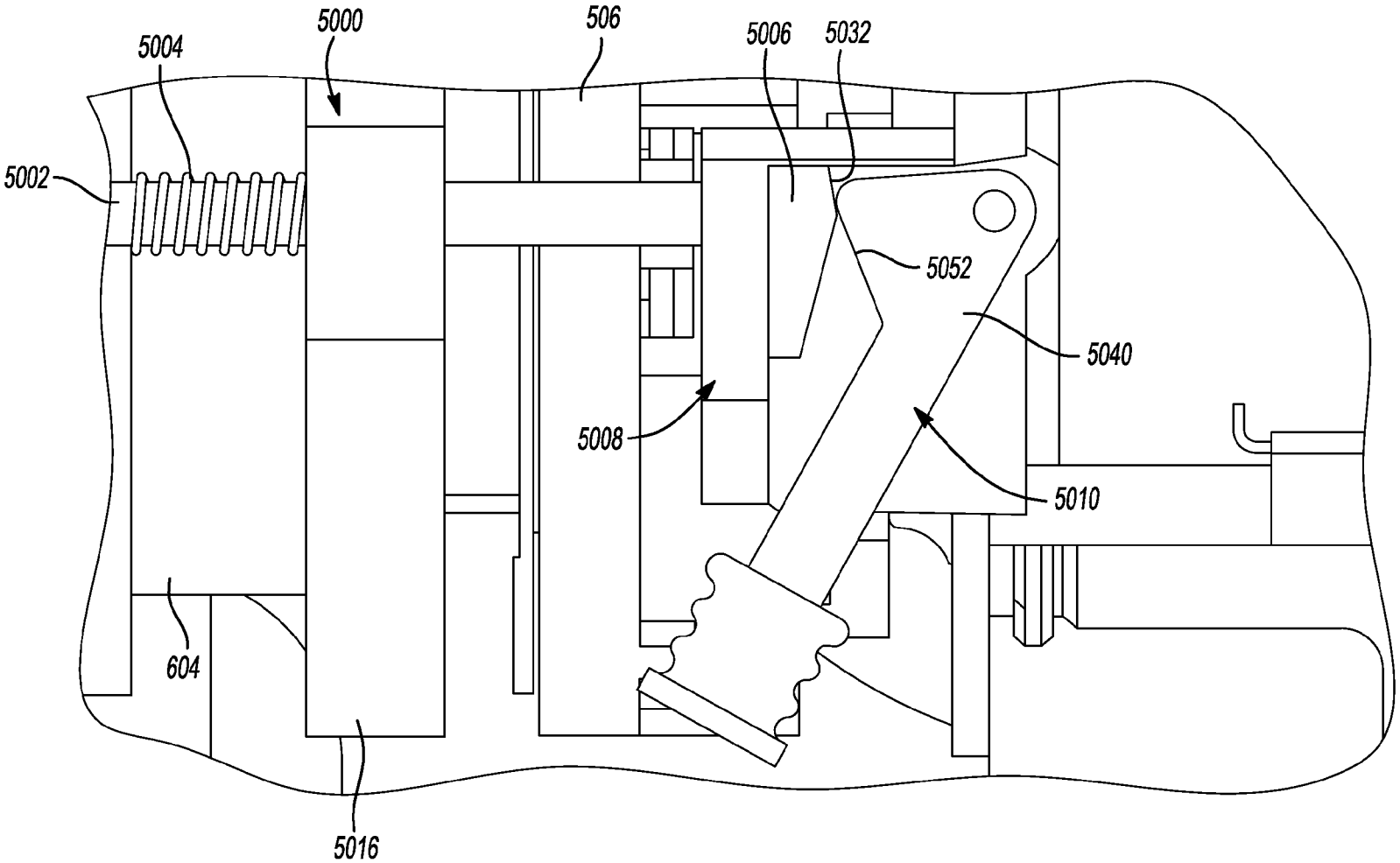
FIG. 12 is a top, partly broken away view of a portion of the hybrid impact tool of FIG. 1 illustrating the shift cam in a forward position.

In FIGS. 11 and 12, the shift cam 5010 is illustrated in a forward position, which positions the mode collar 604 in the second position. In this position, the second cam surface 5052 of the cam 5040 is in contact with the second follower profile 5032 of the cam follower 5006. The over-center position of the shift cam 5010 and the force applied to the shaft 5002 by the biasing spring 5004 cooperate to maintain the shift cam 5010 in its forward position. It will be appreciated that in situations where the mode collar 604 is to be moved into the second position but the second mating engagement members 622 are not aligned to the second engagement members 602, the biasing spring 5004 can be compressed to permit the shaft 5002 and the cam follower 5006 to be moved axially forward when the shift cam 5010 is positioned in the forward position. It will be appreciated that the biasing spring 5004 can urge the shift fork 5000 forwardly when the second mating engagement members 622 can be received between the second engagement members 602 to move the mode collar 604 forwardly.

While the switch mechanism 606 has been illustrated and described as axially shifting only the mode collar 604 between the first and second positions to control the operation of the impact mechanism 14*c*, it will be appreciated that the switch mechanism 606 could also be employed to shift the transmission 12*c* between two or more overall speed reduction ratios. For example, the switch mechanism 606 could include a second shift fork (not shown) that could be engaged to an axially-shiftable member of the transmission 12*c*, such as the change collar 501 (FIG. 1). Where the transmission 12*c* includes a planetary stage, the second shift fork could be coupled to the shaft 5002 for translation therewith or to a second shaft (not shown) that could be operated via the cam 5040 or a different cam (not shown). It will be appreciated that where two cams are employed to shift the shift fork 5000 and the second shift fork, the hybrid impact tool may be operated in a drill mode in multiple speed ratios. The second shift fork could engage the ring gear of the planetary stage or a change collar in a manner that is similar to the manner in which the shift fork 5000 engages the mode collar 604. The ring gear or change collar could be moved between a first, low-speed position and a second, high-speed position. In the first position, the ring gear can be non-rotatably engaged to an appropriate structure, such as the housing 510*c* such that the planetary stage performs a speed reduction and torque multiplication function. In the second position, the ring gear can be coupled to other members of the planetary stage for rotation about a common axis so that the speed and torque of the rotary output of the planetary stage are about equal to the speed and torque of the rotary input to the planetary stage. One manner in which the ring gear can be coupled to the other members of the planetary stage for rotation about the common axis is to engage the internal teeth of the ring gear to teeth formed on a planet carrier as disclosed in U.S. Pat. No. 7,223,195, the disclosure of which is hereby incorporated by reference as if fully set forth in detail herein. In situations where the transmission 12*c* were configured as a two-stage planetary transmission, the ring gear of the first stage (closest to the motor 11*c*) could be axially movable and the ring gear of the second stage could be axially fixed.

Figure 5A:
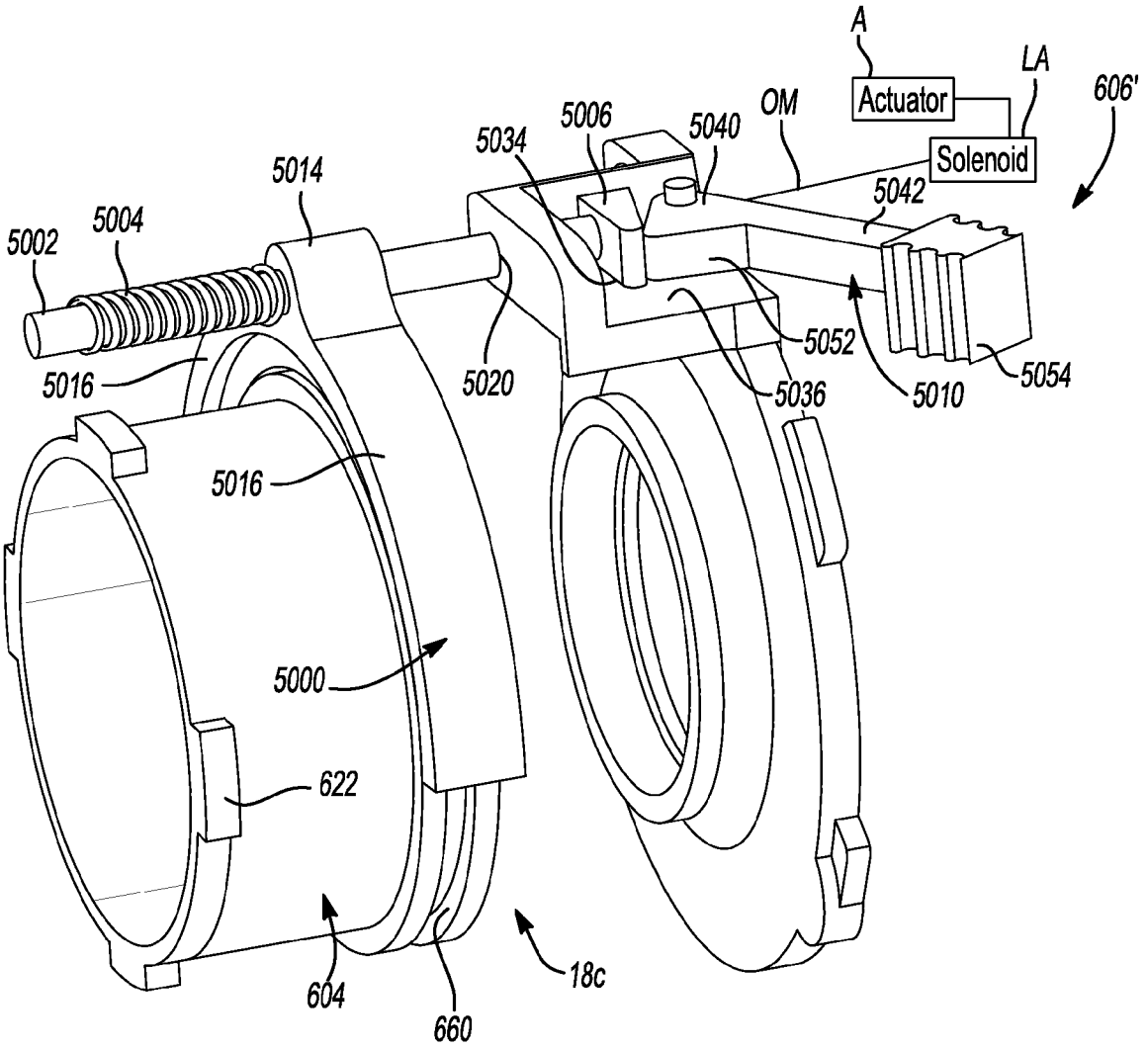
FIG. 5A is a perspective view similar to FIG. 5 but illustrating an alternative switch mechanism.

With reference to FIG. 5A, an alternative switch mechanism 606' is illustrated. The switch mechanism 606' is generally similar to the switch mechanism 606 described above and illustrated in FIG. 5, except that it further includes a linear actuator LA and an actuator A for controlling operation of the linear actuator LA. In the example provided, the linear actuator LA is a solenoid but those of skill in the art will appreciate that the linear actuator could be any type of linear actuator or motor. The linear actuator LA can include an output member OM that can be coupled to the shaft 5002 in a manner that permits the linear actuator LA to selectively move the shaft 5002. In the example provided, the output member OM of the linear actuator LA is pivotally coupled to the shift cam 5010 so that the shaft 5002 may be moved through manual operation of the shift cam 5010 or through operation of the linear actuator LA. It will be appreciated, however, that the output member OM of the linear actuator LA could be coupled directly to the shaft 5002 and that the shift cam 5010 could be omitted. The actuator A can be any type of means for controlling the linear actuator LA. In its most basic form, the actuator A can be a switch that couples the linear actuator LA to a source of electrical power. Alternatively or additionally, the actuator A can include an electronic controller that can be configured to operate the linear actuator LA without receipt of a manually generated input. For example, a controller could be employed to operate the linear actuator LA when a torsional output of the tool exceeds a predetermined threshold. The magnitude of the torsional output of the tool can be sensed directly (e.g., through appropriate sensors) or indirectly (e.g., based on the current that is drawn by the motor). Configuration in this latter manner permits the tool to be operated in a drill mode but shifted into an impact mode when the output torque of the tool rises above a predetermined threshold. While the switch mechanism 606' has been illustrated as including both a linear actuator LA and an actuator A, it will be appreciated that the shaft 5002 may also be moved through a remote mechanical actuator (e.g., a second trigger) (not shown).

Figure 5B:
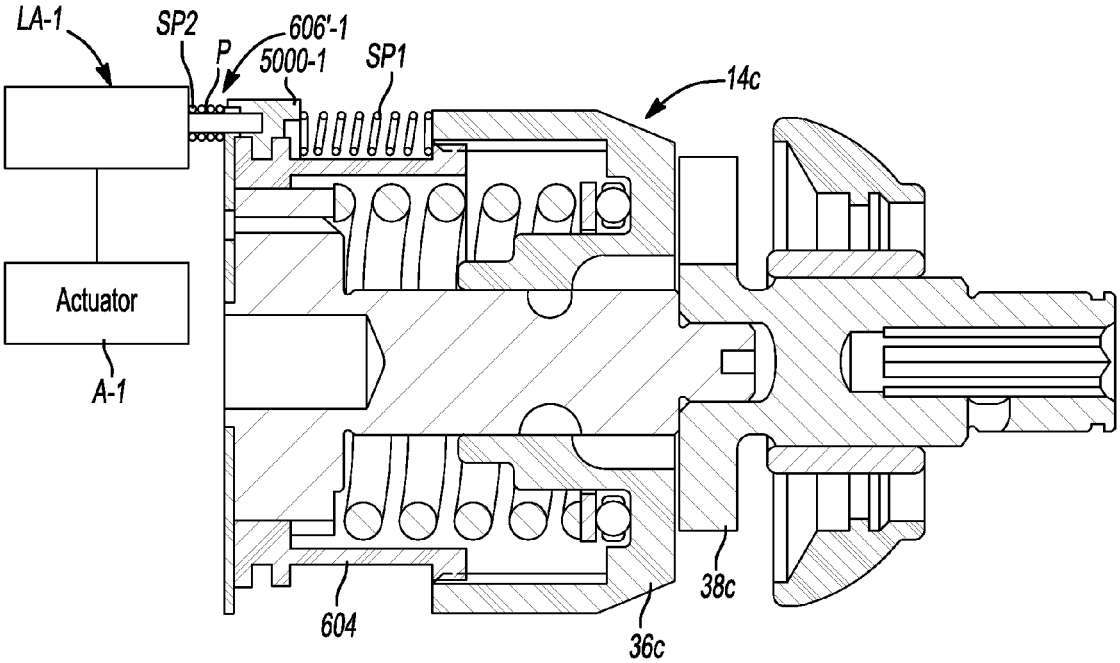
FIGS. 5B and 5C are section views illustrating other alternative switch mechanisms.

FIG. 5B depicts a second alternative switch mechanism 606'-1 that also employs a linear actuator LA-1 and an actuator A-1 for controlling the operation of the linear actuator LA-1. In this example, the linear actuator LA-1 includes a plunger P that can be directly mounted to the shift fork 5000-1, while other elements of the switch mechanism 606 (FIG. 5), including the shaft 5002, the biasing spring 5004, the cam follower 5006, the support plate 5008 and the shift cam 5010, may be omitted. One or more springs SP1, SP2 can be employed to bias the plunger P and/or the shift fork 5000-1 in a desired manner. For example, springs SP can be employed to bias both the plunger P into a retracted position and to bias the shift fork 5000-1 rearwardly such that the mode collar 604 is correspondingly biased toward the first or rearward position. It will be appreciated that while the switch mechanism 606'-1 is not depicted in the example of FIG. 5B as including a mechanical switch that is configured to switch based upon an input received from the user of the tool, various electronic means, such as a dedicated mode switch (not shown) or the actuation of another switch in a predetermined manner (e.g., depressing and releasing the trigger switch in quick succession a predetermined number of times) could be employed to cause the actuator A-1 to operate the linear actuator LA-1 in a desired manner.

In operation, the linear actuator LA-1 can be operated to shift the mode collar 604 to the second or forward position to permit the impact mechanism 14*c* to operate in a hammer mode (i.e., a mode in which the hammer 36*c* can disengage and cyclically re-engage the anvil 38*c*) in response to a predetermined condition, such as an output torque of the tool or a depth to which a fastener has been driven. Various means may be employed to identify or approximate the output torque of the tool, including the magnitude of the current that is input to the motor 11*c* (FIG. 1) and/or a torque sensor. While the linear actuator LA-1 may be energized to maintain the mode collar 604 in the second position while the tool is in operation, it may be desirable in some situations to provide a detent or latch mechanism (not shown) to engage the shift fork 5000-1 and/or the mode collar 604 to maintain the mode collar 604 in the second position. When operation of the tool is halted such that no load is transmitted through the transmission 12*c* and the impact mechanism 14*c*, the mode collar 604 can be urged rearwardly through the spring(s) SP and/or via a manual input (not shown) applied to the shift fork 5000-1.

Figure 5C:
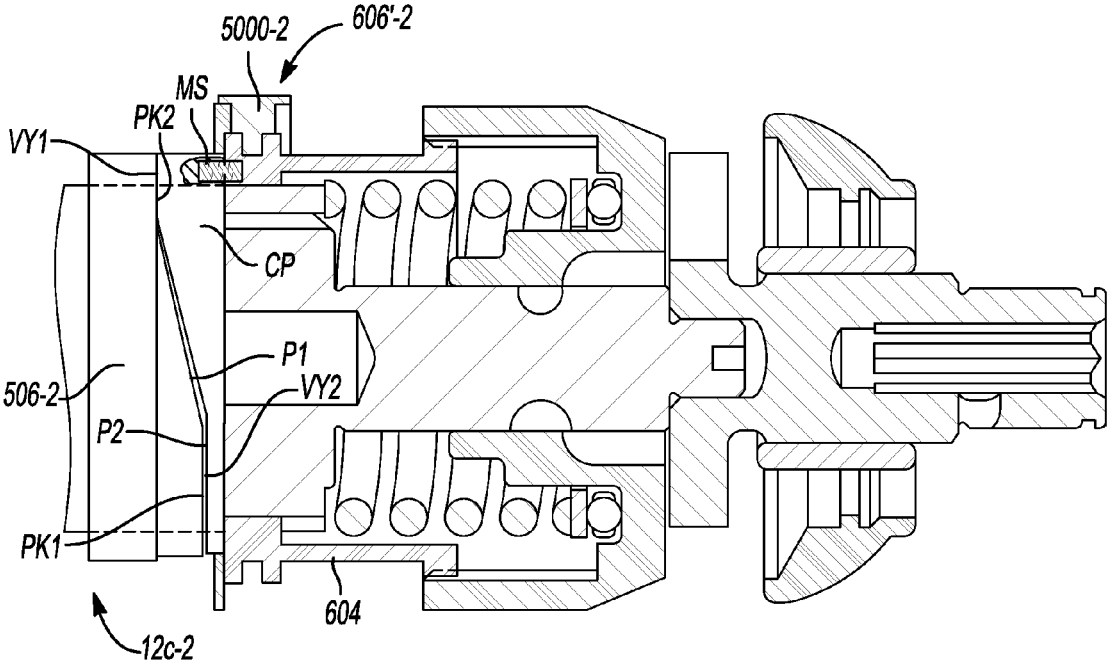

FIG. 5C depicts another alternative switch mechanism 606'-2 that is configured to operate automatically in response to the magnitude of torque that is transmitted through the transmission 12*c*-2. More specifically, the transmission 12*c*-2 is configured to interact with the switch mechanism 606'-2 to cause the switch mechanism 606'-2 to shift the mode collar 604 in response to the transmission of a predetermined amount of torque through the transmission 12*c*-2. In the particular example provided, the transmission 12*c*-2 includes a rotatable ring gear 506-2 having a first cam profile P1 formed thereon, while the switch mechanism 606'-2 includes a non-rotatable cam plate CP having a mating cam profile P2 formed thereon. The cam plate CP can be configured such that its translation in an axial direction can cause corresponding translation of the mode collar 604. A mode spring MS can be employed to bias the cam plate CP against the ring gear 506-2 to cause mating engagement between the cam profile P1 and mating cam profile P2. When the magnitude of the torque that is transmitted through the transmission 12*c*-2 is less than a predetermined shifting torque, the mode spring MS will bias the cam plate CP rearwardly such that peaks PK1 and valleys VY1 on the cam profile P1 will matingly engage valleys VY2 and peaks PK2, respectively, on the mating cam profile P2 to inhibit rotation of the ring gear 506-2 relative to the cam plate CP. When the magnitude of the torque that is transmitted through the transmission 12*c*-2 is greater than or equal to the predetermined shifting torque, the axial force generated by the mode spring MS is insufficient to counteract the rotational force exerted on the ring gear 506-2 by corresponding planet gears (not shown) so that the ring gear 506-2 rotates relative to the cam plate CP such that the peaks PK1 on the cam profile P1 engage the peaks PK2 on the mating cam profile P2 and the ring gear 506-2 drives the cam plate CP in an axial direction away from the transmission 12*c*-2. It will be appreciated that axial movement of the cam plate CP causes corresponding motion of the mode collar 604 such that the mode collar 604 is moved to the second or forward position. When operation of the tool is halted such that no load is transmitted through the transmission 12*c*-2 and the impact mechanism 14*c*, the mode collar 604 can be urged rearwardly through a spring (e.g., a spring similar to SP1 in FIG. 5*b*) that acts on the mode collar 604 or the shift fork 5000-2 and/or via a manual input (not shown) applied to the shift fork 5000-2. Those of skill in the art will appreciate that the predetermined shifting torque could be set at a fixed magnitude, or could have a magnitude that is adjustable. For example, in situations where a spring biases the mode collar 604 rearwardly, adjustment of the magnitude of the shifting torque could be accomplished via an exchange of the spring with another spring having a different spring rate or via an adjustment mechanism that can be employed to an amount by which the spring is compressed. Such adjustment mechanism could be similar to an adjustment mechanism for a torque clutch (e.g., the adjustment mechanism described in U.S. Pat. No. 7,066,691, the disclosure of which is hereby incorporated by reference as if fully set forth in detail herein).

Figure 13:
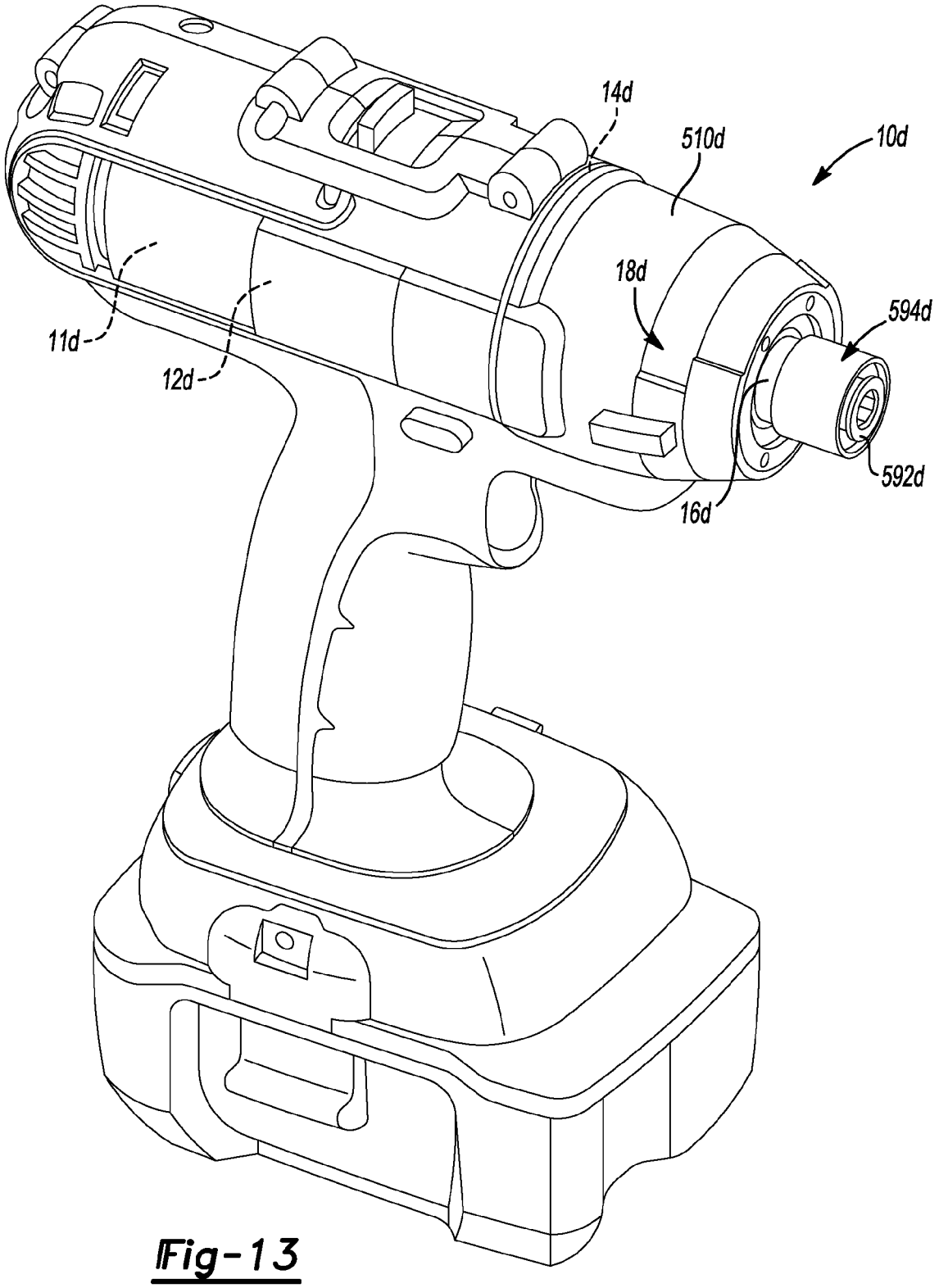
FIG. 13 is a perspective view of another hybrid impact tool constructed in accordance with the teachings of the present disclosure.
Figure 14:
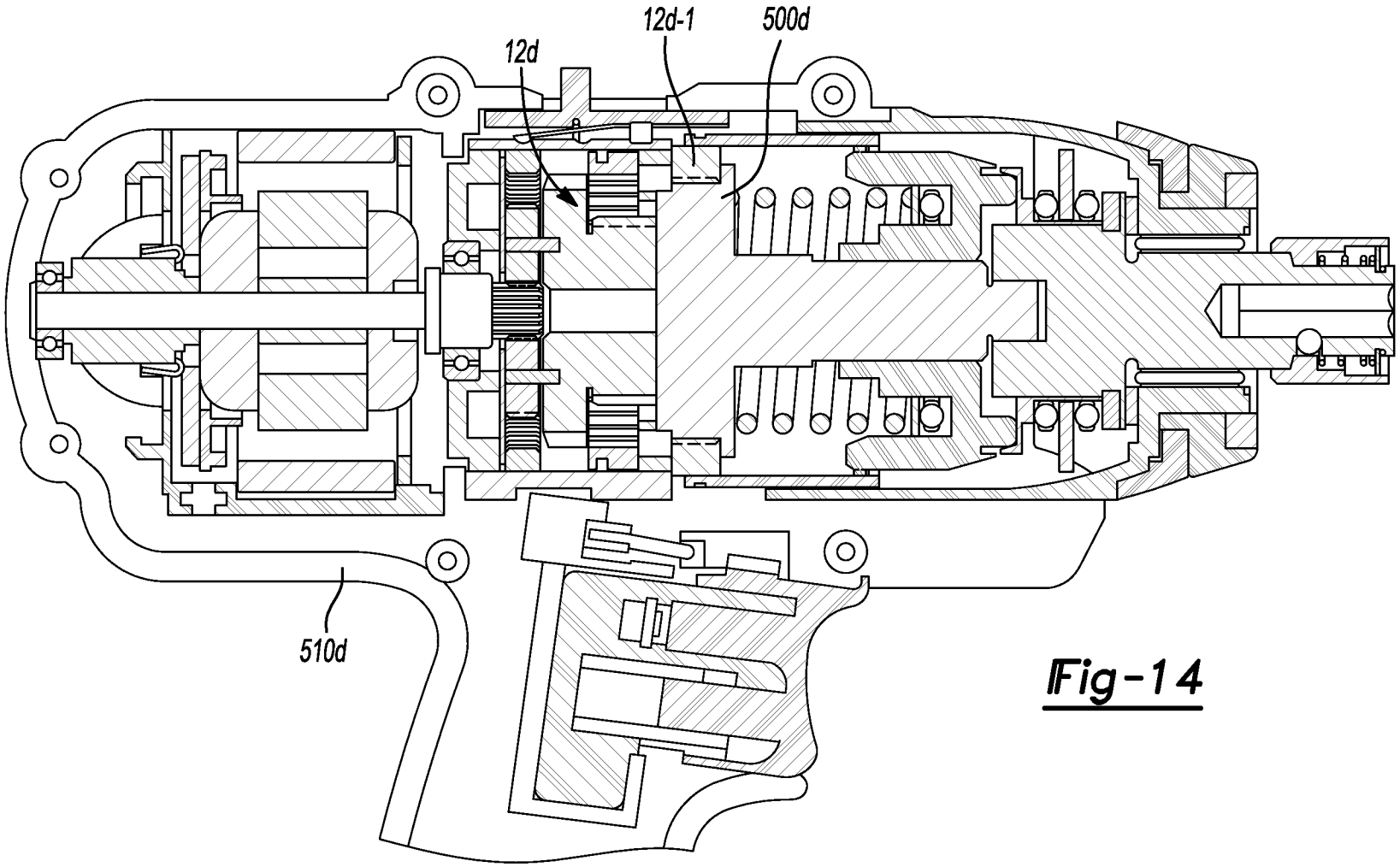
FIG. 14 is a longitudinal section view of a portion of the hybrid impact tool of FIG. 13.

With reference to FIG. 13, another hybrid impact tool constructed in accordance with the teachings of the present disclosure is generally indicated by reference numeral 10*d*. The hybrid impact tool 10*d* can be generally similar to the hybrid impact tool 10 of FIG. 1 of copending U.S. patent application Ser. No. 12/138,516 and can include a motor 11*d*, a transmission 12*d*, an impact mechanism 14*d*, an output spindle 16*d* and a mode change mechanism 18*d*. The motor 11*d* can be any type of motor (e.g., electric, pneumatic, hydraulic) and can provide rotary power to the transmission 12*d*. With additional reference to FIG. 14, the transmission 12*d* can be any type of transmission and can include one or more reduction stages and a transmission output member 500*d*. In the particular example provided, the transmission 12*d* is a two-speed planetary transmission and the transmission output member 500*d* is a planet carrier associated with the final (second) stage of the transmission 12*d*. A bearing 12*d*-1 can be employed to support the transmission output member 500*d* relative to the housing 510*d*.

Figure 15:
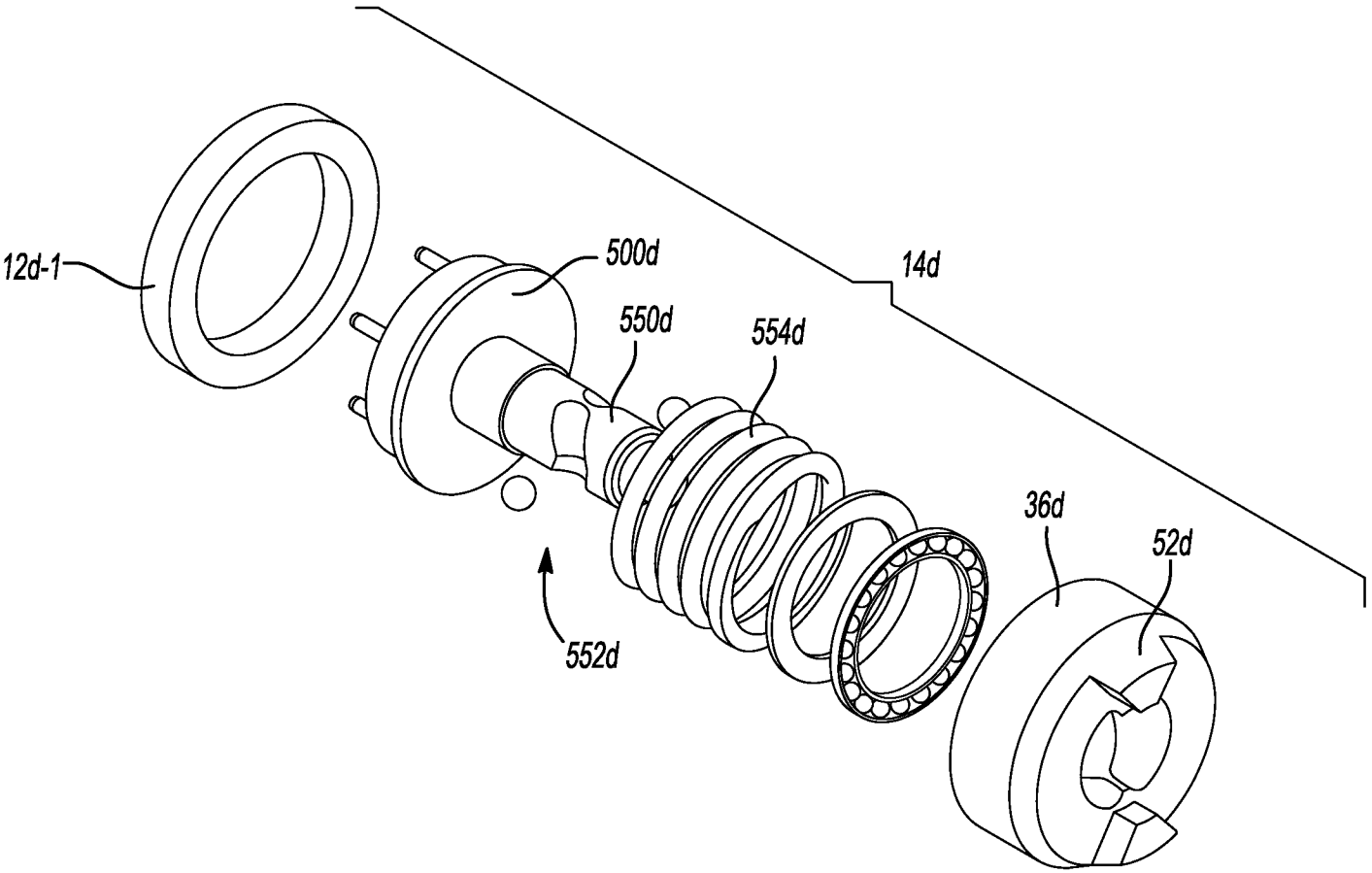
FIG. 15 is an exploded perspective view of a portion of the hybrid impact tool of FIG. 13, illustrating a portion of the impact mechanism.
Figure 16:
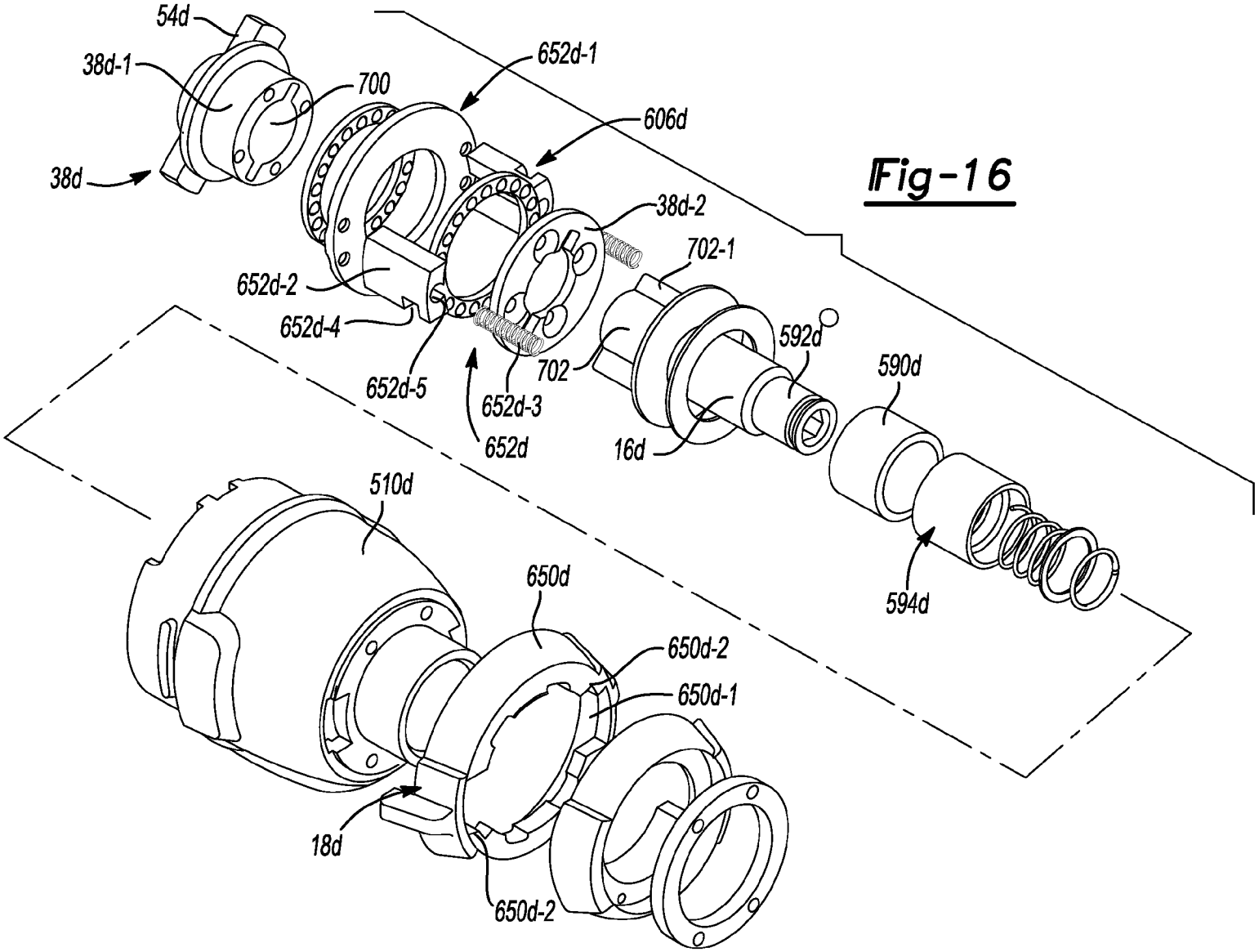
FIG. 16 is an exploded perspective view of a portion of the hybrid impact tool of FIG. 13, illustrating a portion of the impact mechanism and the mode change mechanism.
Figure 17:
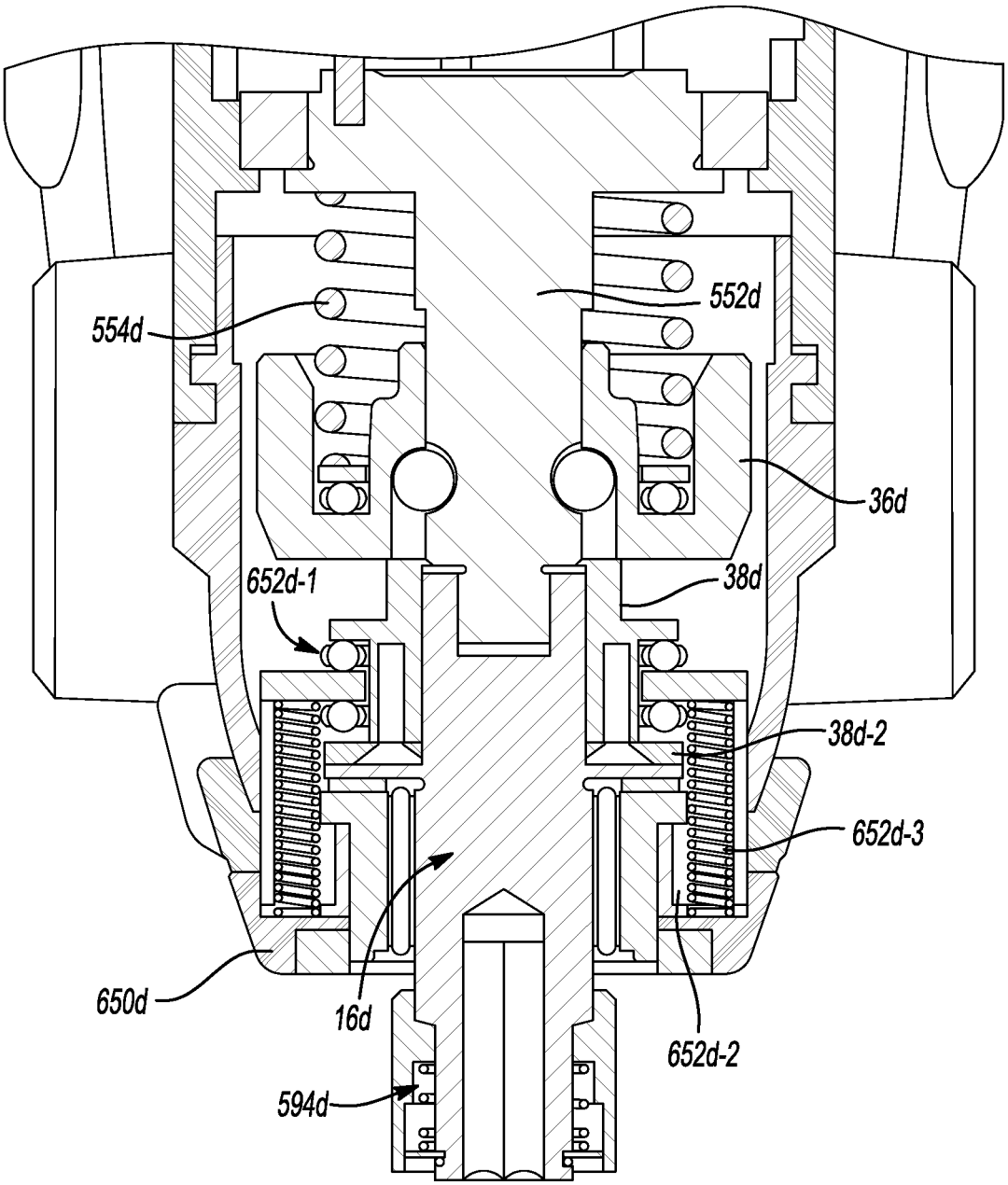
FIG. 17 is a longitudinal section view of a portion of the hybrid impact tool of FIG. 13 illustrating the impact mechanism and the mode change mechanism in more detail.

With reference to FIGS. 15 and 16, the impact mechanism 14*d* can include can include a spindle (input spindle) 550*d*, a hammer 36*d*, a cam mechanism 552*d*, a hammer spring 554*d* and an anvil 38*d*. The spindle 550*d* can be coupled for rotation with the transmission output member 500*d*. The hammer 36*d* can be received onto the spindle 550*d* and can include a set of hammer teeth 52*d*. The cam mechanism 552*d* can be a conventional and well-known cam mechanism that couples the hammer 36*d* to the spindle 550*d* in a manner that permits limited rotational and axial movement of the hammer 36*d* relative to the spindle 550*d*. The hammer spring 554*d* can be disposed coaxially about the spindle 550*d* and can abut the transmission output member 500*d* and the hammer 36*d* to thereby bias the hammer 36*d* toward the anvil 38*d*. The anvil 38*d* can include a plurality of anvil teeth 54*d*, which can be configured to engage the hammer teeth 52*d* and an anvil recess 700.

The output spindle 16*d* can be supported for rotation relative to a housing 510*d* of the hybrid impact tool 10*d* (FIG. 13) by a set of bearings 590*d*. The output spindle 16*d* can include a tool coupling end 592*d* that can comprise a chuck 594*d* or square-shaped end segment (not shown) to which an end effector (e.g., tool bit, tool holder) can be coupled. The output spindle 16*d* can also include an anvil coupling end 702 onto which the anvil 38*d* can be non-rotatably but axially displaceably coupled. In the particular example provided, the anvil coupling end 702 of the output spindle 16*d* has a pair of tabs 702-1 that are matingly received into the anvil coupling end 702.

Figure 18:
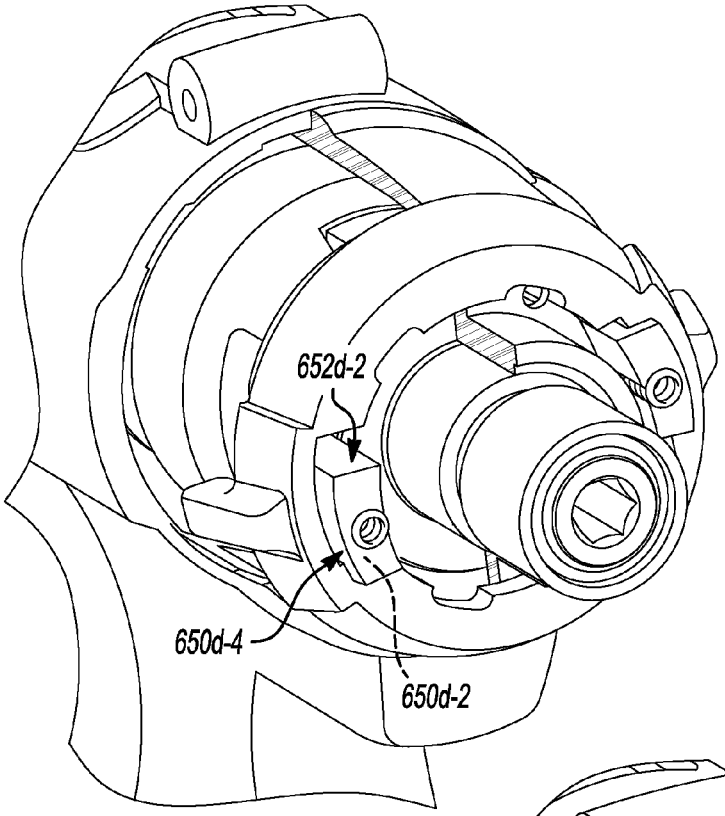
FIGS. 18 and 19 are perspective, partly broken away views of the hybrid impact tool of FIG. 13, illustrating the hybrid impact tool in an impact mode and drill mode, respectively.
Figure 19:
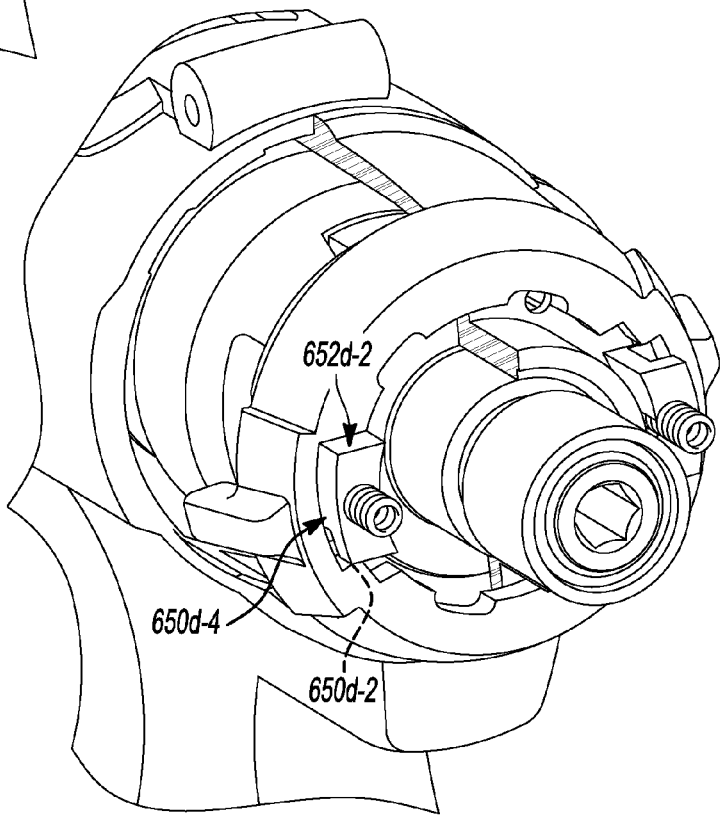

With reference to FIG. 16, the mode change mechanism 18*d* can include a switch mechanism 606*d* that can be employed to selectively lock the anvil 38*d* in a predetermined axial location (relative to the hammer 36*d*) to permit the hammer 36*d* to disengage the anvil 38*d* (shown in FIG. 18), or to unlock the anvil 38*d* to permit the anvil 38*d* to translate with or follow the hammer 36*d* so that the hammer 36*d* does not disengage the anvil 38*d* (shown in FIG. 19). The switch mechanism 606*d* can include a switch member 650*d*, which can be configured to receive an input from an operator to change the lock-state of the anvil 38*d*, and an actuator 652*d* that can couple the switch member 650*d* to the anvil 38*d*. As those of skill in the art will appreciate, various types of known mechanisms can be employed to change the lock state of the anvil 38*d*. For example, the axially sliding switch mechanism disclosed in U.S. Pat. No. 7,066,691, the disclosure of which is hereby incorporated by reference as if fully set forth in detail herein, could be employed to translate locking elements that could be employed to set or change the locking state of the anvil 38*d*. It will be appreciated that such switch mechanisms can be employed to maintain the anvil 38*d* in a desired lock state such that a change in the lock state of the anvil 38*d* requires that the switch mechanism be manipulated by the user (e.g., translated or rotated) to change the lock state of the anvil 38*d*. In the particular example provided, the actuator 652*d* includes a thrust bearing 652*d*-1, a pair of spacers 652*d*-2 and a pair of biasing springs 652*d*-3. The thrust bearing 652*d*-1 can be received onto a protruding portion 38*d*-1 of the anvil 38*d*. A plate 38*d*-2 or other structure can be coupled to the protruding portion 38*d*-1 of the anvil 38*d* to inhibit or limit axial movement of the thrust bearing 652*d*-1 relative to the anvil 38*d*, while permitting rotation of the anvil 38*d* relative to the thrust bearing 652*d*-1. The plate 38*d*-2 can be coupled to the protruding portion 38*d*-1 in any desired manner, such as via a plurality of threaded fasteners (not shown). Each of the spacers 652*d*-2 can include a spacer groove 652-4 and a spring pocket 652*d*-5 and can be abutted against and fixedly coupled to the thrust bearing 652*d*-1. Each of the spacers 652*d*-2 can be sized to be received through a spacer aperture 650*d*-1 formed in the switch member 650*d*. The biasing springs 652*d*-3 can be received into the spring pockets 652-5 can bias the spacers 652*d*-2 away from the switch member 650*d*. The switch member 650*d* can include a pair of latch members 650*d*-2 that can be received into the spacer grooves 652*d*-4 to inhibit axial movement of the spacers 652*d*-2 relative to the switch member 650*d*. With additional reference to FIG. 18, the switch member 650*d* can be rotated into a position (shown in FIG. 18) where the latch members 650*d*-2 are received into the spacer grooves 652*d*-4 to thereby maintain the anvil 38*d* in a forward or locked position that permits the hammer 36*d* (FIG. 15) to selectively disengage the anvil 38*d* to provide a rotary impacting output to the output spindle 16*d*. With reference to FIGS. 16 and 19, the switch member 650*d* can be rotated into a second position (shown in FIG. 19) where the latch members 650*d*-2 are disengaged from the spacer grooves 652*d*-4 to permit the spacers 652*d*-2 to move axially within the spacer apertures 650*d*-1 in the switch member 650*d*. Accordingly, it will be appreciated that the biasing springs 652*d*-3 can bias the spacers 652*d*-2 (and thereby the thrust bearing 652*d*-1 and the anvil 38*d*) rearwardly toward the hammer 36*d* (FIG. 15) to permit the anvil 38*d* to translate with the hammer 36*d* to thereby inhibit disengagement of the hammer 36*d* (FIG. 15) from the anvil 38*d* and provide a rotary non-impacting output to the output spindle 16*d*.

Figure 20:
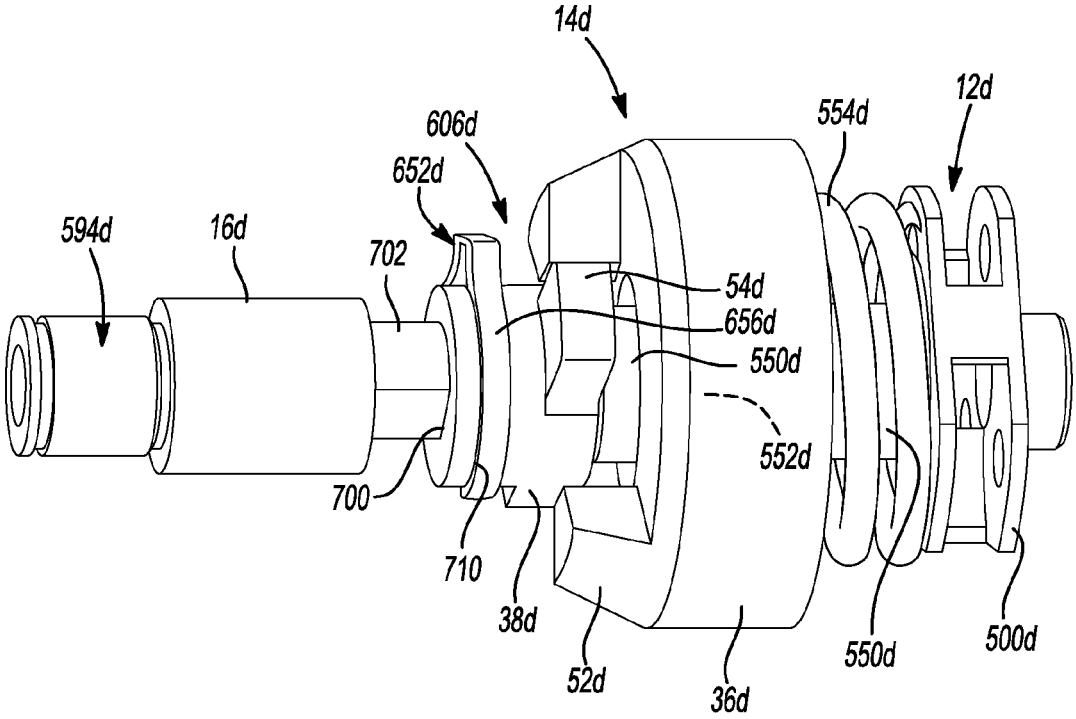
FIG. 20 is a perspective view of a portion of another hybrid impact tool similar to that of FIG. 13, the view illustrating the impact mechanism and the output spindle in more detail.
Figure 21:
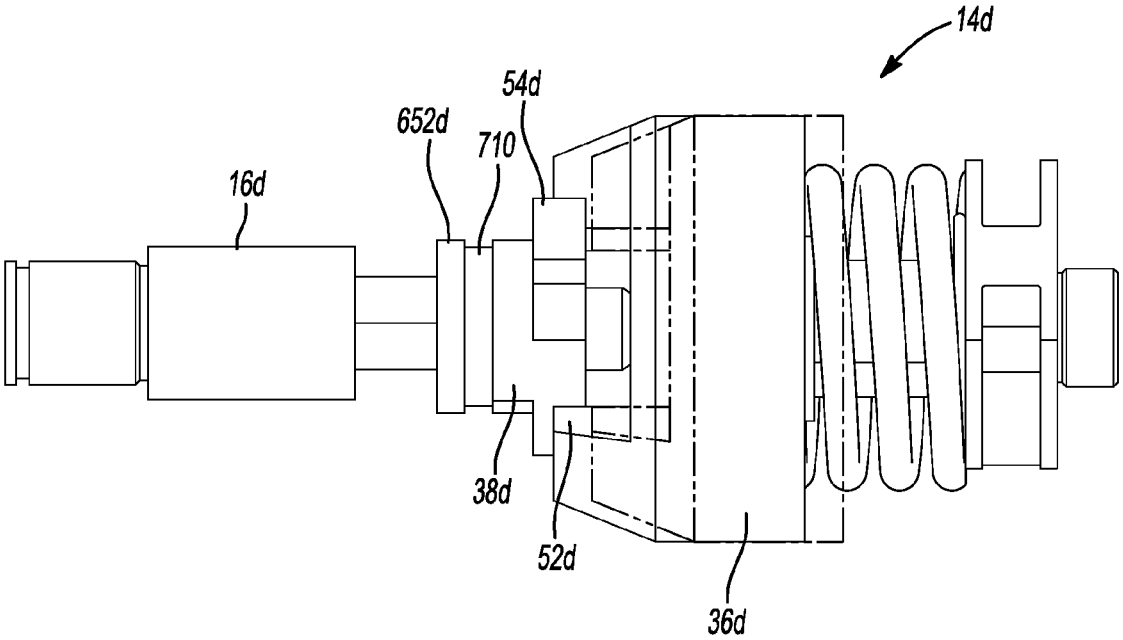
FIGS. 21, 22 and 23 are side elevation views of a portion of the hybrid impact tool of FIG. 20 illustrating the anvil in the first, second and third positions, respectively.
Figure 22:
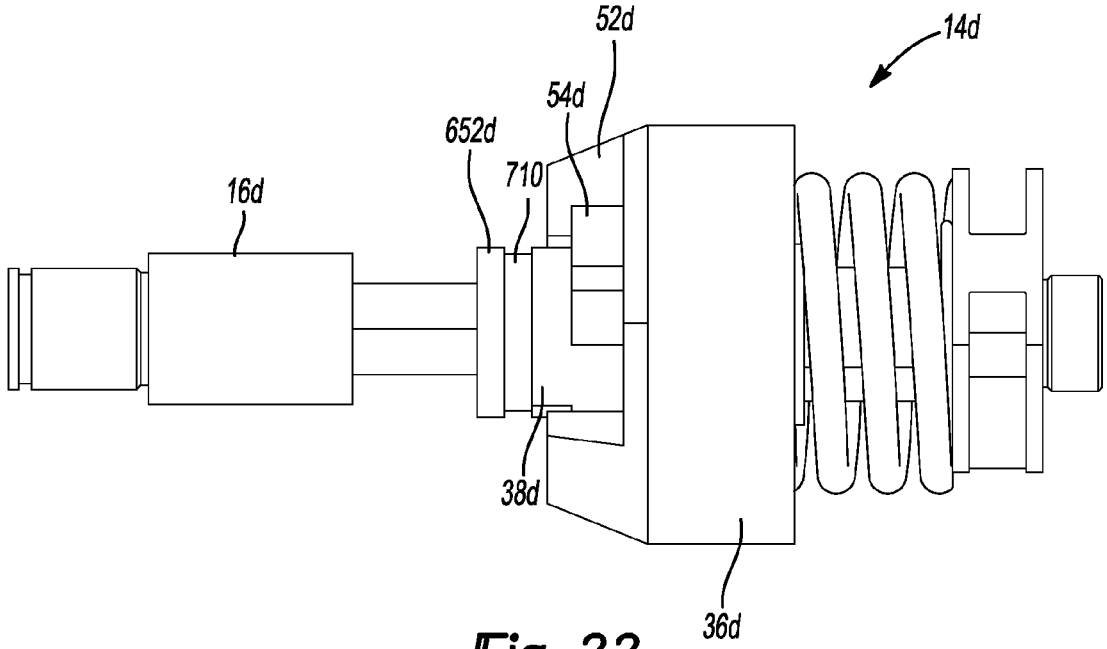

A similar impact tool is partly illustrated in FIGS. 20, 21 and 22. The alternate impact mechanism 14*d* can include can include a spindle (input spindle) 550*d*, a hammer 36*d*, a cam mechanism 552*d*, a hammer spring 554*d* and an anvil 38*d*. The spindle 550*d* can be coupled for rotation with the transmission output member 500*d* and can include a stub aperture (not specifically shown) on a side opposite the transmission output member 500*d*. The hammer 36*d* can be received onto the spindle 550*d* and can include a set of hammer teeth 52*d*. The cam mechanism 552*d* can be a conventional and well-known cam mechanism that couples the hammer 36*d* to the spindle 550*d* in a manner that permits limited rotational and axial movement of the hammer 36*d* relative to the spindle 550*d*. The hammer spring 554*d* can be disposed coaxially about the spindle 550*d* and can abut the transmission output member 500*d* and the hammer 36*d* to thereby bias the hammer 36*d* toward the anvil 38*d*. The anvil 38*d* can include a plurality of anvil teeth 54*d*, which can be configured to engage the hammer teeth 52*d* and an anvil recess 700.

The output spindle 16*d* can be supported for rotation relative to a housing 510*d* of the hybrid impact tool 10*d* by a set of bearings (not shown). The output spindle 16*d* can include a tool coupling end 592*d* that can comprise a chuck 594*d* or square-shaped end segment (not shown) to which an end effector (e.g., tool bit, tool holder) can be coupled. The output spindle 16*d* can also include an anvil coupling end 702 onto which the anvil 38*d* can be non-rotatably but axially displaceably coupled. In the particular example provided, the anvil coupling end 702 of the output spindle 16*d* has a male hexagonal shape and the anvil recess 700 has a corresponding female hexagonal shape that matingly receives the anvil coupling end 702. The anvil coupling end 702 can include a reduced diameter stub (not specifically shown) that can be received into the stub aperture formed in the spindle 550*d* to support an end of the output spindle 16*d* opposite the tool coupling end 592*d*.

The mode change mechanism 18*d* can include a switch mechanism 606*d* that can be employed to limit axial translation of the anvil 38*d* or lock the anvil 38*d* into a first position (FIG. 21), or to unlock the anvil 38*d* such that it can follower the hammer 36*d* as shown in FIG. 22 to prevent decoupling of the hammer 36*d* and the anvil 38*d*. The switch mechanism 606*d* can include a switch member (not specifically shown), which can be configured to receive an input from an operator to change the position of the anvil 38*d*, and an actuator 652*d* that can couple the switch member to the anvil 38*d*. As those of skill in the art will appreciate, various types of known switch mechanisms can be employed to axially translate the anvil 38*d*. For example, the axially sliding switch mechanism disclosed in U.S. Pat. No. 7,066,691, the disclosure of which is hereby incorporated by reference as if fully set forth in detail herein, could be employed to change the lock state of the anvil 38*d*. It will be appreciated that such switch mechanisms can be employed to maintain the anvil 38*d* in a desired lock state such that a change in the lock state of the anvil 38*d* requires that the switch mechanism be manipulated by the user (e.g., translated or rotated) to effect the change. The actuator 652*d* can be coupled to the switch member for movement therewith and include a wire clip or shift fork 656*d* that can be received into an annular groove 710 formed in the outer peripheral surface of the anvil 38*d* forwardly of the anvil teeth 54*d*.

When the anvil 38*d* is locked in the first position as shown in FIG. 21, the anvil teeth 54*d* can be received between the hammer teeth 52*d* at a position that permits the hammer teeth 52*d* to disengage the anvil teeth 54*d* so that the hammer 36*d* can disengage and cyclically re-engage the anvil 38*d* (i.e., the impact mechanism 14*d* can operate to produce a rotary impacting output that is applied to the output spindle 16*d*). When the anvil 38*d* is in the unlocked state as shown in FIG. 22, the anvil teeth 54*d* are received between the hammer teeth 52*d* and as the anvil 38*d* is permitted to follow the hammer 36*d* to prevent the hammer teeth 52*d* from disengaging the anvil teeth 54*d*, the hammer 36*d* cannot disengage the anvil 38*d* (i.e., the impact mechanism 14*d* is locked so that the output spindle 16*d* is directly driven in a continuous, non-impacting manner).

Figure 23:
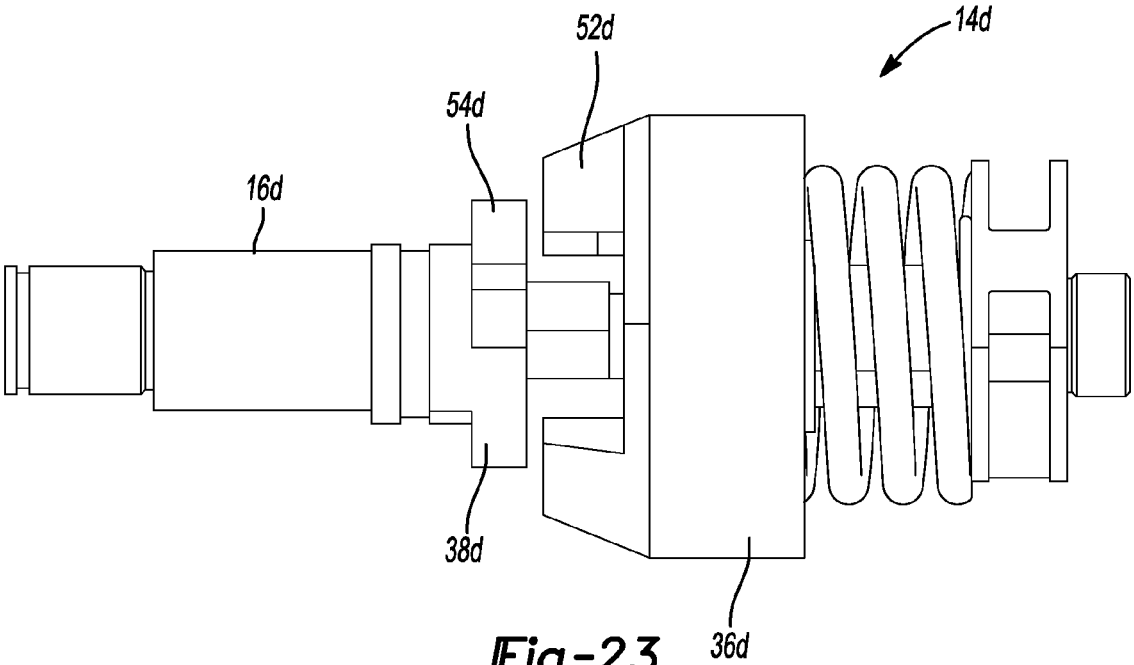

Optionally, the anvil 38*d* can be positioned in a third position, as illustrated in FIG. 23, in which the anvil teeth 54*d* are disengaged from the hammer teeth 52*d*. Placement of the anvil 38*d* in the third position may be employed to prevent the motor 11 (FIG. 13) from stalling. Additionally or alternatively, placement of the anvil 38*d* in the third position may be employed in conjunction with automation of the switch mechanism 606*d*.

Figure 24:
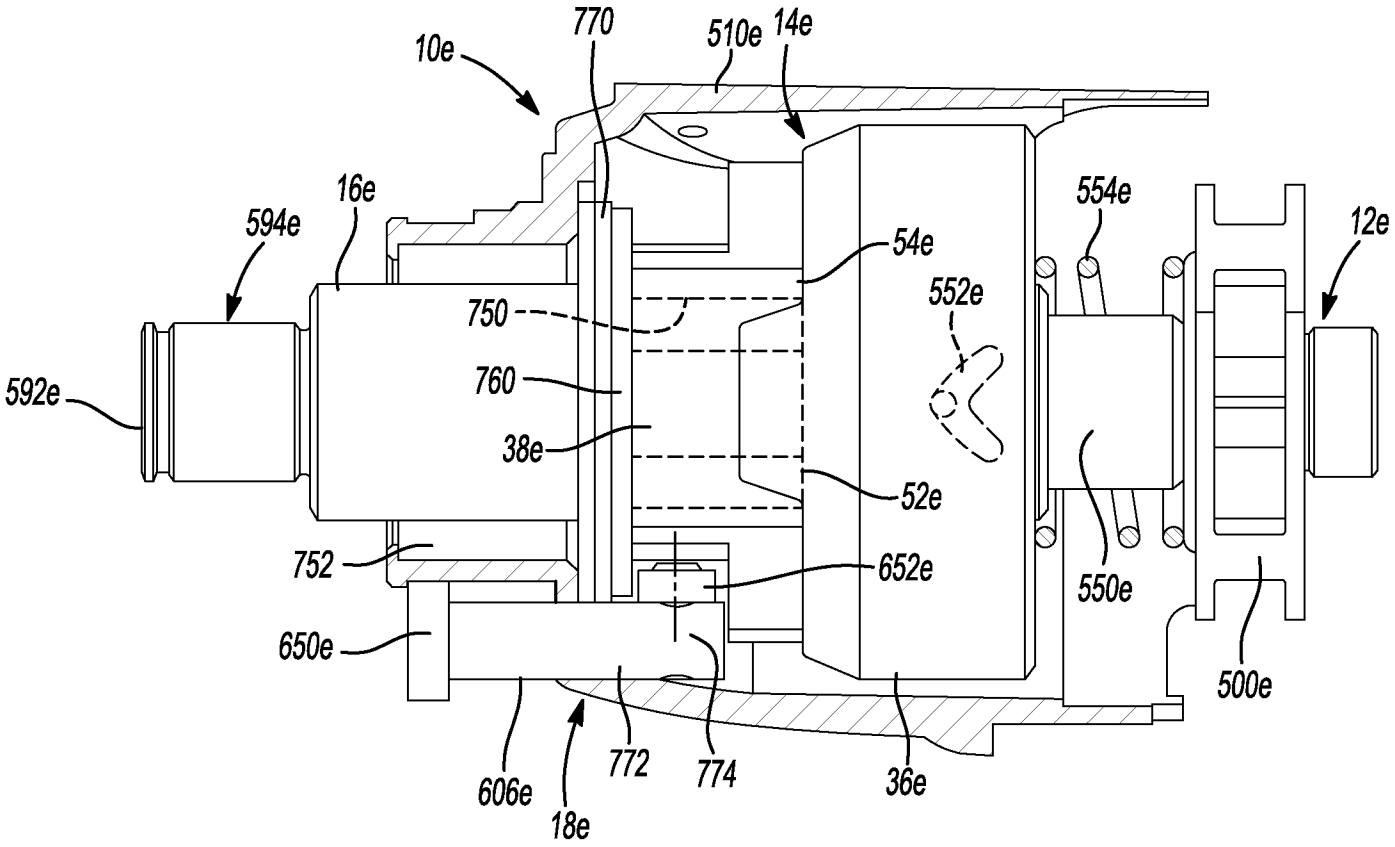
FIG. 24 is an elevation view in partial section of a portion of another hybrid impact tool constructed in accordance with the teachings of the present disclosure.

A portion of an alternately constructed hybrid impact tool 10*e* constructed in accordance with the teachings of the present disclosure is illustrated in FIG. 24. The hybrid impact tool 10*e* can be generally similar to the hybrid impact tool 10*d* of FIG. 13 and can include a motor (not shown), a transmission 12*e*, an impact mechanism 14*e*, an output spindle 16*e* and a mode change mechanism 18*e*. The transmission 12*e* can be any type of transmission and can include one or more reduction stages and a transmission output member 500*e*. In the particular example provided, the transmission 12*e* is a two-stage, single speed planetary transmission and the transmission output member 500*e* is a planet carrier associated with the final (second) stage of the transmission 12*e*.

The impact mechanism 14*e* can include a spindle (input spindle) 550*e*, a hammer 36*e*, a cam mechanism 552*e*, a hammer spring 554*e* and an anvil 38*e*. The spindle 550*e* can be coupled for rotation with the transmission output member 500*e*. The hammer 36*e* can be received onto the spindle 550*e* and can include a set of hammer teeth 52*e*. The cam mechanism 552*e* can be a conventional and well-known cam mechanism that couples the hammer 36*e* to the spindle 550*e* in a manner that permits limited rotational and axial movement of the hammer 36*e* relative to the spindle 550*e*. The hammer spring 554*e* can be disposed coaxially about the spindle 550*e* and can abut the transmission output member 500*e* and the hammer 36*e* to thereby bias the hammer 36*e* toward the anvil 38*e*. The anvil 38*e* can include a plurality of anvil teeth 54*e*, which can be configured to engage the hammer teeth 52*e*, and an anvil recess 750.

The output spindle 16*e* can be supported for rotation relative to a housing 510*e* of the hybrid impact tool 10*e* by a set of bearings 752. The output spindle 16*e* can include a tool coupling end 592*e* that can comprise a chuck 594*e* or square-shaped end segment (not shown) to which an end effector (e.g., tool bit, tool holder) can be coupled. The output spindle 16*e* can also include an anvil coupling end 760 onto which the anvil 38*d* can be non-rotatably but axially displaceably coupled. In the particular example provided, the anvil coupling end 760 of the output spindle 16*e* has a male hexagonal shape and the anvil recess 750 has a corresponding female hexagonal shape that matingly receives the anvil coupling end 760. An end of the output shaft 16*e* opposite the tool coupling end 592*e* can be supported by the spindle 550*e* in a manner that is similar to that which is described above (e.g., via a stub and an aperture).

The mode change mechanism 18*e* can include a flange member 760, a biasing means 762 and a switch mechanism 606*e* that can be employed to retain the anvil 38*e* in a first, forward position or to permit the anvil 38*e* to reciprocate axially between the first position and a second, rearward position. The flange member 760 can be coupled to the anvil 38*e* forwardly of the anvil teeth 54*e* to define an annular space 764 therebetween. The biasing means 762 can comprise one or more springs that can bias the anvil 38*e* toward the hammer 36*e*. In the particular example provided, the biasing means 764 includes a plurality of coil springs that are disposed concentrically about the output spindle 16*e*. A forward end of the biasing means 762 can abut an annular flange 770 on the output spindle 16*e*, while a second, opposite end of the biasing means 762 can abut either the flange member 760 or a thrust bearing (not shown) that can be disposed between the flange member 760 and the biasing means 762.

Figure 26:
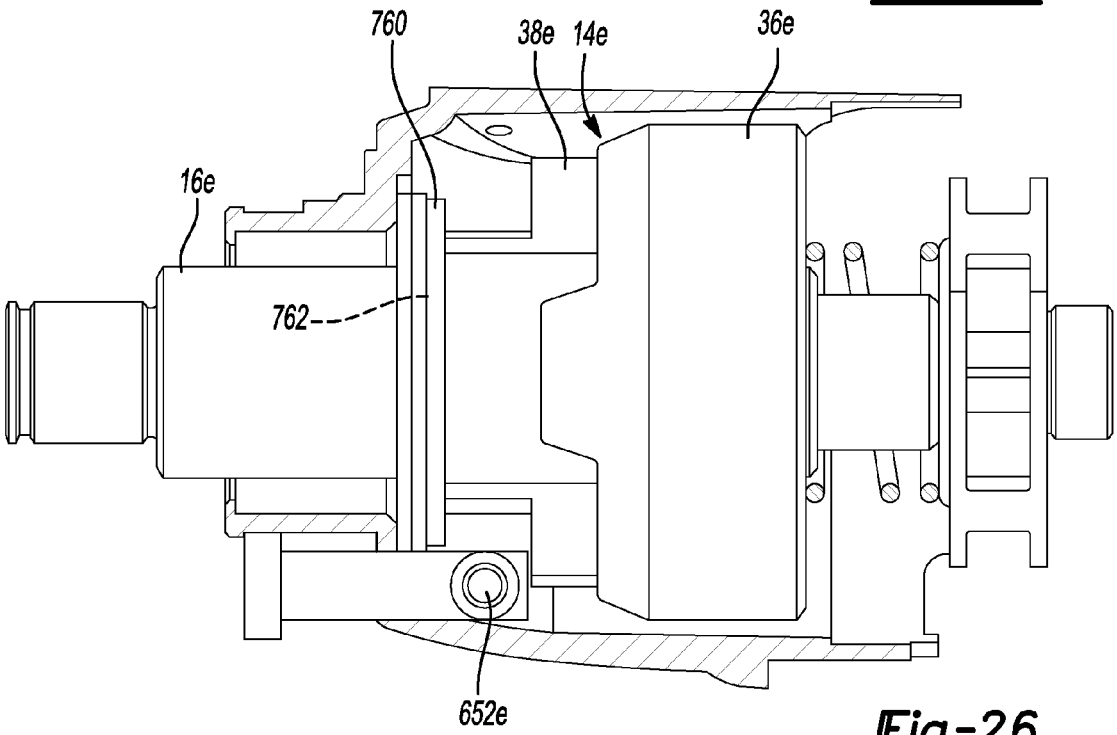
FIGS. 26, 27 and 28 are views similar to that of FIG. 24 but illustrating the impact mechanism operating in a rotary non-impacting mode where the anvil will follow the hammer throughout its axial range of motion.

The switch mechanism 606*e* can include a switch member 650*e*, which can be configured to receive an input from an operator to selectively lock the anvil 38*e* in a forward position, and an actuator 652*e* that can couple the switch member 650*e* to the anvil 38*e*. In the particular example provided, the switch member 650*e* includes a shaft 772 that is generally parallel to the output spindle 16*e* and rotatably but non-axially movably mounted in the housing 510*e*, while the actuator 652*e* includes a ball bearing having an outer race 774 that is rotatable about an axis that is generally perpendicular to the shaft 772. Rotation of the switch member 650*e* will cause corresponding rotation of the shaft 772 so that the actuator 652*e* can be rotated between a first position, which is shown in FIG. 24, and a second position that is shown in FIG. 26. While not shown, those of skill in the art will appreciate that spring biased detents or other means may be employed to hold the switch member 650*e* into one or both of the positions shown in FIGS. 24 and 26.

In the first position, the actuator 652*e* can contact the flange member 760 to maintain the flange member 760 (and the anvil 38*e*) in a forward position in which the biasing means 762 is compressed by the hammer 36*e* and the hammer spring 554*e*. In the example provided, the outer race 774 of the ball bearing is disposed in rolling contact with the flange member 760. In this position, the anvil 38*e* is positioned relative to the hammer 36*e* such that the hammer 36*e* can disengage the anvil 38*e* (see FIG. 25) and cyclically re-engage the anvil 38*e* after the trip torque is reached (i.e., the impact mechanism 14*e* can operate to produce a rotary impacting output that is applied to the output spindle 16*e*).

Figure 27:
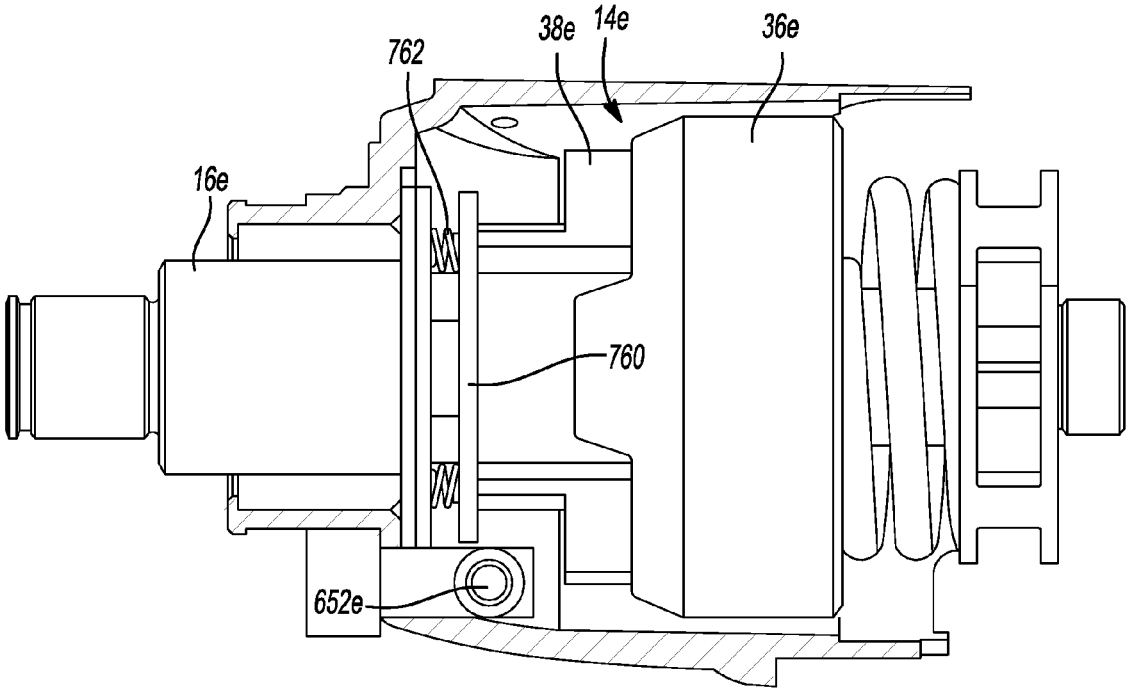
Figure 28:
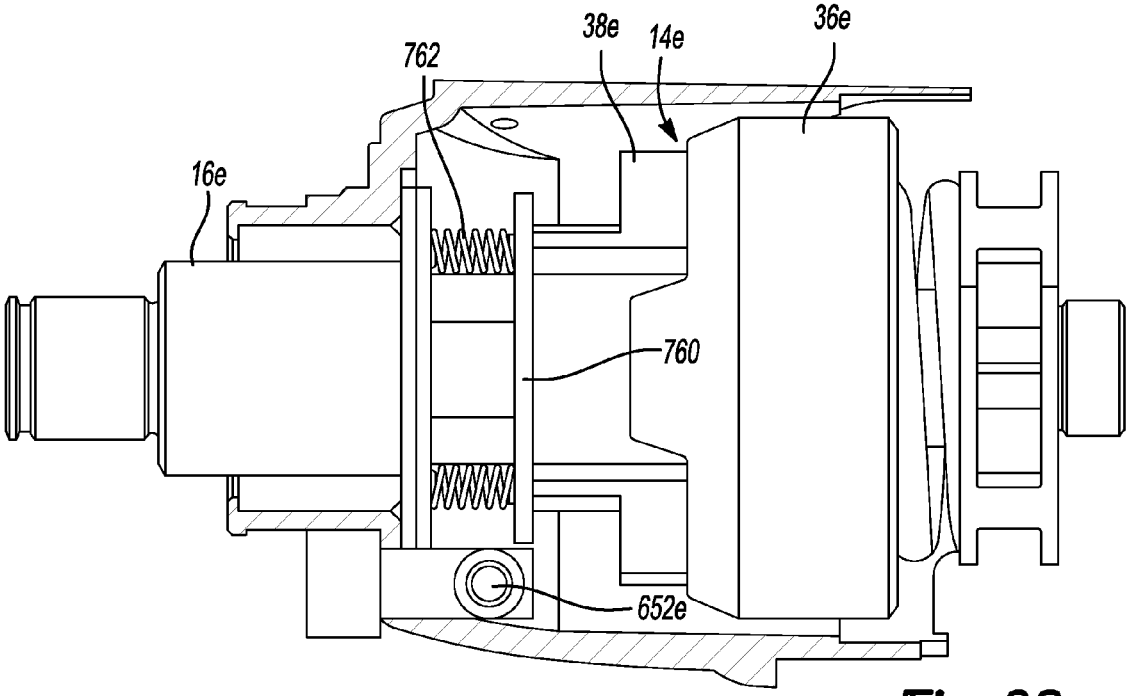

In the second position, which is illustrated in FIG. 26, the actuator 652*e* can be rotated away from the flange member 760 to permit the biasing means 762 to urge the anvil 38*e* rearwardly into sustained engagement with the hammer 36*e*. In this position, the anvil 38*e* will axially follow the hammer 36*e* as shown in FIGS. 26 through 28 to that the hammer 36*e* cannot disengage the anvil 38*e* (i.e., the impact mechanism 14*e* is locked so that the output spindle 16*e* is directly driven in a continuous, non-impacting manner).

Figure 29:
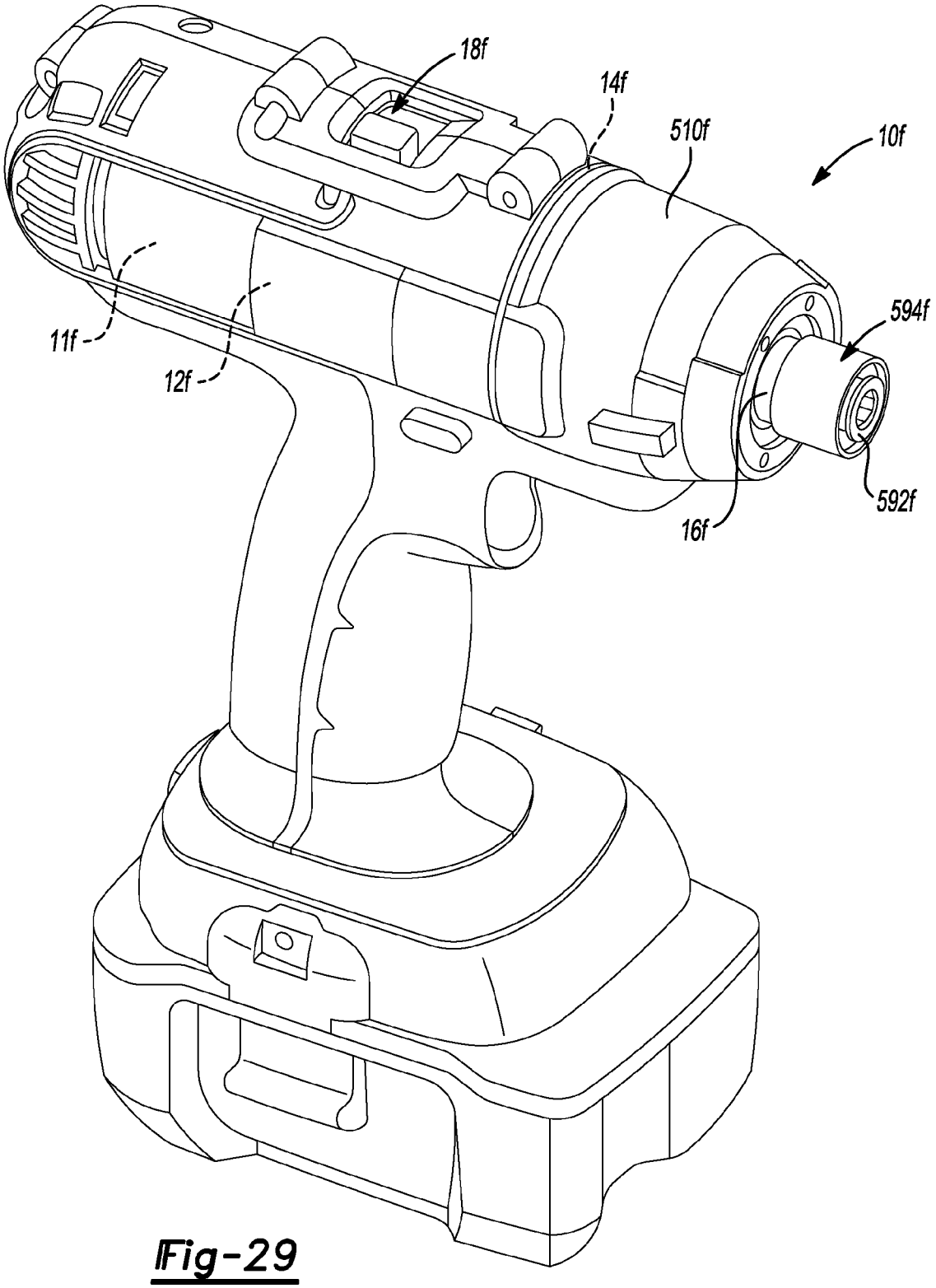
FIG. 29 is a perspective view of another hybrid impact tool constructed in accordance with the teachings of the present disclosure.
Figure 30:
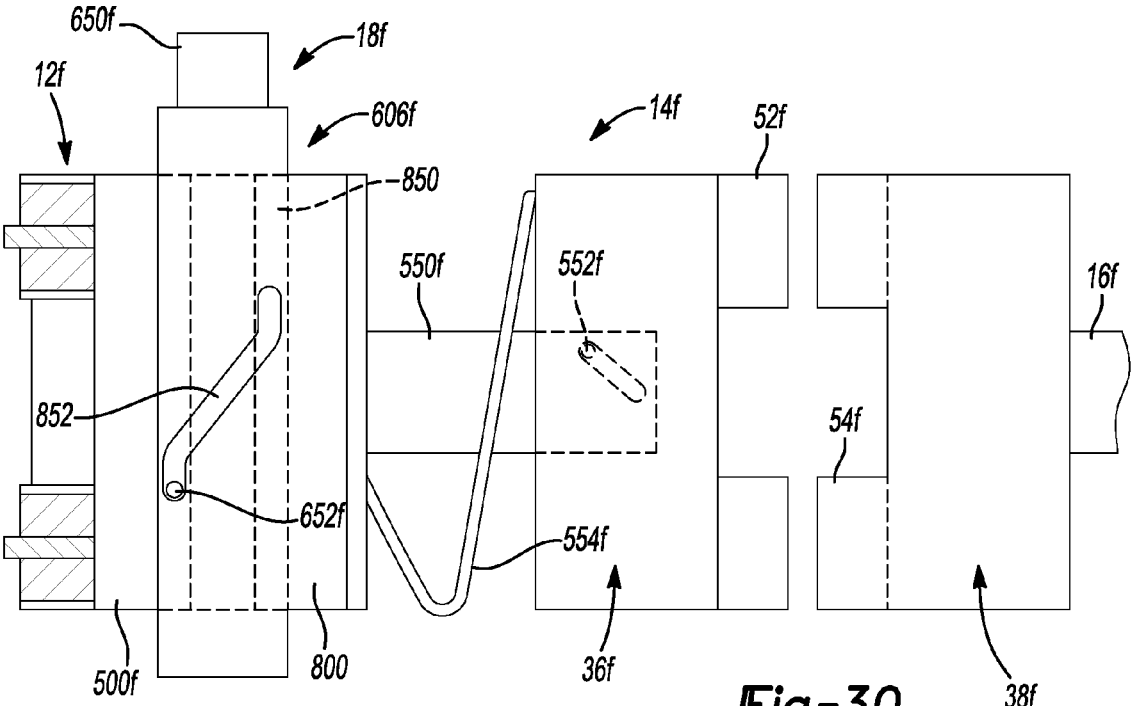
FIG. 30 is a side elevation view of a portion of the hybrid impact tool of FIG. 29, illustrating the impact mechanism and the mode change mechanism in greater detail.

With reference to FIGS. 29 and 30, another hybrid impact tool constructed in accordance with the teachings of the present disclosure is generally indicated by reference numeral 10*f*. The hybrid impact tool 10*f* can be generally similar to the hybrid impact tool 10*d* of FIG. 13 and can include a motor 11*f*, a transmission 12*f*, an impact mechanism 14*f*, an output spindle 16*f* and a mode change mechanism 18*f*. The motor 11*f* can be any type of motor (e.g., electric, pneumatic, hydraulic) and can provide rotary power to the transmission 12*f*. The transmission 12*f* can be any type of transmission and can include one or more reduction stages and a transmission output member 500*f*. In the particular example provided, the transmission 12*f* is a two-stage, single speed planetary transmission and the transmission output member 500*f* is a planet carrier associated with the final (second) stage of the transmission 12*f*.

The impact mechanism 14*f* can include can include a spindle (input spindle) 550*f*, a hammer 36*f*, a cam mechanism 552*f*, a hammer spring 554*f* and an anvil 38*f*. The spindle 550*f* can be coupled for rotation with the transmission output member 500*f*. The hammer 36*f* can be received onto the spindle 550*f* and can include a set of hammer teeth 52*f*. The cam mechanism 552*f* can be a conventional and well-known cam mechanism that couples the hammer 36*f* to the spindle 550*f* in a manner that permits limited rotational and axial movement of the hammer 36*f* relative to the spindle 550*f*. The hammer spring 554*f* can be disposed coaxially about the spindle 550*f* and can abut the hammer 36*f* to thereby bias the hammer 36*f* toward the anvil 38*f*. The anvil 38*f* can include a plurality of anvil teeth 54*f*, which can be configured to engage the hammer teeth 52*f*. The anvil 38*f* can be supported by or on the spindle 550*f* in a manner that is similar to those that are described above.

The output spindle 16*f* can be supported for rotation relative to a housing 510*f* of the hybrid impact tool 10*f*. The output spindle 16*f* can include a tool coupling end 592*f* that can comprise a chuck 594*f* or square-shaped end segment (not shown) to which an end effector (e.g., tool bit, tool holder) can be coupled. The output spindle 16*f* can also be fixed to the anvil 38*f* for rotation therewith.

The mode change mechanism 18*f* can include a hammer spring stop 800, and a switch mechanism 606*f* that can be employed to axially translate the hammer spring stop 800 between two or more positions. The hammer spring stop 800 can be received over the spindle 550*f*. The switch mechanism 606*f* can include a switch member 650*f*, which can be configured to receive an input from an operator to change the position of the hammer spring stop 800, and an actuator 652*f* that can couple the switch member 650*f* to the hammer spring stop 800. As those of skill in the art will appreciate, various types of known switch mechanisms can be employed to axially translate the hammer spring stop 800, such as the rotary sliding switch mechanism disclosed in U.S. Pat. No. 6,431,289. The actuator 652*f* can include a U-shaped wire clip that can be received into an annular groove 850 formed in the outer peripheral surface of the hammer spring stop 800 and a cam track 852 that can be coupled for rotation with the switch member 650*f*. While not shown, it will be appreciated that a detent mechanism or other means can be employed to resist movement of the switch member 650*f* relative to the housing 510*f* of the hybrid impact tool 10*f* to thereby maintain the hammer spring stop 800 in a desired position.

Figure 31:
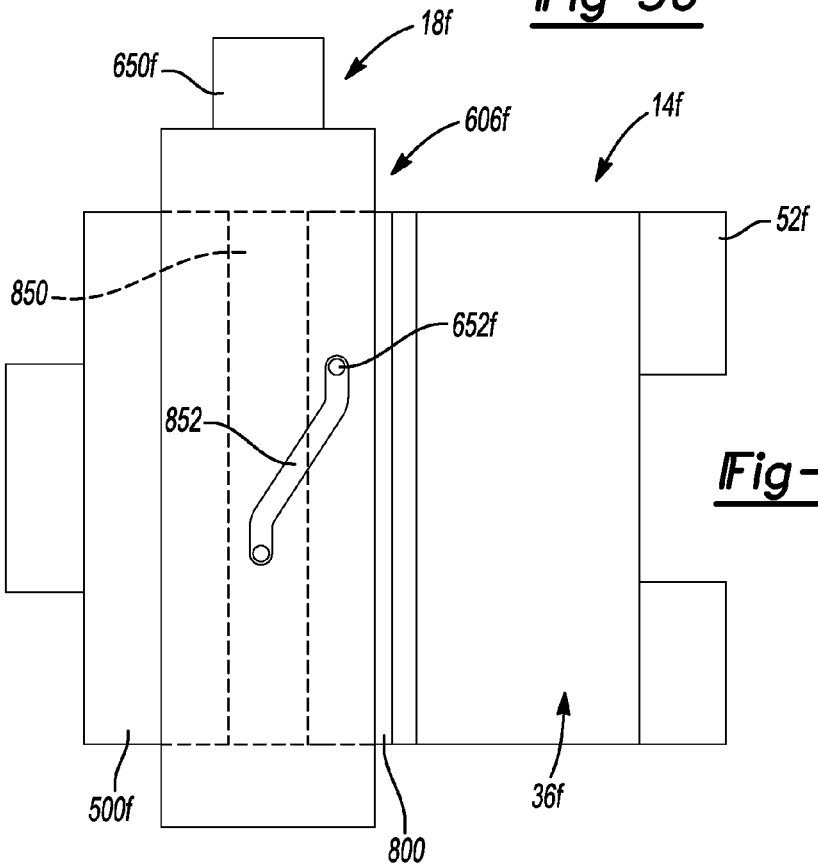
FIG. 31 is a view that is similar to the view of FIG. 30 but illustrates the hybrid impact tool with the hammer locked so that the tool operates in a drill mode.

In its most basic form, the hammer spring stop 800 is movable between a first position (FIG. 31), which prevents the hammer 36*f* from moving away from the anvil 38*f* by a distance that is sufficient to permit the hammer 36*f* to disengage the anvil 38*f*, and a second position (FIG. 30) that is spaced apart from the hammer 36*f* sufficiently so as to permit the hammer 36*f* to disengage the anvil 38*f* when the trip torque has been exceeded. In a more advanced form, the hammer spring stop 800 is movable to one or more intermediate positions between the first position and the second position to further compress the hammer spring 554*f* relative to the compression of the hammer spring 554*f* at the second position to thereby raise the trip torque relative to the trip torque at the second position. Accordingly, it will be appreciated that incorporation of one or more intermediate positions permits the trip torque of the hybrid impact tool 10*f* to be selectively varied between a minimum trip torque, which occurs at the second position, and a maximum trip torque that occurs at the last intermediate position before the first position.

Figure 32:
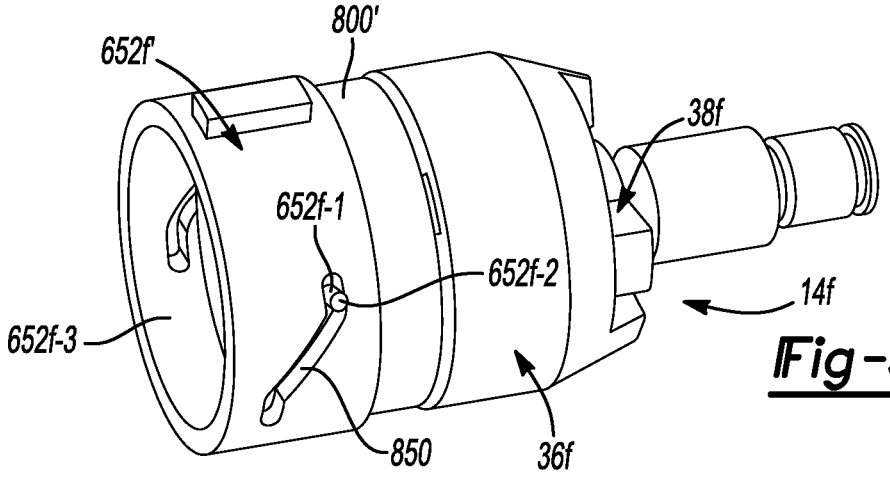
FIGS. 32, 33 and 34 are perspective views of a portion of another hybrid impact tool that is similar to that of FIG. 29 but which employs an alternative mode change mechanism.
Figure 33:
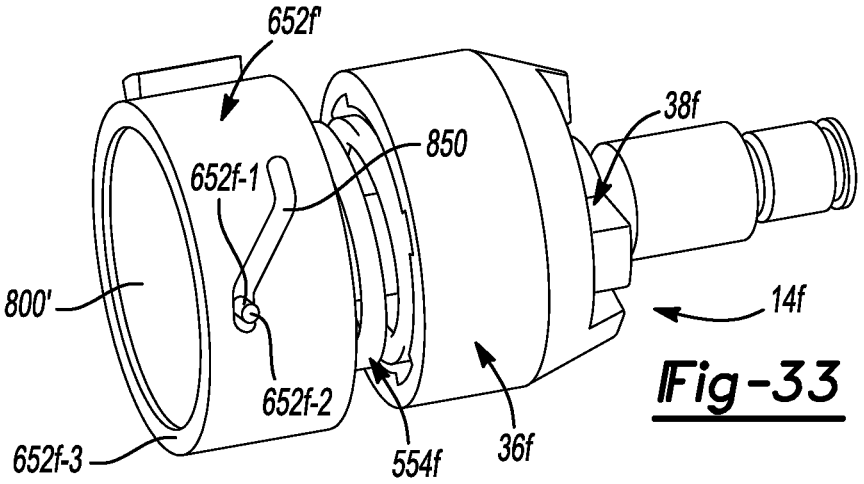
Figure 34:
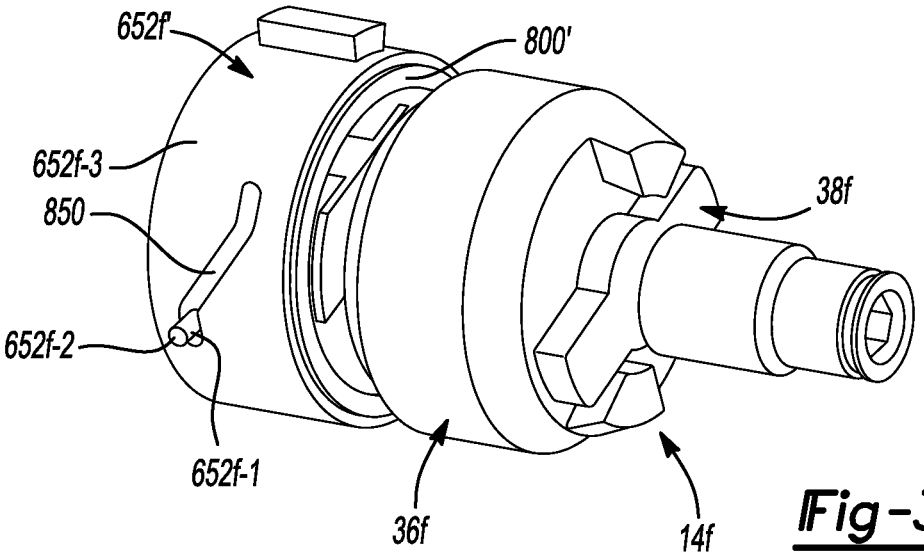

The hammer spring stop 800 is illustrated to be located disposed on a side of the hammer spring 554*f* opposite the hammer 36*f* and as such, it will be understood that the hammer spring stop 800 can be employed to vary the force that is exerted by the hammer spring 554*f* onto the hammer 36*f*. Alternatively, the hammer spring stop 800' could be a hollow (e.g., tubular) structure that can be received about the hammer spring 554*f* as shown in FIGS. 32 through 34. In this alternative configuration, the hammer spring stop 800' can be moved between a first position (FIGS. 32 & 33), which is sufficiently axially spaced apart from the hammer 36*f* so as not to impede operation of the impact mechanism 14*f*, and a second position that can prevent the hammer 36*f* from retreating rearwardly by a sufficient distance that permits the hammer 36*f* to disengage the anvil 38*f*. The actuator 652*f'* can include a wire clip 652*f*-1 that can be received into an annular groove 850 formed about the hammer spring stop 800' and can include a pair of tabs 652*f*-2 that extend through cam tracks 852 formed in a hollow cam 652*f*-3 into which the hammer spring stop 800' is received. While not shown, it will be appreciated that a bearing could be disposed between the hammer spring stop 800' and the hammer 36*f*.

Figure 35:
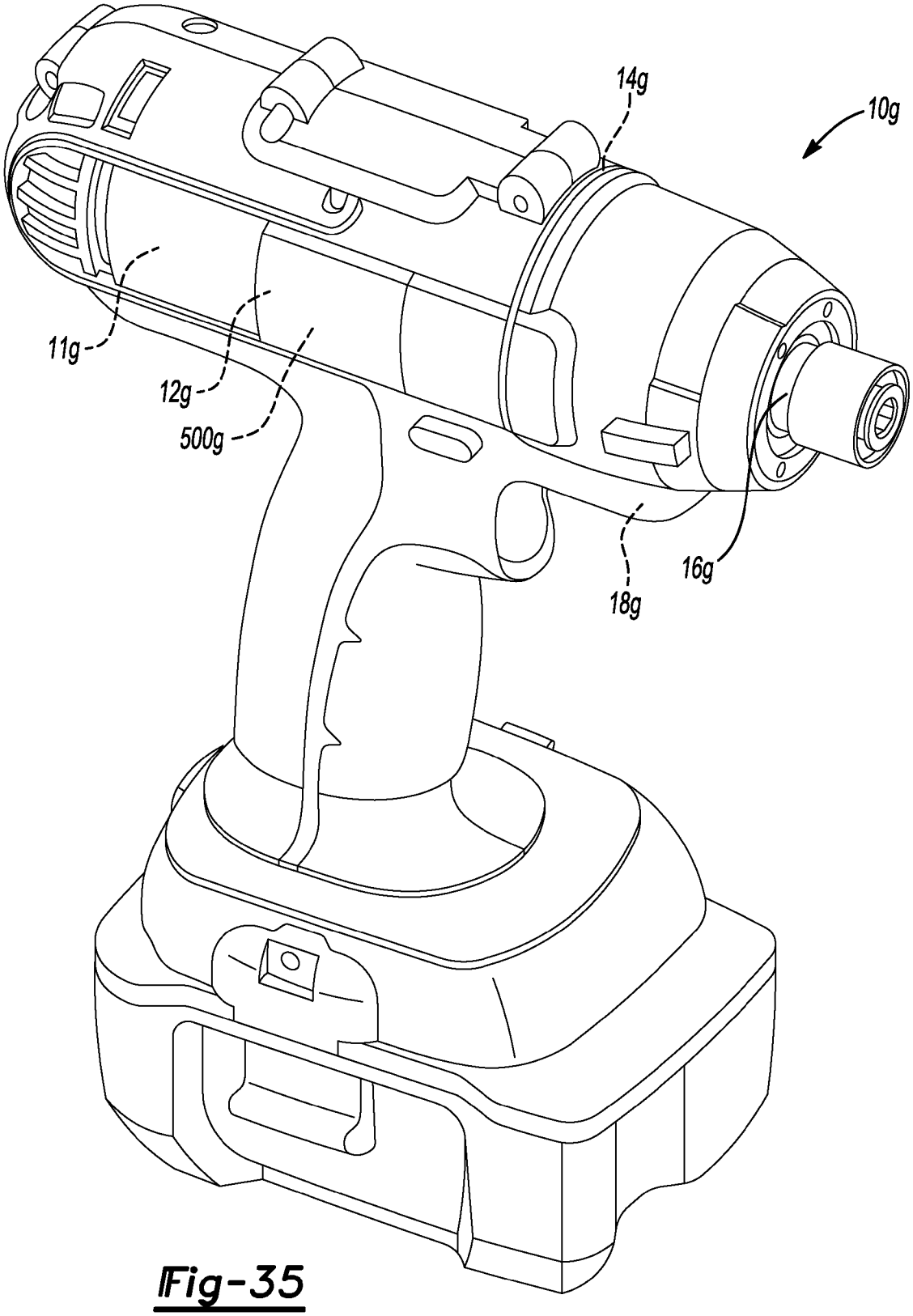
FIG. 35 is a perspective tool of another hybrid impact tool constructed in accordance with the teachings of the present disclosure.

With reference to FIG. 35, another hybrid impact tool constructed in accordance with the teachings of the present disclosure is generally indicated by reference numeral 10*g*. The hybrid impact tool 10*g* can be generally similar to the hybrid impact tool 10*d* of FIG. 13 and can include a motor 11*g*, a transmission 12*g*, an impact mechanism 14*g*, an output spindle 16*g* and a mode change mechanism 18*g*. The motor 11*g* can be any type of motor (e.g., electric, pneumatic, hydraulic) and can provide rotary power to the transmission 12*g*. The transmission 12*g* can be any type of transmission and can include one or more reduction stages and a transmission output member 500*g*. In the particular example provided, the transmission 12*g* is a two-stage, single speed planetary transmission and the transmission output member 500*g* is a planet carrier associated with the final (second) stage of the transmission 12*g*.

Figure 36:
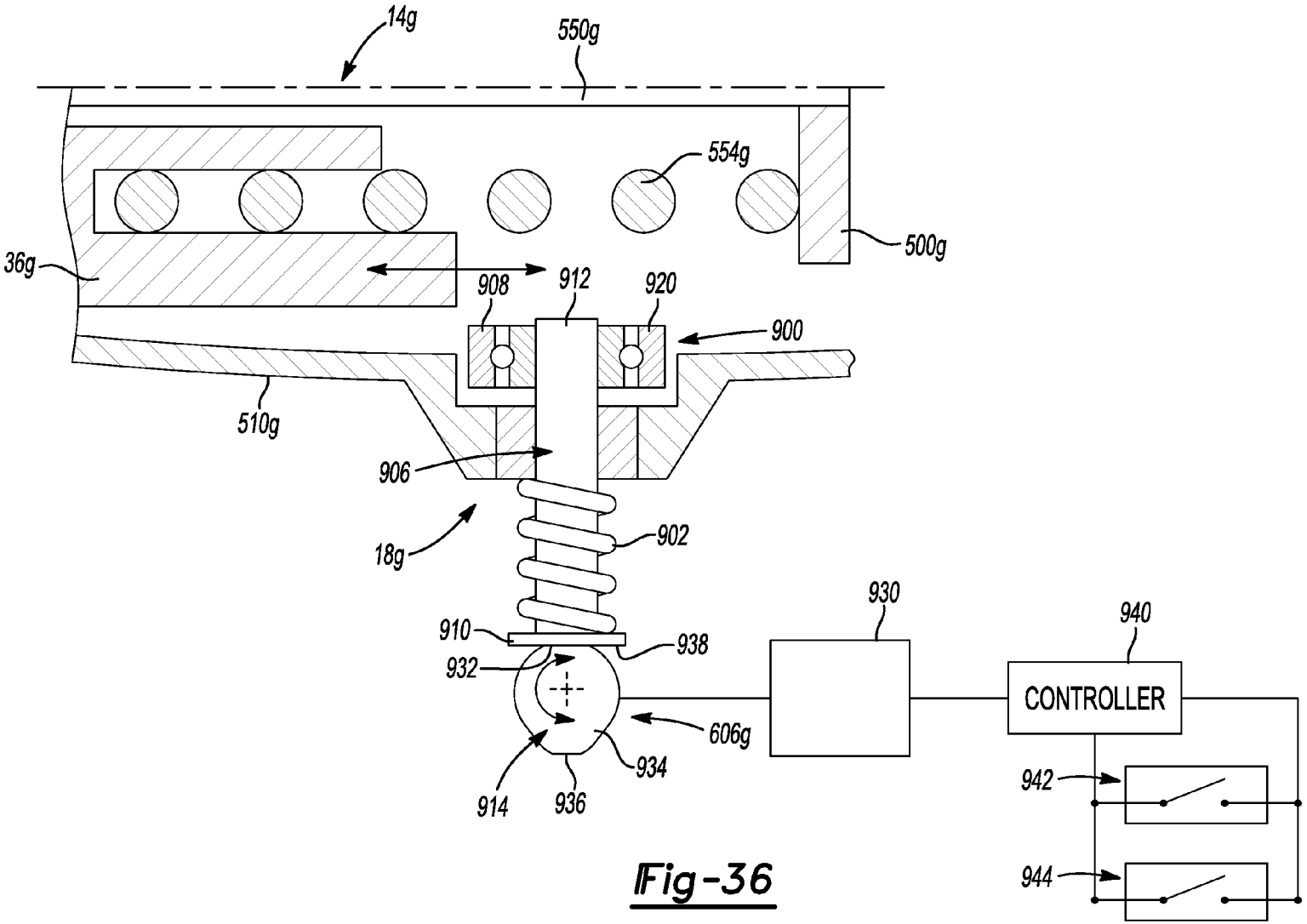
FIGS. 36 and 37 are section views of a portion of the hybrid impact tool of FIG. 35 illustrating the tool in an impact mode and a drill mode, respectively.
Figure 37:
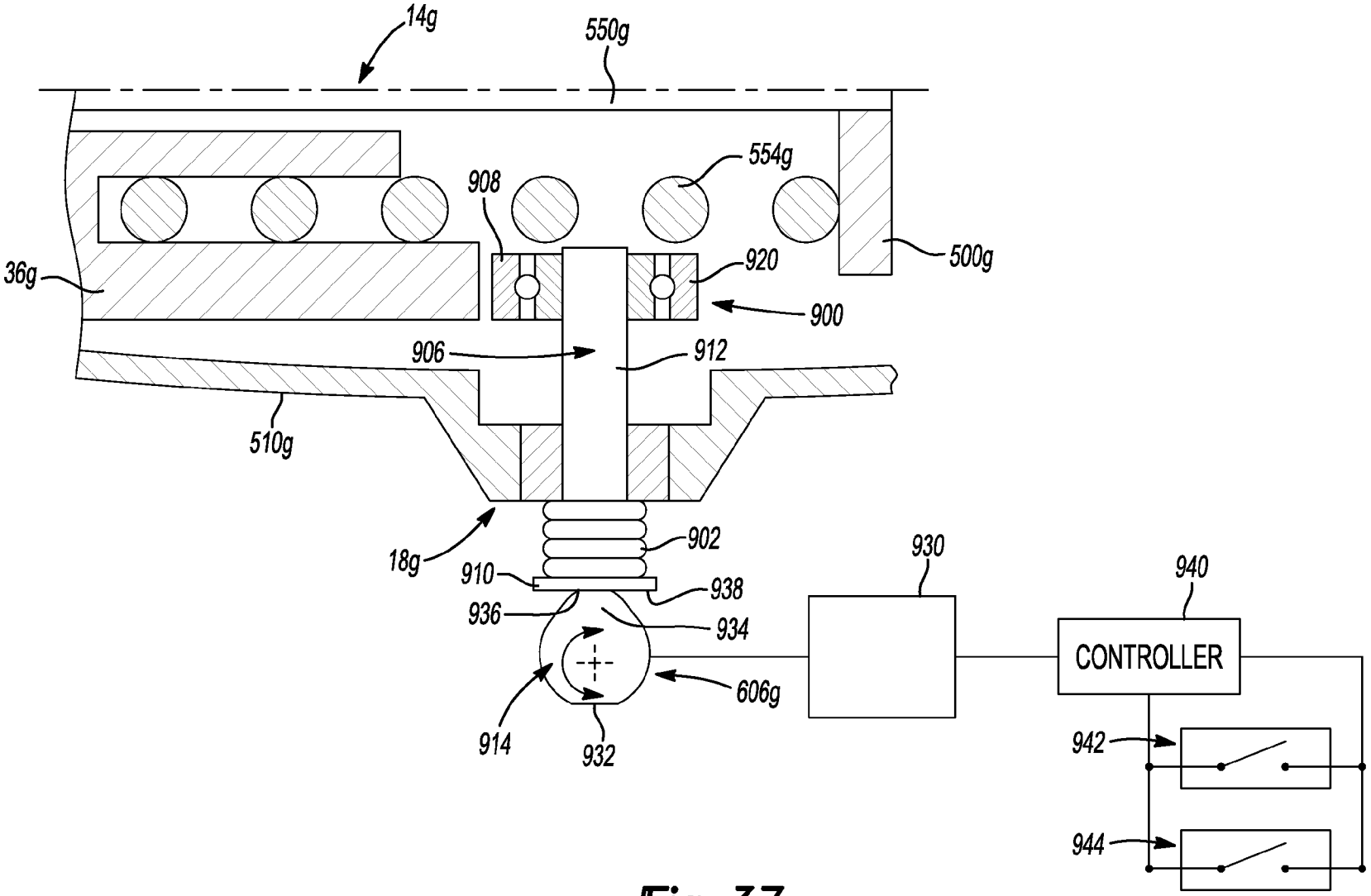

With reference to FIGS. 36 and 37, the impact mechanism 14*g* can include can include a spindle (input spindle) 550*g*, a hammer 36*g*, a cam mechanism (not specifically shown), a hammer spring 554*g* and an anvil (not specifically shown). The spindle 550*g* can be coupled for rotation with the transmission output member 500*g*. The hammer 36*g*, the cam mechanism, the anvil and the output spindle 16*g* can be constructed as described above in the example of FIG. 13. The hammer spring 554*g* can be disposed coaxially about the spindle 550*g* and can abut the hammer 36*g* to thereby bias the hammer 36*g* toward the anvil.

The mode change mechanism 18*g* can include a hammer stop 900, a hammer stop spring 902 and a switch mechanism 606*g* that can be employed to axially translate the hammer stop 900 between a first position (FIG. 36) and a second position (FIG. 37). The hammer stop 900 can include a shaft 906 and a ball bearing 908. The shaft 906 can include a head 910 and a shaft member 912 that can extend through a portion of the housing 510*g* generally perpendicular to a rotational axis of the hammer 36*g*. The hammer stop spring 902 can be disposed between the housing 510*g* and the head 910 to bias the shaft member 912 in a direction outwardly from the housing 510*g*. The switch mechanism 606*g* can be employed to selectively translate the shaft 906 between a first position (FIG. 36) and a second position (FIG. 37). The switch mechanism 606*g* can include a rotary cam 914 that may be rotated by any manual or automated means. For example, the rotary cam 914 can be coupled to a handle (not shown) that can be manually rotated, or could be driven by a motor 930 (schematically shown) in response to movement of a manually operated switch (not shown) or according to a control methodology implemented by a controller (not shown). In situations where a controller is employed to control movement of the rotary cam 914, the controller can be configured to move the rotary cam 914 based on the amount of torque that is output from the output spindle 16*g*. In this regard, the controller can include a sensor for directly or indirectly monitoring a torque value. Such indirect sensors could include, for example, a sensor that senses the current that is delivered to the motor 11*g*.

In the first position as shown in FIG. 36, the shaft member 912 and the ball bearing 908 are retracted away from the hammer 36*g* so as not to interfere with the hammer 36*g* as it disengages and cyclically re-engages the anvil. Accordingly, the impact mechanism 14*g* operates in a mode that is capable of producing a rotary impact to drive the anvil and output spindle 16*g* (FIG. 35) when the torque that is output from the output spindle 16*g* (FIG. 35) exceeds the trip torque.

In the second position as shown in FIG. 37, an outer bearing race 920 of the ball bearing 908 can be disposed in-line with the hammer 36*g* at a location that prevents the hammer 36*g* from moving rearwardly from the anvil by a distance that is sufficient to permit the hammer 36*g* to disengage the anvil. Accordingly, the impact mechanism 14*g* cannot operate in a mode that produces a rotary impact and consequently, the anvil is directly driven by the hammer 36*g* irrespective of whether or not the torque that is output from the output spindle 16*g* (FIG. 35) exceeds the trip torque.

In the example of FIGS. 36 and 37, the cam 914 of the switch mechanism 606*g* can be driven by an output member of a stepper motor 930. The cam 914 can define a base portion 932 and a lobe 934 with a crest portion 936. Both the base portion 932 and the crest portion 936 can be defined by a flat surface that can be parallel to a corresponding surface 938 on the head 910 when the head 910 contacts the base portion 932 or the crest portion 936. As shown in FIG. 36, positioning of the base portion 932 against the head 910 positions the shaft 906 in the first position, while positioning of the crest portion 936 against the head 910 positions the shaft 906 in the second position as shown in FIG. 37. Operation of the stepper motor 930 can be controlled by a controller 940 in response to transmission of a predetermined amount of torque through the output spindle 16*g* (FIG. 35) (which may be the actual amount of torque transmitted or a torque that is inferred from a characteristic, such as a speed of the motor 11*g* (FIG. 35)) or in response to a user-generated signal (which may be generated via second trigger 942 or a bump switch 944 that generates a signal when an axial load applied to the output spindle 16*g* (FIG. 35) exceeds a predetermined axial load).

Those of skill in the art will appreciate that while the switch mechanism 606*g* has been illustrated and described as including a rotary cam that is driven by an electrically-powered device having a rotary output, the invention, in its broadest aspects, may be configured somewhat differently. For example, the switch mechanism 606*g*' of FIG. 38 includes a cam 914' that can be driven by an output member of a linear motor 930', such as a solenoid. The cam 914' can include a first flat 950, a second flat 952 and a ramp 954 that can interconnect the first and second flats 950 and 952. The head 910' of the shaft 906' can be rounded and can abut the cam 914'. Positioning of the head 910' on the first flat 950 positions the shaft 906' in the first position as shown in FIG. 39, while positioning of the head 910' on the second flat 952 positions the shaft 906' in the second position as shown in FIG. 39. Similar to the previously discussed example, operation of the linear motor 930' can be controlled by a controller 940' in response to transmission of a predetermined amount of torque through the output spindle (not specifically shown) or in response to a user-generated signal.

Figure 38:
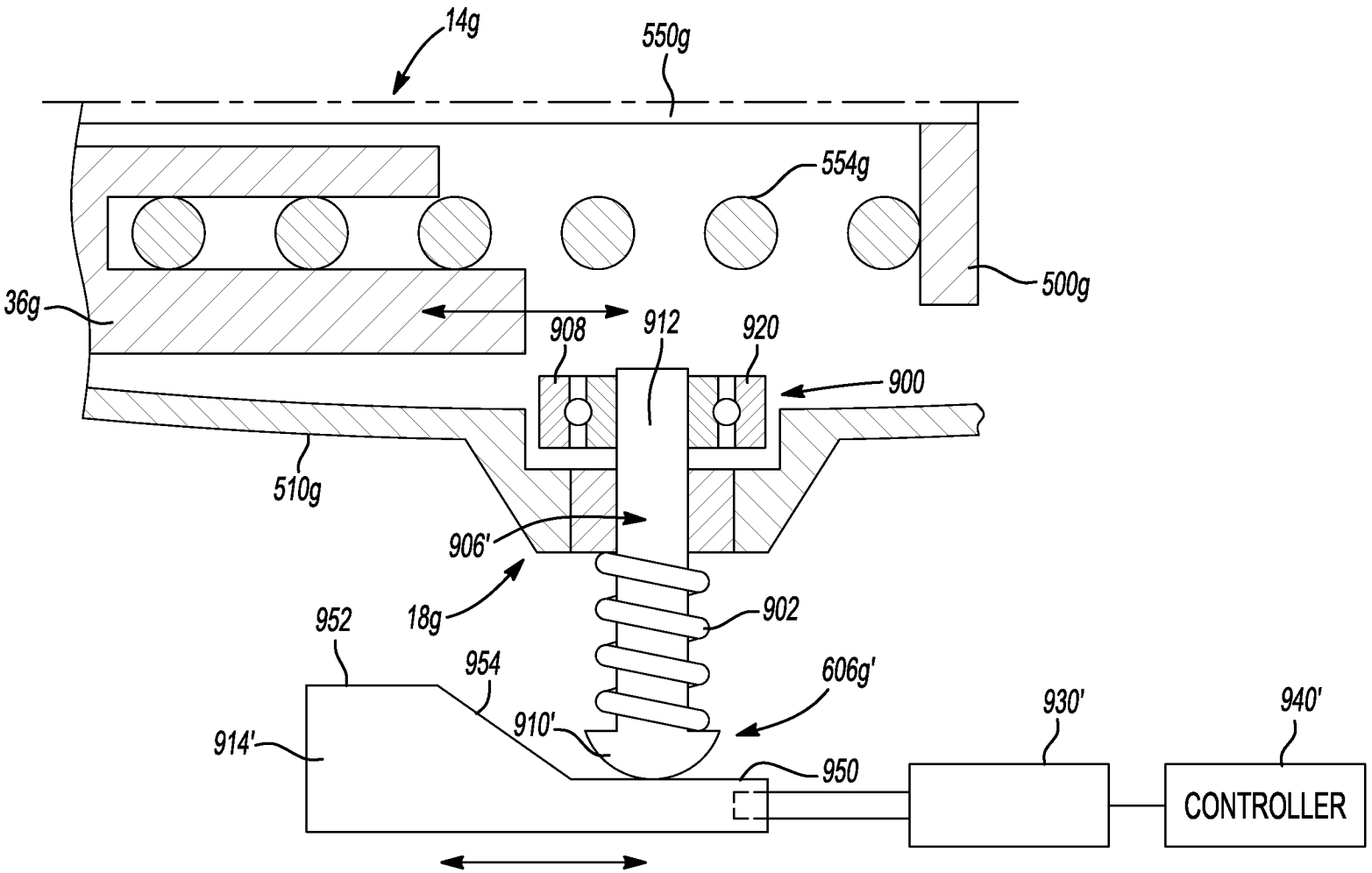
FIGS. 38 and 39 are section views similar to that of FIGS. 36 and 37, but illustrating an alternative switching mechanism.
Figure 39:
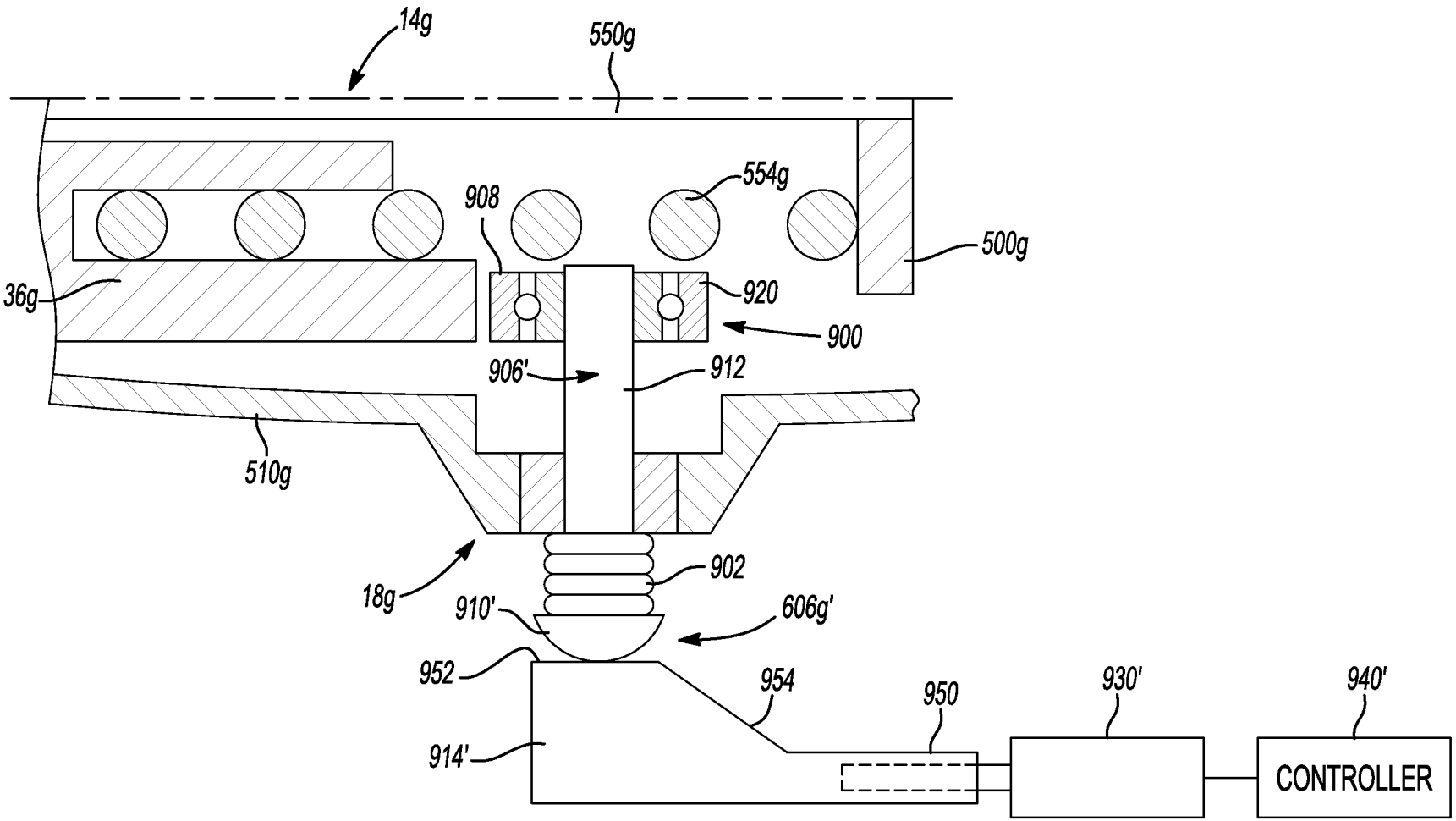
Figure 40:
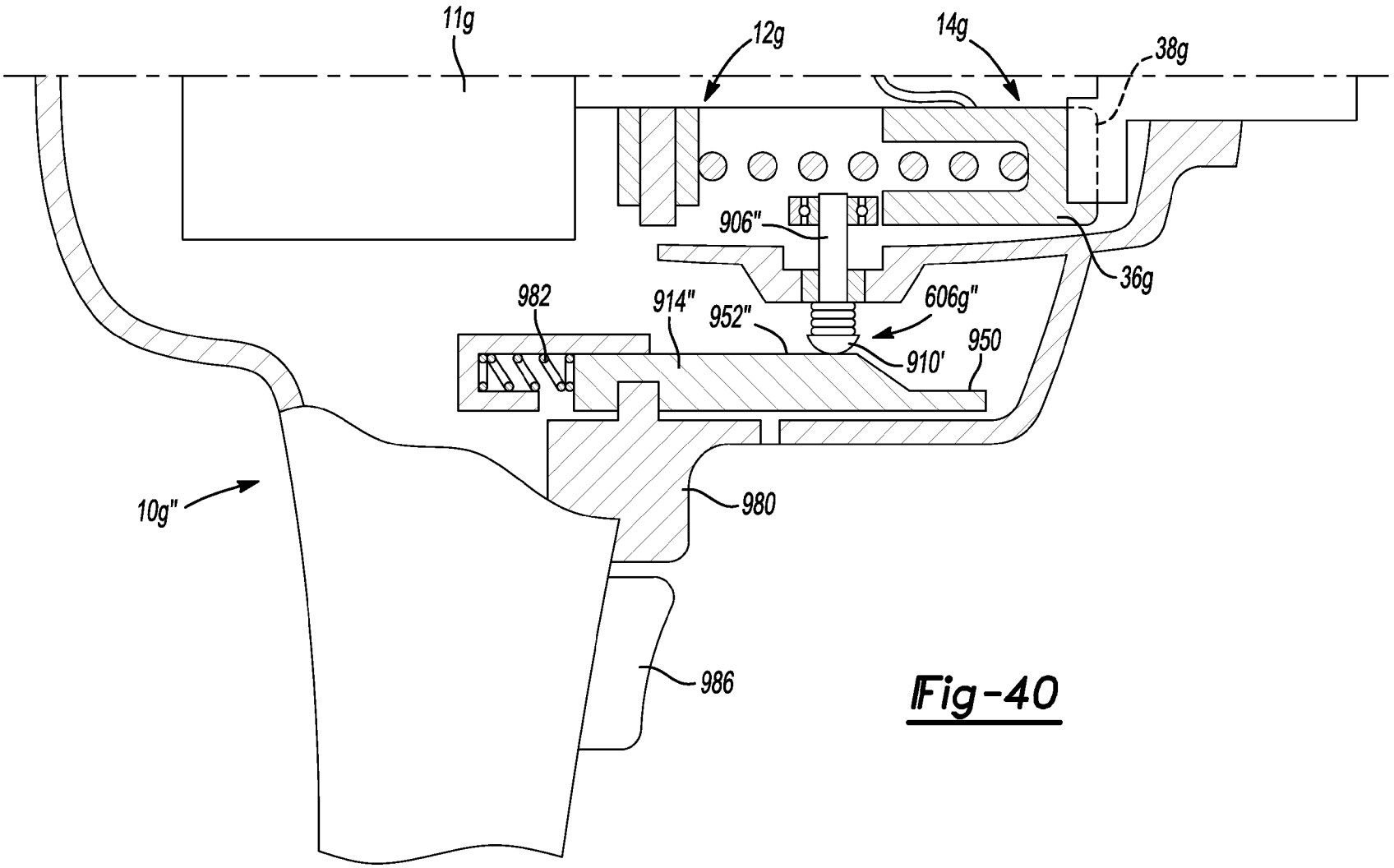
FIG. 40 is another longitudinal section view similar to that of FIGS. 38 and 39, but illustrating yet another alternative switching mechanism.

In the example of FIG. 40, the switch mechanism 606*g*" is generally similar to the switch mechanism 606*g*' of FIG. 38, except that the cam 914" is driven by a second trigger 980". In this example, a spring 982 is employed to bias the cam 914" into the second position and to bias the second trigger 980 into an extended position. An operator may initiate operation of the hybrid impact tool 10*g*" by depressing a first trigger 986 to cause the motor 11*g* to transmit rotary power to the transmission 12*g*. As the cam 914" is biased onto the second flat 952", the shaft 906" is disposed in the second position and the impact mechanism 14*g* is locked such that the hammer 36*g* cannot disengage the anvil 38*g*. When it is desired that the impact mechanism 14*g* operate in a mode to produce a rotary impacting output, the second trigger 980 can be depressed to cause corresponding translation of the cam 914" such that the head 910' is disposed on the first flat 950 (which positions the shaft 906" in the first position). While not shown, it will be appreciated that a lock can be employed to selectively lock the cam 914" in a position in which the head 910" is disposed on the first flat 950.

Figure 25:
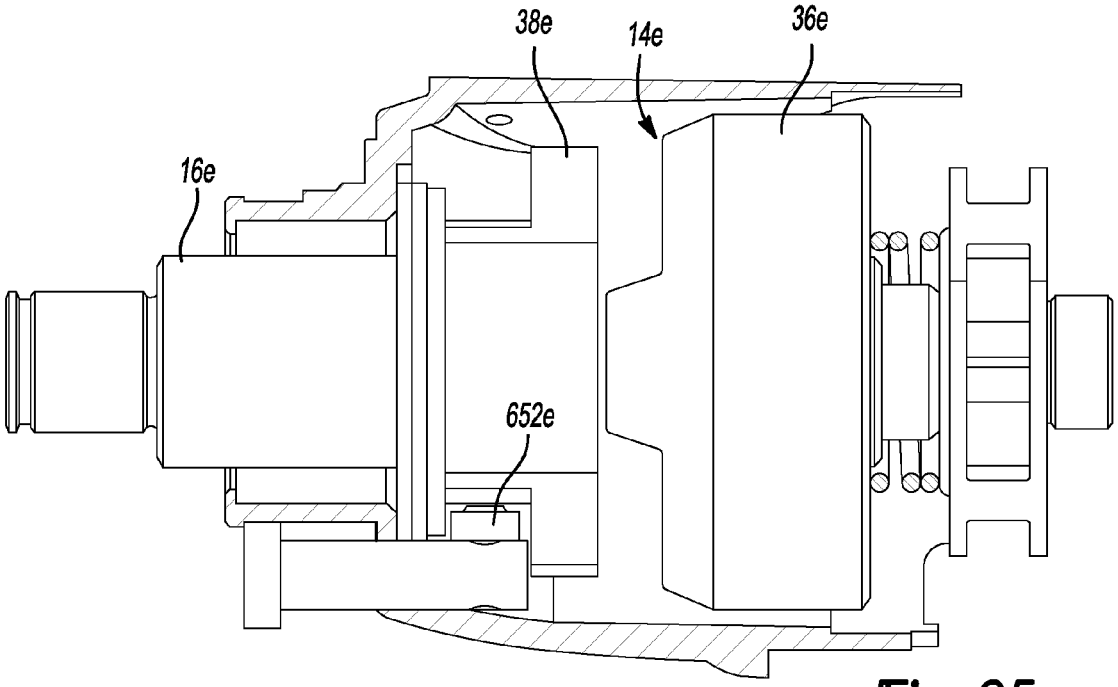
FIG. 25 is a view similar to that of FIG. 24 but illustrating the impact mechanism operating in a rotary impacting mode where the hammer has retreated rearwardly from the hammer.
Figure 41:
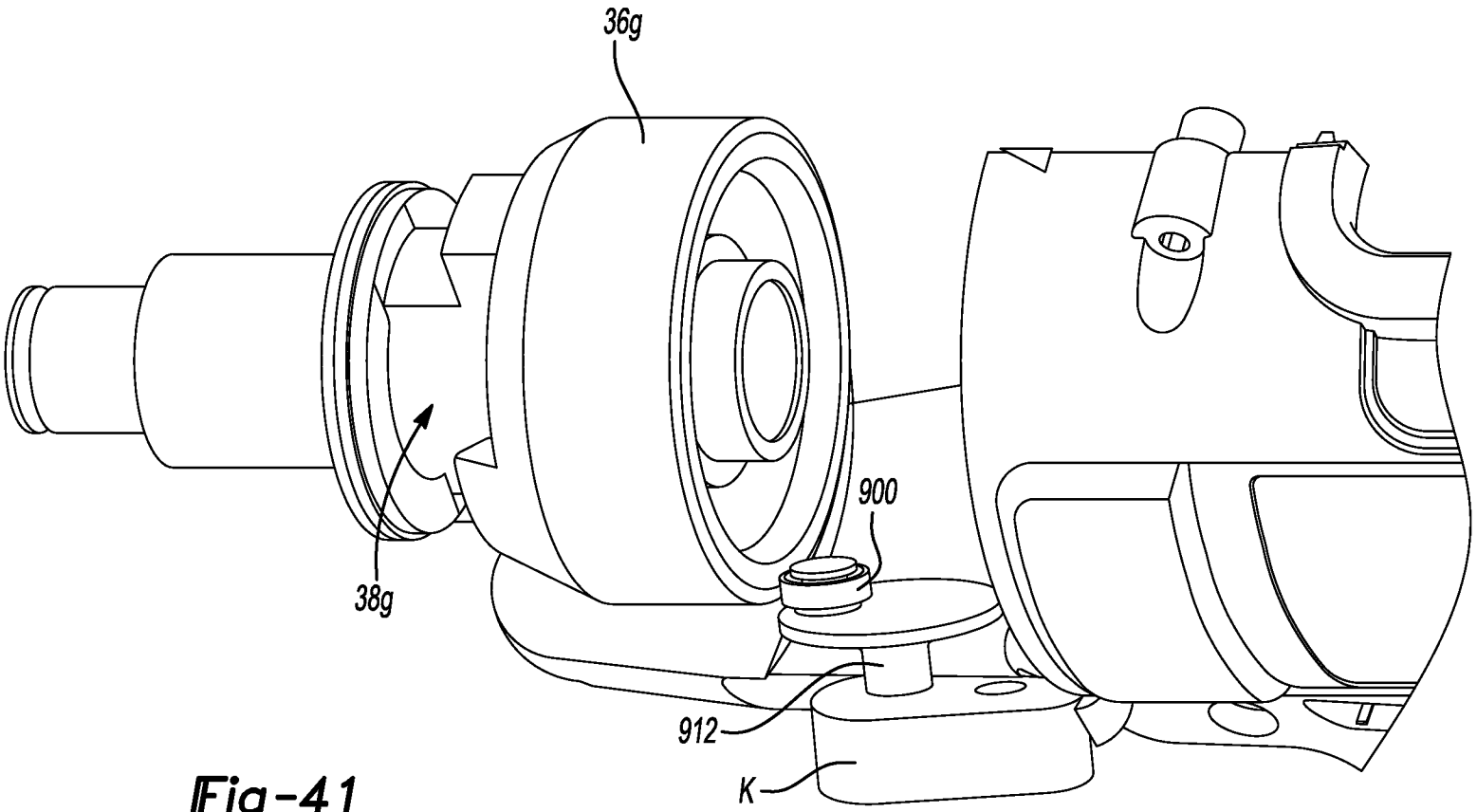
FIG. 41 is a perspective, partly broken away view of a hybrid impact tool similar to that of FIG. 36 but illustrating an eccentrically mounted actuator.

It will be appreciated that the hammer stop 900 could be eccentrically mounted on the shaft member 912 as shown in FIG. 25 so as to permit the hammer stop 900 to be rotated via a rotary knob K between a first position and a second position as shown in FIG. 41. In the first position, the hammer stop 900 can be rotated away from the hammer 36*g* so as not to interfere with the hammer 36*g* as it disengages and cyclically re-engages the anvil. Accordingly, the impact mechanism 14*g* operates in a mode that is capable of producing a rotary impact to drive the anvil and output spindle 16*g* (FIG. 36) when the torque that is output from the output spindle 16*g* (FIG. 36) exceeds the trip torque. In the second position, the hammer stop 900 can be rotated into a position that is in-line with the hammer 36*g* so as to prevent the hammer 36*g* from moving rearwardly from the anvil by a distance that is sufficient to permit the hammer 36*g* to disengage the anvil. Accordingly, the impact mechanism 14*g* cannot operate in a mode that produces a rotary impact and consequently, the anvil is directly driven by the hammer 36*g* irrespective of whether or not the torque that is output from the output spindle 16*g* (FIG. 36) exceeds the trip torque.

Figure 42:
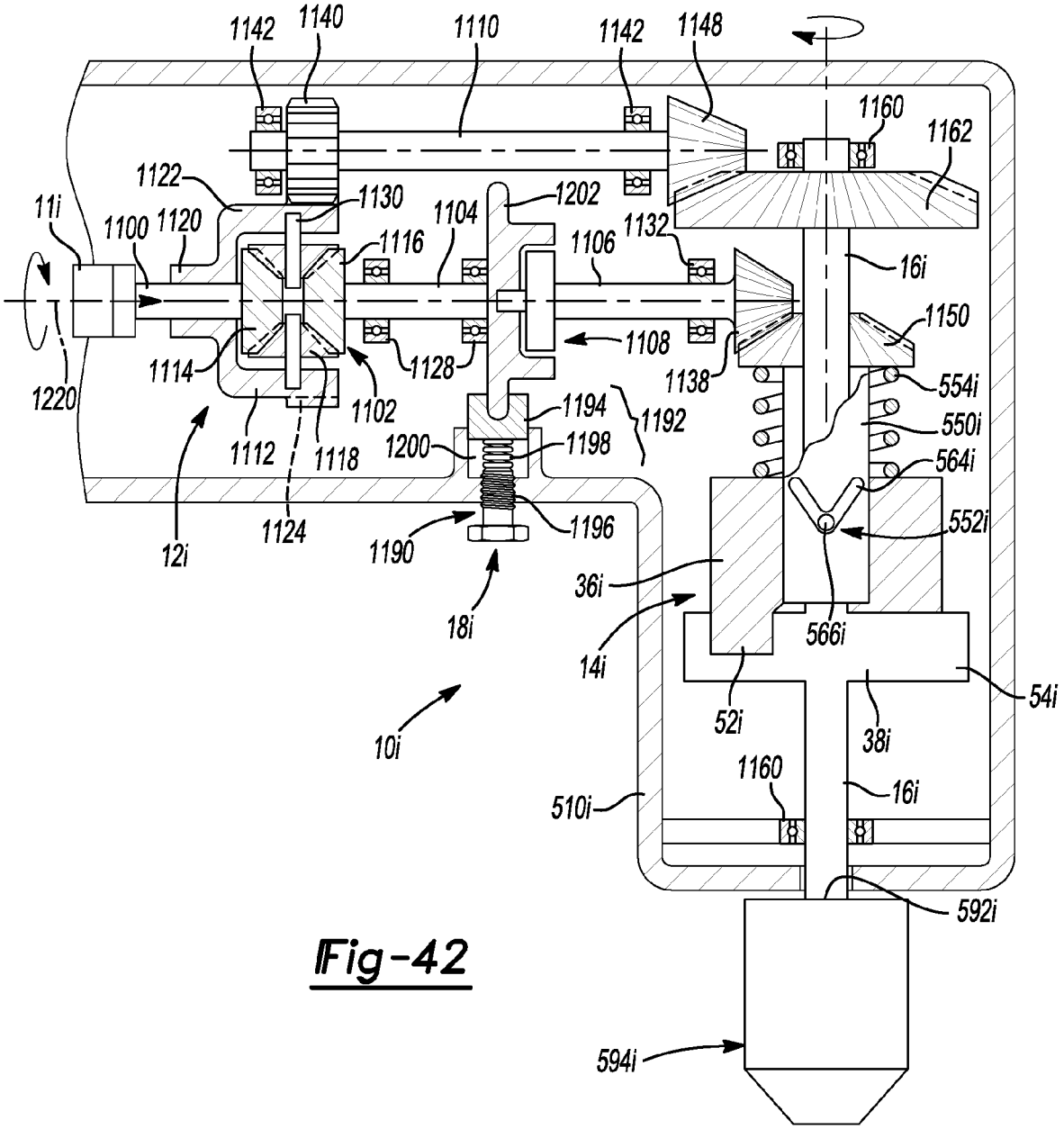
FIG. 42 is a section view of a portion of another hybrid impact tool constructed in accordance with the teachings of the present disclosure.

With reference to FIG. 42, another hybrid impact tool constructed in accordance with the teachings of the present disclosure is generally indicated by reference numeral 10*i*. The hybrid impact tool 10*i* can include a motor 11*i*, a transmission 12*i*, an impact mechanism 14*i*, an output spindle 16*i* and a mode change mechanism 18*i*. The motor 11*i* can be any type of motor (e.g., electric, pneumatic, hydraulic) and can provide rotary power to the transmission 12*i*.

The transmission 12*i* can include one or more reduction stages and can include a differential input shaft 1100, a differential 1102, an impact intermediate shaft 1104, an impact output shaft 1106, a one-way clutch 1108, and a drill intermediate shaft 1110. The differential 1102 can include a differential case 1112, an input side gear 1114, an output side gear 1116 and a plurality of pinions 1118 that mesh with the input side gear 1114 and the output side gear 1116. The differential case 1112 can include a hollow neck 1120, a hollow body 1122 and a plurality of gear teeth 1124 that can extend about an outer perimeter of the hollow body 1122 axially spaced apart from the hollow neck 1120. The differential input shaft 1100 can be received through the hollow neck 1120 of the differential case 1112 and can be coupled for rotation with the input side gear 1114, which can be received in the hollow body 1122. The output side gear 1116 can be disposed within the hollow body 1122 and coupled for rotation with the impact intermediate shaft 1104, which can be rotatably supported in the housing 510*i* by a set of bearings 1128. The pinions 1118 can be journally supported on a pinion shaft 1130 for rotation within the hollow body 1122. The impact output shaft 1106 can be rotatably supported in the housing 510*i* by a set of bearings 1132 and can be coupled to the impact intermediate shaft 1104 via the one-way clutch 1108 and can include an impact intermediate output gear 1138. The plurality of gear teeth formed on the hollow body 1122 of the differential case 1112 can be meshingly engaged with a drill intermediate input gear 1140 that is non-rotatably coupled to the drill intermediate shaft 1110. The drill intermediate shaft 1110 can be rotatably supported in the housing

510*i* by a set of bearings 1142 and can be non-rotatably coupled to a drill intermediate output gear 1148.

The impact mechanism 14*i* can include a spindle 550*i*, a cam mechanism 552*i*, a hammer 36*i*, an anvil 38*i* and a hammer spring 554*i*. The spindle 550*i* can be a generally hollow structure that can be disposed co-axially with the output shaft 16*i*. The spindle 550*i* can include an impact input gear 1150 that can be meshingly engaged to the impact intermediate output gear 1138. The hammer 36*i* can be received co-axially onto the spindle 550*i* and can include a set of hammer teeth 52*i*. The cam mechanism 552*i*, which can include a pair of V-shaped grooves 564*i* (only one shown) formed on the perimeter of the spindle 550*c* and a pair of balls 566*i* (only one shown) that are received into the V-shaped grooves 564*i* and corresponding recesses (not shown) formed in the hammer 36*i*, couples the hammer 36*i* to the spindle 550*i* in a manner that permits limited rotational and axial movement of the hammer 36*i* relative to the spindle 550*i*. Such cam mechanisms are well known in the art and as such, the cam mechanism 552*i* will not be described in further detail. The hammer spring 554*i* can be disposed coaxially about the spindle 550*i* and can abut the impact input gear 1150 and the hammer 36*i* to thereby bias the hammer 36*i* toward the anvil 38*i*. The anvil 38*i* can be coupled for rotation with the output spindle 16*i* and can include a plurality of anvil teeth 54*i* that can be engaged to the hammer teeth 52*i*.

The output spindle 16 can be supported in the housing 510*i* by a set of bearings 1160 include a drill input gear 1162 that can be in meshing engagement with the drill intermediate output gear 1148. The output spindle 16*i* can include a tool coupling end 592*i* that can comprise a chuck 594*i* or square-shaped end segment (not shown) to which an end effector (e.g., tool bit, tool holder) can be coupled. The output spindle 16*i* can also be fixed to the anvil 38*i* for rotation therewith.

The mode change mechanism 18*i* can include a means 1190 for locking the impact intermediate shaft 1104 against rotation relative to the housing 510*i*. In the particular example provided, the locking means 1190 includes a slip clutch 1192 having a shoe 1194, an adjustment knob 1196 and a spring 1198. The shoe can be received in a channel 1200 formed in the housing 510*i* and can frictionally engaged to a flange 1202 that can be formed on the impact intermediate shaft 1104. The spring 1198 can be a compression spring and can be received in the channel 1200 so as to abut the shoe 1194. The adjustment knob 1196 can be threadably coupled to the housing 510*i* and can be adjusted by the user to compress the spring 1198 as desired to thereby adjust a slip torque of the slip clutch 1192. Those of skill in the art will appreciate, however, that the locking means 1190 could employ other types of clutches, such as a dog clutch, can be employed to lock the impact intermediate shaft 1104 against rotation relative to the housing 510*i*.

During operation, torque is transmitted from the motor 11*i* to the transmission 12*i* and directed into the differential 1102 via the differential input shaft 1100. When the locking means 1190 locks the impact intermediate shaft 1104 against rotation (e.g., when a reaction torque applied against the slip clutch 1192 does not exceeds the user-set slip torque of the slip clutch 1192), rotation of the input side gear 1114 (due to rotation of the differential input shaft 1100) will cause the pinions 1118 to rotate about a rotational axis 1220 of the input side gear 1114 and drive the differential case 1112. The gear teeth 1124 that are coupled to the outer perimeter of the hollow body 1122 will rotate as the differential case 1112 rotates to thereby drive the drill intermediate output gear 1140. Power received from the drill intermediate output gear 1140 is transmitted through the drill intermediate shaft 1110 and output via the drill intermediate output gear 1148 to the drill input gear 1162 to thereby drive the output spindle 16*i*. Rotation of the output spindle 16*i* in this mode will cause rotation of the impact output shaft 1106 (via the anvil 38*i*, the hammer 36*i*, the cam mechanism 552*i*, the spindle 550*i* and the impact intermediate output gear 1138, which is meshingly engaged with the impact input gear 1138). The one-way clutch 1108, however, prevents torque from being transmitted from the impact output shaft 1106 to the impact intermediate shaft 1104. As rotary power is passed directly to the output spindle 16*i* from the transmission 12*i*, the impact mechanism 14*i* cannot operate in a mode that produces a rotary impact.

When the locking means 1190 does not lock the impact intermediate shaft 1104 against rotation (e.g., when a reaction torque applied against the slip clutch 1192 does not exceeds the user-set slip torque of the slip clutch 1192) and the torque reaction applied to the output spindle 16*i* via the drill intermediate shaft 1110 is insufficient to rotate the output spindle 16*i* (such that the drill intermediate shaft 1110 locks the differential case 1112 against rotation via engagement between the drill intermediate input gear 1142 and the gear teeth 1124 on the hollow body 1122), rotation of the input side gear 1114 (due to rotation of the differential input shaft 1100) will cause the pinions 1118 to transmit torque to the output side gear 1116 to drive the impact intermediate shaft 1104 about the rotational axis 1220. Rotary power is passed through the one-way clutch 1108 to the impact output shaft 1106 and then into the spindle 550*i* via the impact intermediate output gear 1138 and the impact input gear 1150. Accordingly, the spindle 550*i* can drive the hammer 36*i* (via the cam mechanism 552*i*) and the hammer 36*i* can disengage and cyclically re-engage the anvil 38*i* to produce a rotary impacting output.

Those of skill in the art will appreciate that a change in the speed ratio of the transmission 12*i* can be co-effected with a change in the operational mode of the impact mechanism 14*i*. In the particular example provided, rotary power routed through the transmission 12*i* when the locking means 1190 locks the impact intermediate shaft 1104 against rotation drives the output spindle 16*i* at a first reduction ratio, whereas rotary power routed through the transmission 12*i* when the locking means 1190 does not lock the impact intermediate shaft 1104 against rotation drives the output spindle 16*i* at a second, relatively smaller reduction ratio as higher speeds and lower torques are generally better suited for operation in mode that produces rotary impact. It will be understood, however, that the first and second reduction ratios may be selected as desired and that they could be equal in some situations.

Figure 43:
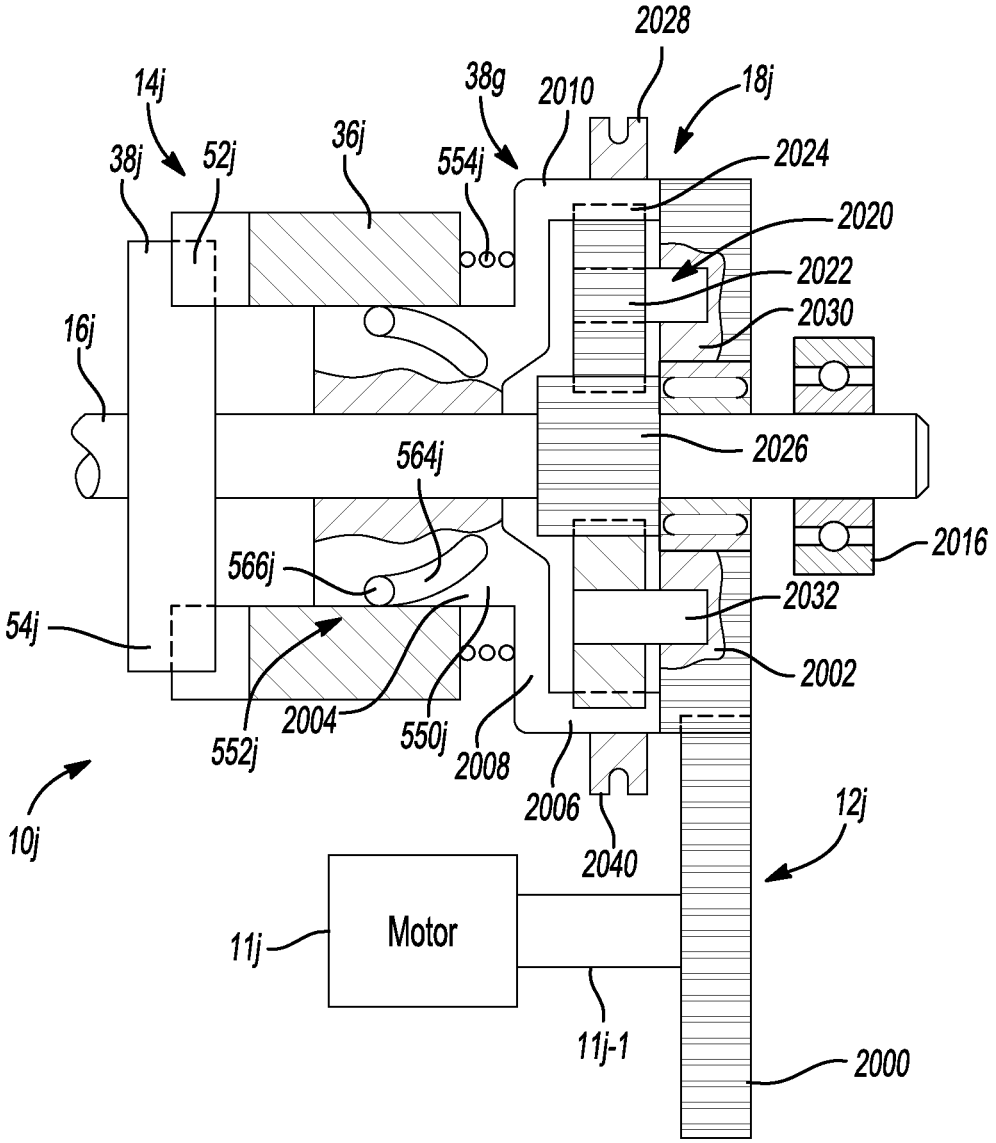
FIG. 43 is a section view of a portion of still another hybrid impact tool constructed in accordance with the teachings of the present disclosure.

Another example of a hybrid impact tool constructed in accordance with the teachings of the present disclosure is generally indicated by reference numeral 10*j* in FIG. 43. The hybrid impact tool 10*j* can include a motor 11*j*, a transmission 12*j*, an impact mechanism 14*j*, an output spindle 16*j* and a mode change mechanism 18*j*. The motor 11*j* can be any type of motor (e.g., electric, pneumatic, hydraulic) and can provide rotary power to the transmission 12*j*. The transmission 12*j* can include a single stage spur gear reduction that can include a spur pinion 2000 which can be coupled to the output shaft 11*j*-1 of the motor 11*j*, and a driven gear 2002 that can be meshingly engaged to the spur pinion 2000. The impact mechanism 14*j* can include a spindle (input spindle) 550*j*, a hammer 36*j*, a cam mechanism 552*j*, a hammer spring 554*j* and an anvil 38*j*. The spindle 550*j* can be rotatably disposed on the output shaft 16*j* and can include a first body portion 2004, which can be generally tubular in shape, a second body portion 2006, which can be generally tubular in shape, and a radially extending flange 2008 that can couple the first and second body portions 2004 and 2006 to one another. A plurality of mode change teeth 2010 can be formed onto the outside diameter of the second body portion 2006. The hammer 36*j* can be received onto the first body portion 2004 of the spindle 550*j* forwardly of the flange 2008 and can include a set of hammer teeth 52*j*. The cam mechanism 552*j*, can include a pair of V-shaped grooves 564*j* formed on the perimeter of the first body portion 2004 and a pair of balls 566*j*. The balls 566*j* can be received into the V-shaped grooves 564*j* and corresponding recesses (not shown) formed in the hammer 36*j* to couple the hammer 36*j* to the spindle 550*j* in a manner that permits limited rotational and axial movement of the hammer 36*j* relative to the spindle 550*j*. Such cam mechanisms are well known in the art and as such, the cam mechanism 552*j* will not be described in further detail. The hammer spring 554*j* can be disposed coaxially about the first body portion 2004 of the spindle 550*j* and can abut the flange 2008 and the hammer 36*j* to thereby bias the hammer 36*j* toward the anvil 38*j*. The anvil 38*j* can be coupled for rotation with the output spindle 16*j* and can include a plurality of anvil teeth 54*j*. The anvil 38*j* can be unitarily formed with the output spindle 16*j*. One or more bearings 2016 can be employed to support the output spindle 16*j*.

The mode change mechanism 18*j* can include a carrier 2020, a plurality of planet gears 2022, a ring gear 2024, a sun gear 2026 and a mode collar 2028. The carrier 2020 can include a carrier plate 2030, which can be integrally formed with the driven gear 2002, and a plurality of pins 2032 that can be fixedly coupled to the carrier plate 2030. Each of the planet gears 2022 can be journally mounted on a corresponding one of the pins 2032. The ring gear 2024 can include a plurality of ring gear teeth and can be integrally formed with the second body portion 2006 of the spindle 550*j*. The sun gear 2026 can include a plurality of sun gear teeth and can be fixedly coupled (e.g., integrally formed) with the anvil 38*j* and/or the output spindle 16*j*. The planet gears 2022 can be meshingly engaged with the ring gear teeth and the sun gear teeth. The mode collar 2028 can include a toothed interior 2040 that can be meshingly engaged with the mode change teeth 2010. An appropriate switching mechanism (not shown) can be employed to axially translate the mode collar 2028 between a first position, in which the toothed interior 2040 of the mode collar 2028 is engaged only to the mode change teeth 2010, and a second position in which the toothed interior 2040 is engaged to both the mode change teeth 2010 and the teeth of the driven gear 2002.

The mode collar 2028 can be positioned in the first position to cause the hybrid impact tool 10*j* to be operated in an automatic mode. In this mode, rotary power transmitted through the transmission 12*j* to the mode change mechanism 18*j* will cause the carrier 2020 and the driven gear 2002 to rotate. When the torque output through the output spindle 16*j* is below a predetermined threshold, the planet gears 2022, the ring gear 2024 and the sun gear 2026 can rotate with the driven gear 2002 and the carrier 2020 to thereby directly drive the output spindle 16*j* in a continuous, non-impacting manner. When the torque transmitted through the output spindle 16*j* is greater than or equal to the predetermined threshold such that the sun gear 2026 has slowed relative to the carrier 2020, a differential effect will occur in which the rotary power is transmitted to the ring gear 2024 to drive the ring gear 2024 at a speed that is faster than the rotational speed of the carrier 2020 and the rotational speed of the anvil 38*j*. Such rotation of the ring gear 2024 drives the spindle 550*j* and the hammer 36*j* relative to the anvil 38*j* so that the impact mechanism 14*j* can operate to apply a rotary impacting input to the output spindle 16*j*. In situations where the torque transmitted through the output spindle 16*j* drops below the predetermined threshold, the sun gear 2026 is able to rotate at the same speed as the carrier 2020 and as such, the output spindle 16*j* will be driven in a continuous, non-impacting manner (i.e., the mode change mechanism 18*j* will automatically switch from the rotary impacting mode to the drill mode).

The mode collar 2028 can also be positioned in the second position to cause the hybrid impact tool 10*j* to be locked in a drill mode such that a continuous rotary input is provided to the output spindle 16*j*. In the second position, the toothed interior 2040 of the mode collar 2028 can be engaged to both the mode change teeth 2010 and the teeth of the driven gear 2002 to thereby inhibit rotation of the ring gear 2024 relative to the sun gear 2026.

Figure 44:
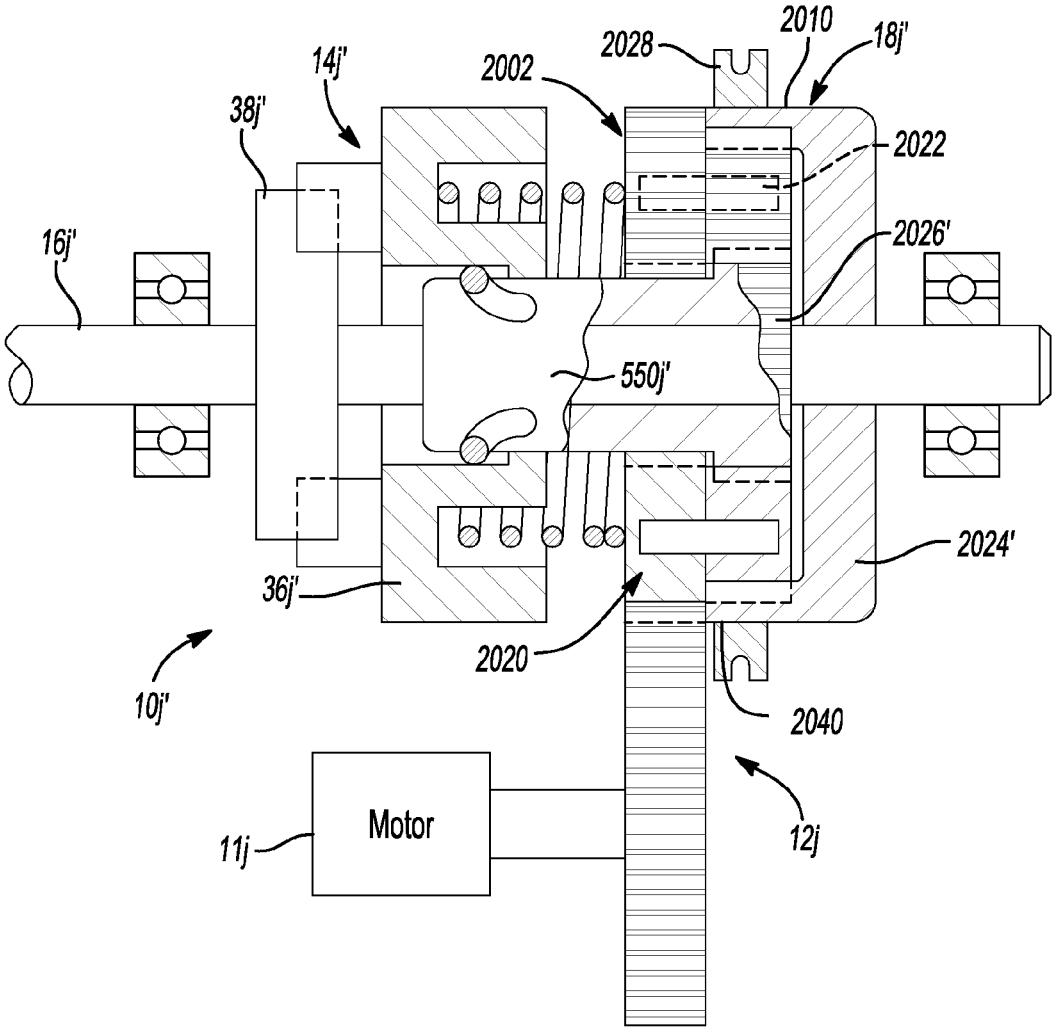
FIG. 44 is a section view similar to that of FIG. 43 but illustrating an alternately constructed hybrid impact tool.

An alternatively constructed hybrid impact tool 10*j*' is illustrated in FIG. 44. The hybrid impact tool 10*j*' can be generally similar to the hybrid impact tool 10*j* of FIG. 43, except that the spindle 550*j*' of the impact mechanism 14*j*' is coupled to the sun gear 2026' for rotation therewith, the anvil 38*j*' and the output spindle 16*j*' are coupled to the ring gear 2024' for rotation therewith, and the positions of the ring gear 2024' and the carrier 2020/driven gear 2002 are flipped relative to the positions illustrated in FIG. 43.

The mode collar 2028 can be positioned in the first position (shown) to cause the hybrid impact tool 10*j*' to be operated in an automatic mode in which rotary power transmitted through the transmission 12*j* to the mode change mechanism 18*j*' to cause the driven gear 2002 and the carrier 2020 to rotate. When the torque that is output through the output spindle 16*j*' is below the predetermined threshold, the planet gears 2022, the ring gear 2024' and the sun gear 2026' can rotate with the driven gear 2002 and the carrier 2020 to thereby directly drive the output spindle 16*j*' in a continuous, non-impacting manner. When the torque transmitted through the output spindle 16*j*' is greater than or equal to the predetermined threshold such that ring gear 2024' has slowed relative to the carrier 2020, a differential effect will occur in which rotary power is transmitted to the sun gear 2026' to drive the sun gear 2026' at a speed that is faster than both the rotational speed of the carrier 2020 and the rotational speed of the anvil 38*j*'. Such rotation of the sun gear 2026' drives the spindle 550*j*', and thereby the hammer 36*j*' relative to the anvil 38*j*' so that the impact mechanism 14*j*' can operate to apply a rotary impacting input to the output spindle 16*j*'. In situations where the torque transmitted through the output spindle 16*j*' drops below the predetermined threshold, the ring gear 2024' is able to rotate at the same speed as the carrier 2020 and as such, the output spindle 16*j*' will be driven in a continuous, non-impacting manner (i.e., the mode change mechanism 18*j*' will automatically switch from the rotary impacting mode to the drill mode).

The mode collar 2028 can also be positioned in the second position (not shown) to cause the hybrid impact tool 10*j*' to be locked in a drill mode such that a continuous rotary input is provided to the output spindle 16*j*'. In the second position, the toothed interior 2040 of the mode collar 2028 can be engaged to both the mode change teeth 2010 on the ring gear 2024' and the teeth of the driven gear 2002 to thereby inhibit rotation of the ring gear 2024' relative to the sun gear 2026'.

In contrast to the example of FIG. 43, which can achieve a speed-up ratio (i.e., a rotational speed of the spindle 550*j* relative to a rotational speed of the driven gear 2002) that is less than a ratio of about 2:1 when the hybrid impact tool 10*j* is operated in the rotary impact mode, the example of FIG. 44 can achieve a speed-up ratio (i.e., a rotational speed of the spindle 550*j*' relative to a rotational speed of the driven gear 2002) that is greater than a ratio of about 2:1. Configuration of the mode change mechanism 18j/18j' in this manner permits the hybrid impact tool 10j/10j' to be operated at a rotational speed that is well suited for drilling and driving tasks when the tool is operated in a drill mode, but also to have a sufficiently high rate of impacts between the hammer 36j/36j' and the anvil 38j/38j' when the tool is operated in the rotary impact mode.

Figure 45:
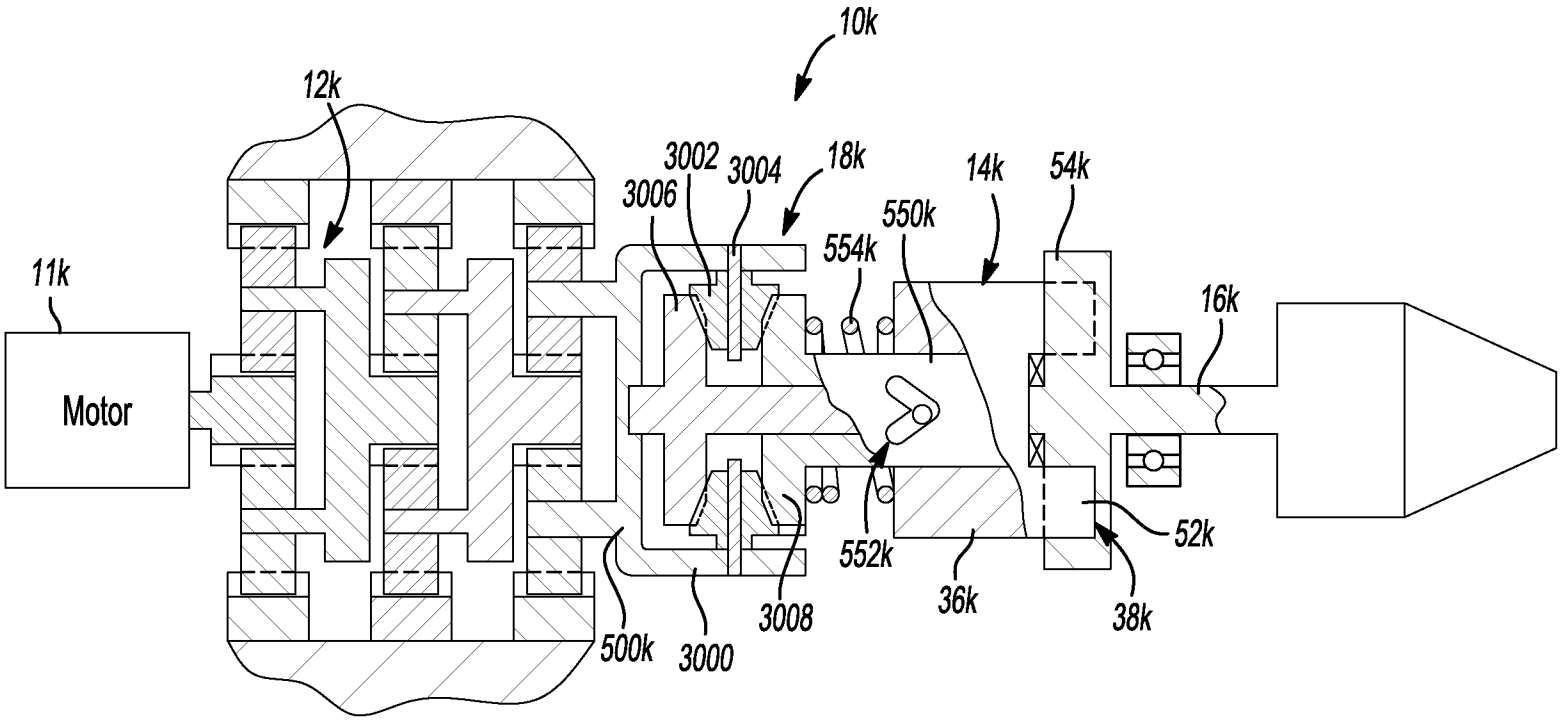
FIG. 45 is a side elevation view in partial section of another hybrid impact tool constructed in accordance with the teachings of the present disclosure.

Another example of a hybrid impact tool constructed in accordance with the teachings of the present disclosure is generally indicated by reference numeral 10k in FIG. 45. The hybrid impact tool 10k can include a motor 11k, a transmission 12k, an impact mechanism 14k, an output spindle 16k and a mode change mechanism 18k. The motor 11k can be any type of motor (e.g., electric, pneumatic, hydraulic) and can provide rotary power to the transmission 12k. The transmission 12k can include a single speed multi-stage (e.g., three stage) planetary gear reduction that can include a transmission output member 500k. In the particular example provided, the transmission output member 500k is a carrier that is configured to support (and be driven by) a plurality of planet gear that are associated with a final stage of the planetary gear reduction. The impact mechanism 14k can include a spindle (input spindle) 550k, a hammer 36k, a cam mechanism 552k, a hammer spring 554k and an anvil 38k. The spindle 550k is hollow and can be rotatably disposed on the output shaft 16k. The hammer 36k can be received onto the spindle 550k and can include a set of hammer teeth 52k. The cam mechanism 552k can be similar to the cam mechanism 552j illustrated in FIG. 43 and described above. Accordingly, it will be appreciated that the cam mechanism 552k can couple the hammer 36k to the spindle 550k in a manner that permits limited rotational and axial movement of the hammer 36k relative to the spindle 550k. The hammer spring 554k can be disposed coaxially about the spindle 550k and can abut the hammer 36k to thereby bias the hammer 36k toward the anvil 38k. The anvil 38k can be coupled for rotation with the output spindle 16k and can include a plurality of anvil teeth 54k. The anvil 38k can be unitarily formed with the output spindle 16k. One or more bearings can be employed to support the output spindle 16k.

The mode change mechanism 18k can include a carrier 3000, a plurality of differential pinions 3002, a plurality of pins 3004, a first side gear 3006 and a second side gear 3008. The carrier 3000 can be generally cup-shaped and can be coupled for rotation with the transmission output member 500k. In the particular example provided, the carrier 3000 and the transmission output member 500k are unitarily formed. The pins 3004 can be non-rotatably mounted to the carrier 3000 along an axis that is generally perpendicular to the rotational axis of the carrier 3000. The differential pinions 3002 can be received onto the pins 3004 such that the pins 3004 journally support the differential pinions 3002. The first side gear 3006 can be coupled for rotation with the output spindle 16k and can be meshingly engaged to the differential pinions 3002. The second side gear 3008 can be coupled for rotation with the spindle 550k and can be meshingly engaged with the differential pinions 3002. A side of the hammer spring 554k opposite the hammer 36k can be abutted against the second side gear 3008.

In operation, rotary power transmitted through the transmission 12k is employed to rotate the carrier 3000. When the reaction torque acting on the output spindle 16k is below a predetermined threshold, rotation of the carrier 3000 will effect rotation of the first side gear 3006 without corresponding rotation of the differential pinions 3002 about a respective one of the pins 3004. Consequently, rotary power is transmitted to the output spindle 16k without being passed through the impact mechanism 14k. When the reaction torque acting on the output spindle 16k is equal to or above the predetermined threshold, the first side gear 3006 will slow or stop relative to the second side gear 3008; such differential movement between the first and second side gears 3006 and 3008 is facilitated through rotation of the differential pinions 3002 about the pins 3004 as the carrier 3000 rotates. Differential rotation of the second side gear 3008 at a rotational speed that is relatively faster than the rotational speed of the first side gear 3006 drives the hammer 38k at a rotational speed that is faster than the anvil 38k so that the impact mechanism 14k can operate to apply a rotary impacting input to the output spindle 16k. In situations where the torque transmitted through the output spindle 16k drops below the predetermined threshold, the first side gear 3006 is able to rotate at the same speed as the second side gear 3008 and as such, the output spindle 16k will be driven in a continuous, non-impacting manner (i.e., the mode change mechanism 18k will automatically switch from the rotary impacting mode to the drill mode).

Figure 46:
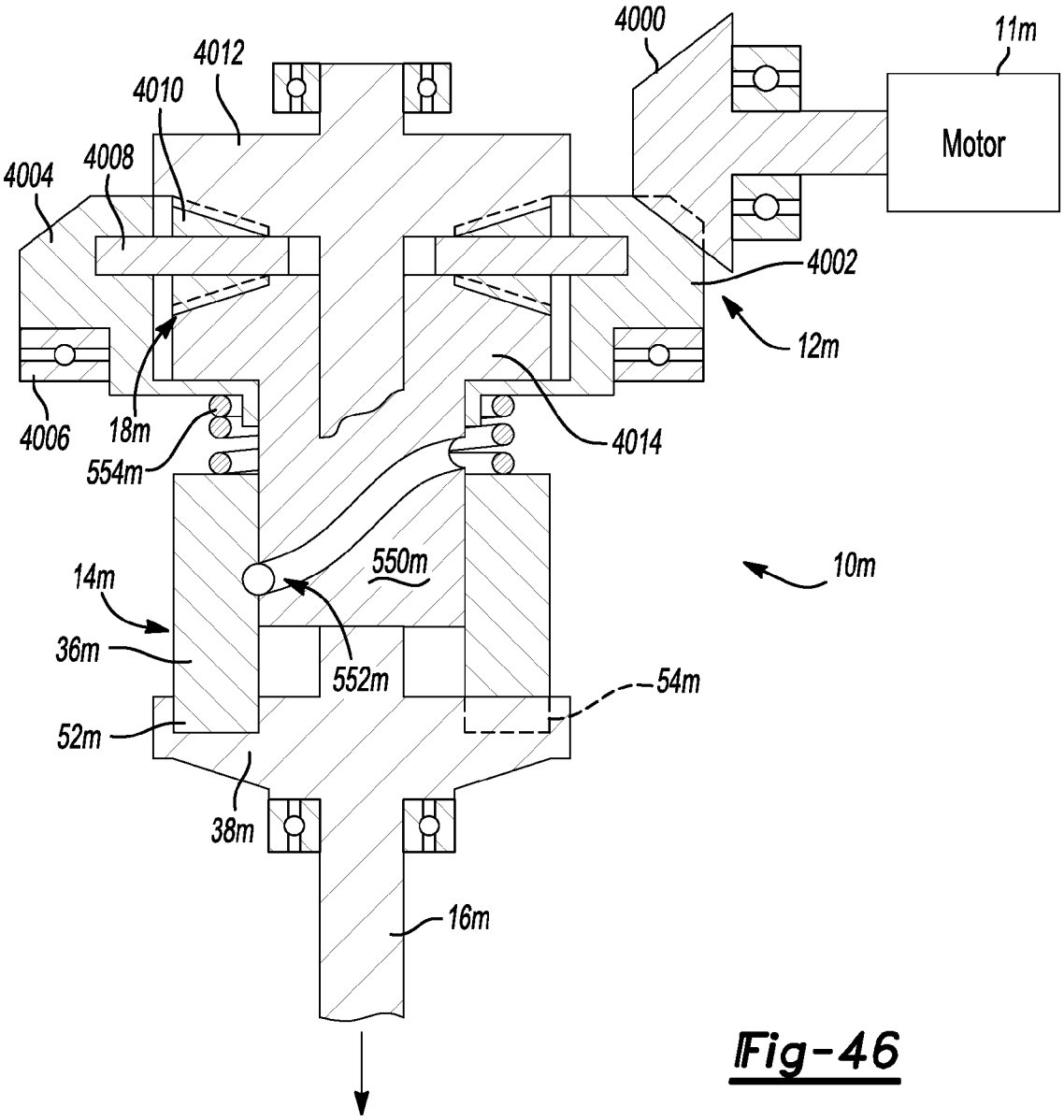
FIG. 46 is a side elevation view in partial section of yet another hybrid impact tool constructed in accordance with the teachings of the present disclosure.

Yet another example of a hybrid impact tool constructed in accordance with the teachings of the present disclosure is generally indicated by reference numeral 10m in FIG. 46. The hybrid impact tool 10m can include a motor 11m, a transmission 12m, an impact mechanism 14m, an output spindle 16m and a mode change mechanism 18m. The motor 11m can be any type of motor (e.g., electric, pneumatic, hydraulic) and can provide rotary power to the transmission 12m. The transmission 12m can include a single speed bevel gear reduction that can include a bevel pinion 4000, which can be driven by the motor 11m, and a transmission output member or bevel gear 4002. The impact mechanism 14m can include a spindle (input spindle) 550m, a hammer 36m, a cam mechanism 552m, a hammer spring 554m and an anvil 38m. The spindle 550m is hollow and can be rotatably disposed on the output shaft 16m. The hammer 36m can be received onto the spindle 550m and can include a set of hammer teeth 52m. The cam mechanism 552m can be similar to the cam mechanism 552j illustrated in FIG. 43 and described above. Accordingly, it will be appreciated that the cam mechanism 552m can couple the hammer 36m to the spindle 550m in a manner that permits limited rotational and axial movement of the hammer 36m relative to the spindle 550m. The hammer spring 554m can be disposed coaxially about the spindle 550m and can abut the hammer 36m to thereby bias the hammer 36m toward the anvil 38m. The anvil 38m can be coupled for rotation with the output spindle 16m and can include a plurality of anvil teeth 54m. The anvil 38m can be unitarily formed with the output spindle 16m. One or more bearings can be employed to support the output spindle 16m.

The mode change mechanism 18m can include a carrier 4004, a thrust bearing 4006, a plurality of pins 4008, a plurality of differential pinions 4010, a first side gear 4012 and a second side gear 4014. The carrier 4004 can be generally cup-shaped and can be coupled for rotation with the bevel gear 4002. In the particular example provided, the carrier 4004 and the bevel gear 4002 are unitarily formed. The thrust bearing 4006 can support the carrier 4004 for rotation relative to a housing (not shown). The pins 4008 can be non-rotatably mounted to the carrier 4004 along an axis that is generally perpendicular to the rotational axis of the carrier 4004. The differential pinions 4010 can be received onto the pins 4008 such that the pins 4008 journally support the differential pinions 4010. The first side gear 4012 can be coupled for rotation with the output spindle 16m and can be meshingly engaged to the differential pinions 4010. The second side gear 4014 can be coupled for rotation with the spindle 550m and can be meshingly engaged with the differential pinions 4010. A side of the hammer spring 554*m* opposite the hammer 36*k* can be abutted against the second side gear 4014.

In operation, rotary power transmitted through the transmission 12*m* is employed to rotate the carrier 4004. When the reaction torque acting on the output spindle 16*m* is below a predetermined threshold, rotation of the carrier 4004 will effect rotation of the first side gear 4012 without corresponding rotation of the differential pinions 4010 about a respective one of the pins 4008. Consequently, rotary power is transmitted to the output spindle 16*m* without being passed through the impact mechanism 14*m*. When the reaction torque acting on the output spindle 16*m* is equal to or above the predetermined threshold, the first side gear 4012 will slow or stop relative to the second side gear 4014; such differential movement between the first and second side gears 4012 and 4014 is facilitated through rotation of the differential pinions 4010 about the pins 4008 as the carrier 4004 rotates. Differential rotation of the second side gear 4014 at a rotational speed that is relatively faster than the rotational speed of the first side gear 4012 drives the hammer 38*m* at a rotational speed that is faster than the anvil 38*m* so that the impact mechanism 14*m* can operate to apply a rotary impacting input to the output spindle 16*m*. In situations where the torque transmitted through the output spindle 16*m* drops below the predetermined threshold, the first side gear 4012 is able to rotate at the same speed as the second side gear 4014 and as such, the output spindle 16*m* will be driven in a continuous, non-impacting manner (i.e., the mode change mechanism 18*m* will automatically switch from the rotary impacting mode to the drill mode).

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A power tool comprising:

a motor;

a transmission receiving rotary power from the motor, the transmission having a transmission output member;

a rotary impact mechanism having a spindle, a hammer, a cam mechanism, and an anvil, the hammer being mounted on the spindle, the cam mechanism coupling the hammer to the spindle in a manner that permits limited rotational and axial movement of the hammer relative to the spindle, the hammer including hammer teeth for drivingly engaging a plurality of anvil teeth formed on the anvil; and a mode change mechanism having an actuating member and a mode collar, the actuating member being axially movable to affect a position of the mode collar, the mode collar being movable between a first position, in which the mode collar directly couples the hammer to the transmission output member to inhibit movement of the hammer relative to the spindle, and a second position in which the mode collar does not inhibit movement of the hammer relative to the spindle;

wherein the mode collar is movable from the second position to the first position regardless of a rotational position of the hammer relative to the anvil.

2. The power tool of claim 1, wherein the mode collar comprises a first set of locking features, which are engagable to a first set of mating locking features on the transmission output member, and a second set of locking features, which are engagable to a second set of mating locking features on the hammer, and wherein the first and second sets of locking features are axially spaced apart from one another.

3. The power tool of claim 2, wherein one of the first and second sets of locking features is on an inside surface of the mode collar.

4. The power tool of claim 3, wherein the other one of the first and second sets of locking features is on the inside surface of the mode collar.

5. The power tool of claim 2, wherein a surface of the mode collar has a non-circular shape and the non-circular shape defines the first set of locking features.

6. The power tool of claim 5, wherein the non-circular shape comprises a plurality of teeth.

7. The power tool of claim 5, wherein the non-circular shape has sides that are arranged as a regular polygon.

8. The power tool of claim 2, wherein the mating locking features on the hammer are disposed between the second set of locking features on the mode collar and the transmission output member when the mode collar is in the second position.

9. The power tool of claim 1, wherein the mode collar comprises an annular channel into which a portion of the actuating member is received.

10. The power tool of claim 9, wherein the actuating member comprises a shift fork having at least one lug that is received in the annular channel and being configured to contact the mode collar in at least two circumferentially spaced apart locations.

11. The power tool of claim 1, wherein movement of the mode collar from the first position to the second position moves the mode collar in an axially forward direction away from the motor and toward the anvil.

12. The power tool of claim 1, wherein the spindle is rotatable about a rotary axis, wherein the mode collar is disposed within a first cylindrical envelope that is defined by a first radius that is perpendicular to the rotary axis, wherein the hammer is disposed within a second cylindrical envelope that is defined by a second radius that is perpendicular to the rotary axis and wherein the second radius is larger than the first radius.

13. A power tool comprising:

a motor;

a transmission receiving rotary power from the motor, the transmission having a transmission output member;

a rotary impact mechanism having a spindle, a hammer, an anvil, a spring and a cam mechanism, the hammer being mounted on the spindle and including a plurality of hammer teeth, the anvil having a set of anvil teeth, the spring biasing the hammer toward the anvil such that the hammer teeth engage the anvil teeth, the cam mechanism coupling the hammer to the spindle such that the hammer teeth can move axially rearward to disengage the anvil teeth;

an output spindle coupled for rotation with the anvil; and a mode change mechanism comprising a mode collar, the mode collar being axially movable between a first position and a second position;

wherein rotary power transmitted between the hammer and the anvil during operation of the power tool flows exclusively from the spindle through the cam mechanism to the hammer when the mode collar is in the first position and wherein rotary power transmitted between the hammer and the anvil during operation of the power tool flows through a path that does not include the cam mechanism when the mode collar is in the second position;

wherein a maximum outside diameter of the mode collar is smaller in diameter than the hammer.

14. The power tool of claim 13, wherein the mode collar is movable from the first position to the second position regardless of a rotational position of the hammer relative to the anvil.

15. The power tool of claim 13, wherein the spring is disposed radially inwardly of the mode collar.

16. The power tool of claim 13, wherein rotary power transmitted between the hammer and the anvil during operation of the power tool does not flow through the cam mechanism when the mode collar is in the second position.

* * * * *